US009117584B2

(12) United States Patent
Tanaka et al.

(10) Patent No.: US 9,117,584 B2
(45) Date of Patent: Aug. 25, 2015

(54) SOLENOID DEVICE AND SOLENOID CONTROL SYSTEM

(71) Applicants: NIPPON SOKEN, INC., Nishio, Aichi-pref. (JP); ANDEN CO., LTD., Anjo, Aichi-pref. (JP)

(72) Inventors: Ken Tanaka, Aichi-ken (JP); Osamu Daitoku, Kariya (JP); Tomoaki Tanaka, Okazaki (JP)

(73) Assignees: NIPPON SOKEN, INC., Nishio (JP); ANDEN CO., LTD, Anjo (JP)

( * ) Notice: Subject to any disclaimer, the term of this patent is extended or adjusted under 35 U.S.C. 154(b) by 0 days.

(21) Appl. No.: 14/176,498

(22) Filed: Feb. 10, 2014

(65) Prior Publication Data

US 2014/0225691 A1 Aug. 14, 2014

(30) Foreign Application Priority Data

Feb. 8, 2013 (JP) ..... 2013-023665
Jan. 28, 2014 (JP) ..... 2014-012891

(51) Int. Cl.

| | |
|---|---|
| ***H01F 7/02*** | (2006.01) |
| ***H01F 7/16*** | (2006.01) |
| ***H01H 50/00*** | (2006.01) |
| ***H01H 50/20*** | (2006.01) |
| ***H01H 51/20*** | (2006.01) |
| *H01F 7/08* | (2006.01) |

(52) U.S. Cl.

CPC ..... *H01F 7/1638* (2013.01); *H01H 50/00* (2013.01); *H01H 50/20* (2013.01); *H01H 51/20* (2013.01); *H01F 2007/086* (2013.01); *H01F 2007/1692* (2013.01)

(58) Field of Classification Search

CPC ..... H01F 7/1638; H01F 2007/1692; H01F 2007/086; H01H 50/00
USPC ..... 335/209, 217, 220, 266, 267
See application file for complete search history.

(56) References Cited

U.S. PATENT DOCUMENTS

| | | | | |
|---|---|---|---|---|
| 8,400,243 | B2 * | 3/2013 | Okada et al. | 335/278 |
| 8,729,992 | B2 * | 5/2014 | Schiepp et al. | 335/229 |
| 2004/0051608 | A1 * | 3/2004 | Donce | 335/256 |
| 2008/0164964 | A1 * | 7/2008 | Nelson | 335/229 |

FOREIGN PATENT DOCUMENTS

| | | |
|---|---|---|
| JP | 2009-140835 | 6/2009 |
| JP | 2010-212035 | 9/2010 |
| JP | 2010-287455 | 12/2010 |

* cited by examiner

*Primary Examiner* — Bernard Rojas
(74) *Attorney, Agent, or Firm* — Nixon & Vanderhye, P.C.

(57) ABSTRACT

A solenoid device is provided which is equipped with a first and a second magnetic coil and a first, a second, and a third magnetic circuit, and designed so that when the second magnetic coil is deenergized while the first magnetic coil is kept energized following a dual-energized mode in which the first and second magnetic coils are energized, the magnetic flux Φ flowing through the second magnetic circuit disappears. The magnetic flux Φ of the first magnetic coil, thus, continues to flow though the first and third magnetic circuits, thereby creating a magnetic force to keep a first plunger and a third plunger attracted. This enables the plungers to be attracted independently from each other and results in a decrease in power consumption of the magnetic coils when the plurality of plungers are attracted simultaneously.

20 Claims, 37 Drawing Sheets

SOLENOID DEVICE AND SOLENOID CONTROL SYSTEM

CROSS REFERENCE TO RELATED DOCUMENT

The present application claims the benefit of priority of Japanese Patent Application Nos. 2013-23665 and 2014-12891 filed on Feb. 8, 2013 and Jan. 28, 2014, disclosures of which are incorporated herein by reference.

TECHNICAL FIELD

The present invention generally relates to a solenoid device and a solenoid control system made up of a solenoid device and a control circuit.

BACKGROUND ART

Japanese Patent First Publication No. 2010-287455 discloses a solenoid device made up of magnetic coils which are energized to produce a magnetic flux, a plurality of plungers, stationary cores made from soft magnetic material.

The above solenoid device is designed to energize magnetic coils to generate a magnetic force and attract the plungers to the stationary cores. Springs are disposed between the plungers and the stationary cores. When the magnetic coils are deenergized, so that the magnetic force is lowered, the elastic force of the springs move the plungers away from the stationary cores. In this way, the plungers are moved forward or backward. The solenoid device is used in opening or closing, for example, a switch or a valve with the forward or backward movement of the plungers.

There are solenoid devices which have two modes: an individual attraction mode in which a plurality of plungers are individually attracted to a stationary core in a predetermined sequence and a simultaneous attraction mode in which the plungers are attracted to the stationary core simultaneously. The individual mode is used, for example, in turning on respective switches in sequence to check whether electric current will flow through a circuit or not, thereby inspecting whether the turned off switches are stuck or not. The simultaneous attraction mode is used in turning on a plurality of switches simultaneously to supply electric power to electric devices.

In order to perform the above two operation modes, the solenoid device is equipped with a plurality of magnetic coils. Each of the magnetic coils has a single plunger disposed in the center thereof. In the individual attraction mode, the magnetic coils are individually energized in a given sequence to attract the plungers, respectively. In the simultaneous attraction mode, the magnetic coils are energized simultaneously to attract all the plungers at the same time.

However, the above solenoid devices face a big problem in that in the simultaneous attraction mode, the magnetic coils are energized simultaneously, thus resulting in an increase in power consumed by the magnetic coils.

SUMMARY OF THE INVENTION

It is an object of the present invention to provide a solenoid device which is designed to attract a plurality of plungers to a stationary core independently from each other and also to simultaneously attract the plunger to the stationary core with a decreased consumption of electric power and a solenoid control system which includes such a type of solenoid device and a control circuit.

According to one aspect of the invention, there is provided a solenoid device which comprises:

a first magnetic coil and a second magnetic coil which are energized to produce magnetic fluxes;

a first plunger which is moved frontward or backward by energization of the first magnetic coil;

a second plunger which is moved frontward or backward by energization of the second magnetic coil;

a first stationary core which is disposed so as to face the first plunger in a frontward/backward movement direction of the first plunger;

a second stationary core which is disposed so as to face the second plunger in a frontward/backward movement direction of the second plunger; and a yoke which is disposed outside the first and second magnetic coils, wherein in a dual-deenergized mode in which the above two magnetic coils are both deenergized, gaps are created between the first plunger and the first stationary core and between the second plunger and the second stationary core, wherein when the first magnetic coil is energized, the magnetic flux of the first magnetic coil flows through a first magnetic circuit which includes only the first stationary core, thereby producing a magnetic force which attracts the first plunger to the first stationary core, wherein when the second magnetic coil is energized, the magnetic flux of the second magnetic coil flows through a second magnetic circuit which includes only the second stationary core, thereby producing a magnetic force which attracts the second plunger to the second stationary core, wherein in a dual-energized mode in which the above two magnetic coils are both energized, the magnetic fluxes of the two magnetic coils flow through the first and second magnetic circuits, thereby producing a magnetic force which attracts the first and second plungers, and a portion of the magnetic flux of the first magnetic coil flows through a third magnetic circuit which includes the above two stationary cores, and wherein when the second magnetic coil is deenergized while the first magnetic coil is kept energized following the dual-energized mode, the magnetic flux of the first magnetic coil flows through the first magnetic circuit and the third magnetic circuit, thereby producing magnetic forces to maintain a dual-attracting mode in which the first plunger is attracted to the first stationary core, and the second plunger is attracted to the second stationary core.

According to the second aspect of the invention, there is provided a solenoid control system which includes the above solenoid device, and a control circuit which controls the solenoid device. The control circuit controls directions of currents to be delivered to the first magnetic coil and the second magnetic coil in the dual-energized mode so that the magnetic flux of the first magnetic coil which flows through the third magnetic circuit and the magnetic flux of the second magnetic coil which flows through the second magnetic circuit will be oriented in the same direction in the second stationary core.

In the above solenoid device, when the second magnetic coil is deenergized while the first magnetic coil is kept energized following the dual-energized mode, the magnetic force, as produced by the magnetic flux of the first magnetic coil flowing in the first magnetic circuit and the third magnetic circuit works to keep the first plunger and the second plunger attracted to the first stationary core and the second stationary core, respectively. This causes the two plungers to continue to be attracted only by the energization of the first magnetic coil without having to energize the second magnetic coil. This results in a decrease in power consumption in the magnetic coils.

The above solenoid device is capable of attracting only the first plunger to the first stationary core without attracting the second plunger, for example, when only the first magnetic coil is energized following the dual-deenergized mode. Specifically, in the dual-deenergized mode, the number of the gaps existing in the first magnetic circuit is one: the gap (first gap) between the first plunger and the first magnetic core, while the number of the gaps existing in the third magnetic circuit is two: the gap (second gap) between the second plunger and the second magnetic core, and the first gap. The first magnetic circuit is, thus, lower in magnetic resistance than the third magnetic resistance. Therefore, when the dual-deenergized mode is switched to a mode, for example, in which only the first magnetic coil is energized, the magnetic flux of the first magnetic coil mainly flows through the first magnetic circuit, while it hardly flows in the third magnetic circuit which is higher in magnetic resistance. This enables only the first plunger to be attracted to the first stationary core without the second plunger being attracted.

Similarly, when the dual-deenergized mode is switched to a mode, for example, in which only the second magnetic coil is energized, only the second plunger to be attracted to the second stationary core without the first plunger being attracted.

As described above, the solenoid device works to attract the first plunger and the second plunger independently from each other.

In the solenoid control system, the control circuit serves to control the directions in which the current is to be delivered to the first magnetic coil and the second magnetic coil so that the magnetic flux of the first magnetic coil which flows through the third magnetic circuit and the magnetic flux of the second magnetic coil which flows through the second magnetic circuit will be oriented in the same direction in the second stationary core in the dual-energized mode.

Accordingly, the magnetic fluxes of the two magnetic coils are reinforced by each other in the second stationary core in the dual-energized mode. This increases the magnetic force acting on the second plunger. In the dual-energized mode, the magnetic flux of the second magnetic coil also flows in the third magnetic circuit. The above structure, thus, works to orient the magnetic flux of the second magnetic coil which flows in the third magnetic circuit and the magnetic flux of the first magnetic coil which flows in the first magnetic circuit in the same direction, thus producing a strong magnetic force attracting the first plunger.

As described above, the present invention provides a solenoid device which is capable of attracting a plurality of plungers to stationary cores independently from each other and also attracting the plunger to the stationary cores simultaneously with a decreased consumption of electric power and a solenoid control system.

EMBODIMENTS

Figure 1:
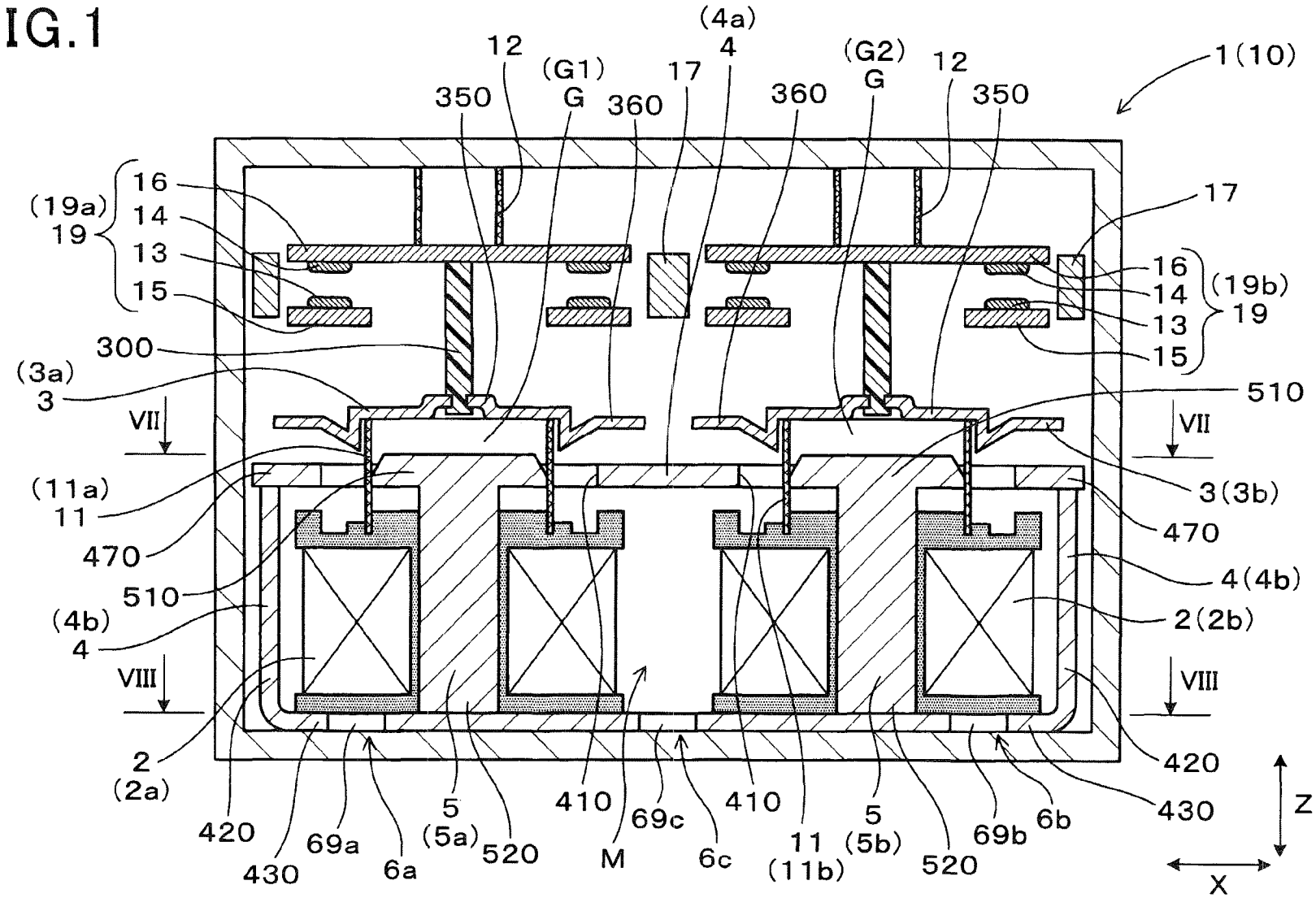
FIG. 1 is a sectional view of a solenoid device in the first embodiment.

Prior to explanation of specific embodiments, the solenoid device, as referred to the above "SUMMARY OF THE INVENTION", will further be described below.

The solenoid device may be employed in, for example, an electromagnetic relay. For instance, the electromagnetic relay may be designed to have two switches one of which is open or closed by a first plunger and the other of which is open or closed by a second plunger.

It is advisable that the above described first magnetic circuit have a first magnetically-saturated portion in which the magnetic flux flowing through the first magnetic circuit is saturated.

In the above case, it is possible to continue to attract the two plungers absolutely using the magnetic flux of the first magnetic coil when the second magnetic flux is deenergized following the dual-energized mode. Specifically, the above first magnetically-saturated portion limits the amount of magnetic flux flowing through the first magnetic circuit, so that a sufficient amount of magnetic flux will also flow in the third magnetic circuit without flow of an excessive amount of magnetic flux only in the first magnetic circuit. This facilitates the ease with which the magnetic flux of the first magnetic coil is supplied equally to the first magnetic circuit and the third magnetic circuit, thereby making degrees of force attracting the two plungers equal to each other. This facilitates the ease with which the two plungers are kept attracted.

It is advisable that the above third magnetic circuit have formed therein a third magnetically-saturated portion in which the magnetic flux flowing through the third magnetic circuit is saturated.

The above case facilitates the operation attracting only the first plunger. Specifically, when the dual-energized mode is switched to a mode in which only the first magnetic coil is energized, most of the magnetic flux of the first magnetic coil, as described above, flows through the first magnetic circuit, but it may also partially flow to the third magnetic circuit to attract the second plunger when the above described second gap is small. Therefore, the third magnetically-saturated portion makes the magnetic flux of the first magnetic coil less likely to flow through the third magnetic circuit in the above case, thus enabling only the first plunger to be attracted absolutely without the second plunger being attracted.

It is also advisable that the number of turns of the second magnetic coil be smaller than that of the first magnetic coil.

The above case allows the amount of conductive wire used in the second magnetic coil to be decreased, thus resulting in a decrease in production cost of the second magnetic coil. Specifically, the above solenoid device works to deenergize the second magnetic coil following the dual-energized mode and continue to attract the two plungers using only the magnetic flux of the first magnetic coil. The length of time the current is being supplied to the second magnetic coil is, thus, relatively short. It is also possible to almost equalize magnetomotive forces of the second magnetic coil and the first magnetic coil by supplying more current to the second magnetic coil than to the first magnetic coil although the number of turns of the second magnetic coil is less than that of the first magnetic coil. This results in an increase in amount of current flowing through the second magnetic coil, but the time for which the current is being delivered to the second magnetic coil is, as described above, short, thus resulting in a decrease in amount of electric power consumed by the second magnetic coil. It is, therefore, possible to decrease the number of turns of the second magnetic coil without increasing the power consumption, which permits the production cost of the second magnetic coil to be reduced.

In the second mode of the invention, when energizing the first magnetic coil to attract the first plunger to the first stationary core without attracting the second plunger to the second stationary core, the control circuit is preferably designed to deliver the current to the second magnetic coil so that the magnetic flux of the second magnetic coil will cancel, of the magnetic flux which is produced by the first magnetic coil and flows through the third magnetic circuit, a portion flowing through the second stationary core and the second plunger.

When energizing the second magnetic coil to attract the second plunger to the second stationary core without attracting the first plunger to the first stationary core, the control circuit is preferably designed to deliver the current to the first magnetic coil so that the magnetic flux of the first magnetic coil will cancel, of the magnetic flux which is produced by the second magnetic coil and flows through the third magnetic circuit, a portion flowing through the first stationary core and the first plunger.

The above case cancels, of the magnetic flux of either of the first magnetic coil or the second magnetic coil, a portion leaking to the third magnetic circuit. This avoids the attraction of the second plunger along with the first plunger when it is required to attract only the first plunger or the attraction of the first plunger along with the second plunger when it is required to attract only the second plunger.

EMBODIMENTS

First Embodiment

A solenoid device and a solenoid control system of the first embodiment will be described below using FIGS. 1 to 9. The solenoid device 1 is, as illustrated in FIG. 1, equipped with a first magnetic coil 2*a* and a second magnetic coil 2*b* which are energized to generate magnetic flux Φ, a first plunger 3*a*, a second plunger 3*b*, a first stationary core 5*a*, a second stationary core 5*b*, and a yoke 4. The first plunger 3*a* is moved forward or backward on the energization of the first magnetic coil 2*a*. The second plunger 3*b* is moved forward or backward on the energization of the second magnetic coil 2*b*.

Figure 2:
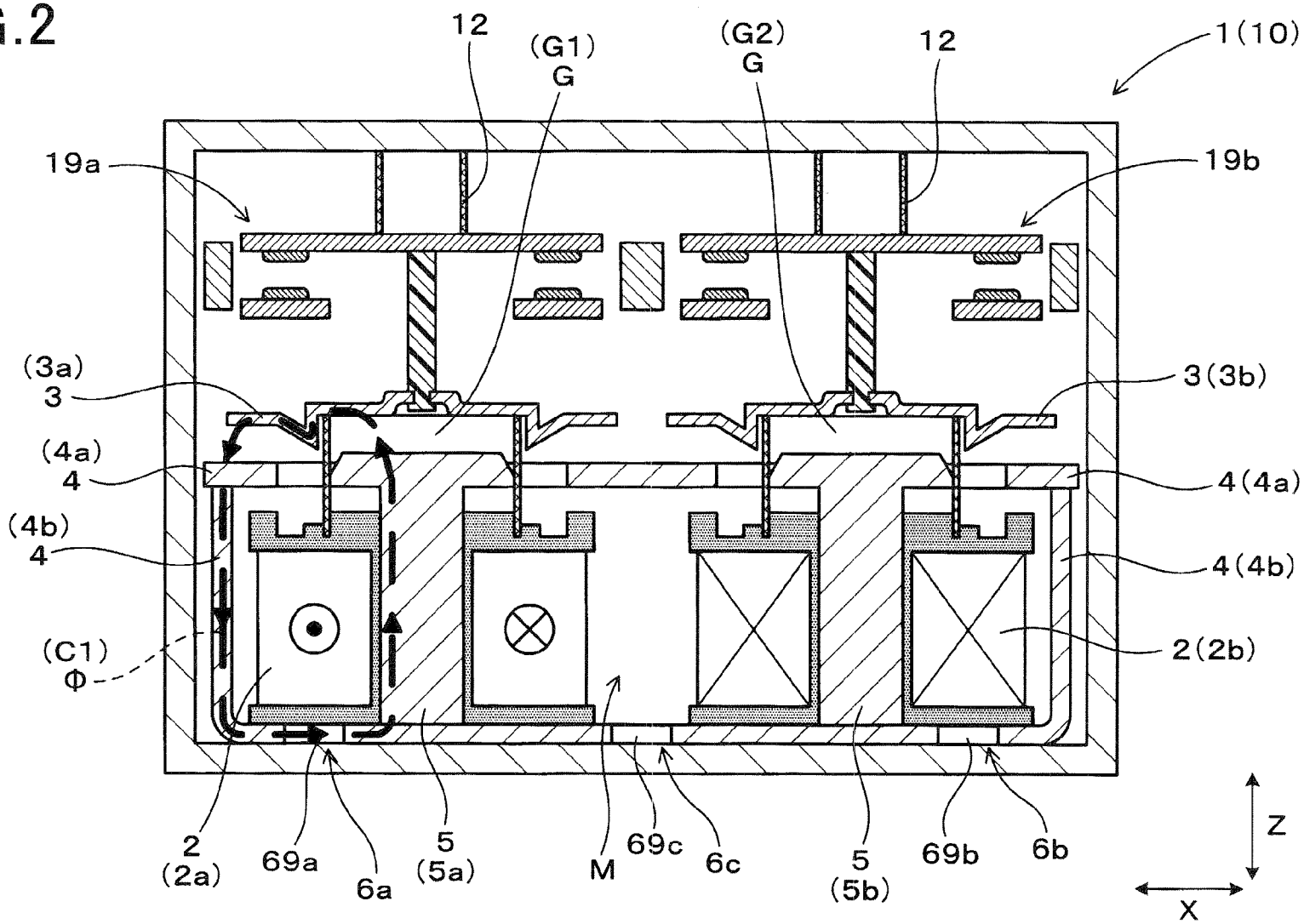
FIG. 2 is a sectional view of a solenoid device immediate after only a first magnetic coil is energized in the first embodiment.
Figure 3:
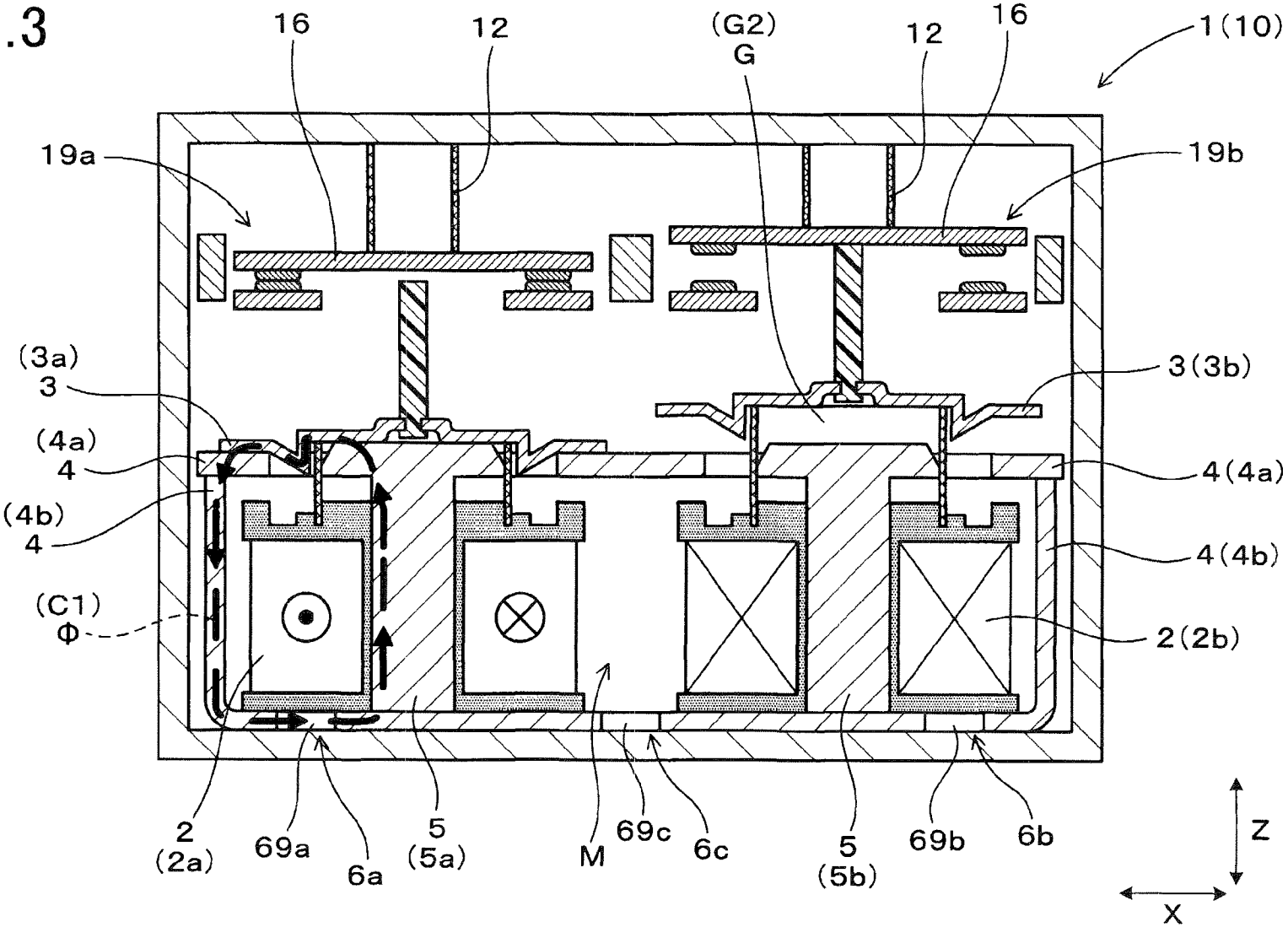
FIG. 3 is a sectional view which explains an operation of the solenoid device following an operation thereof in FIG. 2.
Figure 4:
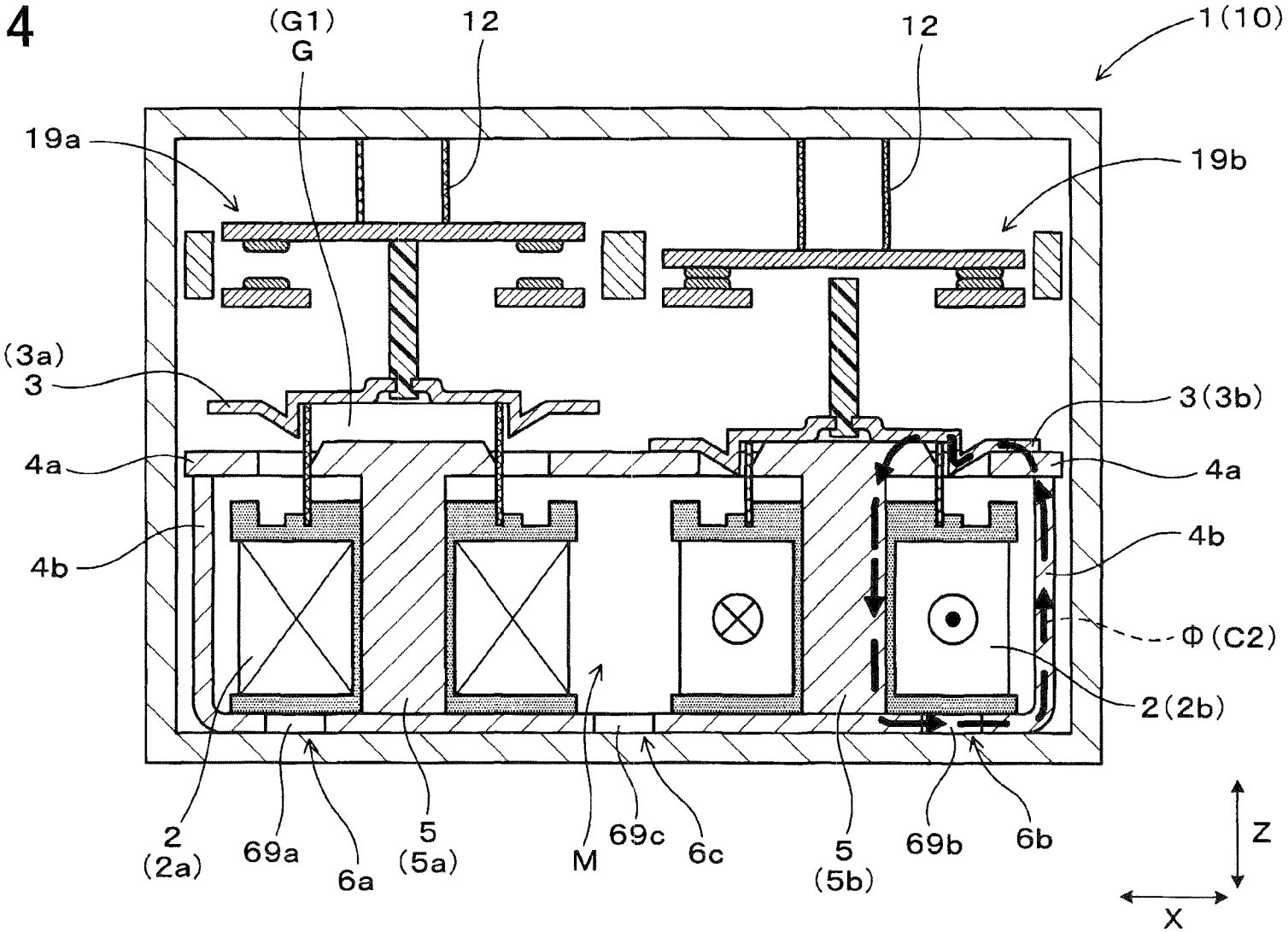
FIG. 4 is a sectional view of a solenoid device immediate after only a second magnetic coil is energized in the first embodiment.

The first stationary core 5*a* is disposed so as to face the first plunger 3*a* in a direction (i.e., the Z-direction) in which the first plunger 3*a* moved forward or backward. The second stationary core 5*b* is disposed so that it faces the second plunger 3*b* in a direction (i.e., the Z-direction) in which the second plunger 3*b* moved forward or backward. The yoke 4 includes a first yoke 4*a* and a second yoke 4*b*. The magnetic flux Φ, as illustrated in FIGS. 2 and 3, flows through the first yoke 4*a* and the first plunger 3*a*. Similarly, the magnetic flux Φ, as illustrated in FIG. 4, flows through the first yoke 4*a* and the second plunger 3*b*. The second yoke 4*b* connects with the first yoke 4*a*, the first stationary core 5*a*, and the second stationary core 5*b*.

In a dual-deenergized mode, as illustrated in FIG. 1, where both the two magnetic coils 2 are deenergized, gaps G (G1 and G2) are created between the first plunger 3*a* and the first stationary core 5*a* and between the second plunger 3*b* and the second stationary core 5*b*.

When the first magnetic coil 2*a* is, as illustrated in FIGS. 2 and 3, energized, the magnetic flux Φ of the first magnetic coil 2*a* flows in a first magnetic circuit C1 to produce a magnetic force which attracts the first plunger 3*a* to the first stationary core 5*a*. The first magnetic circuit C1 is a magnetic circuit including only the first stationary core 5*a* that is one of the two stationary cores 5*a* and 5*b*. The first magnetic circuit C1 is made up of the first stationary core 5*a*, the first plunger 3*a*, the first yoke 4*a*, and the second yoke 4*b*.

When the second magnetic coil 2*b* is, as illustrated in FIG. 4, energized, the magnetic flux Φ of the second magnetic coil 2*b* flows in a second magnetic circuit C2 to produce a magnetic force which attracts the second plunger 3*b* to the second stationary core 5*b*. The second magnetic circuit C2 is a magnetic circuit including only the second stationary core 5*b* that is one of the two stationary cores 5*a* and 5*b*. The second magnetic circuit C2 is made up of the second stationary core 5*b*, the second plunger 3*b*, the first yoke 4*a*, and the second yoke 4*b*.

Figure 5:
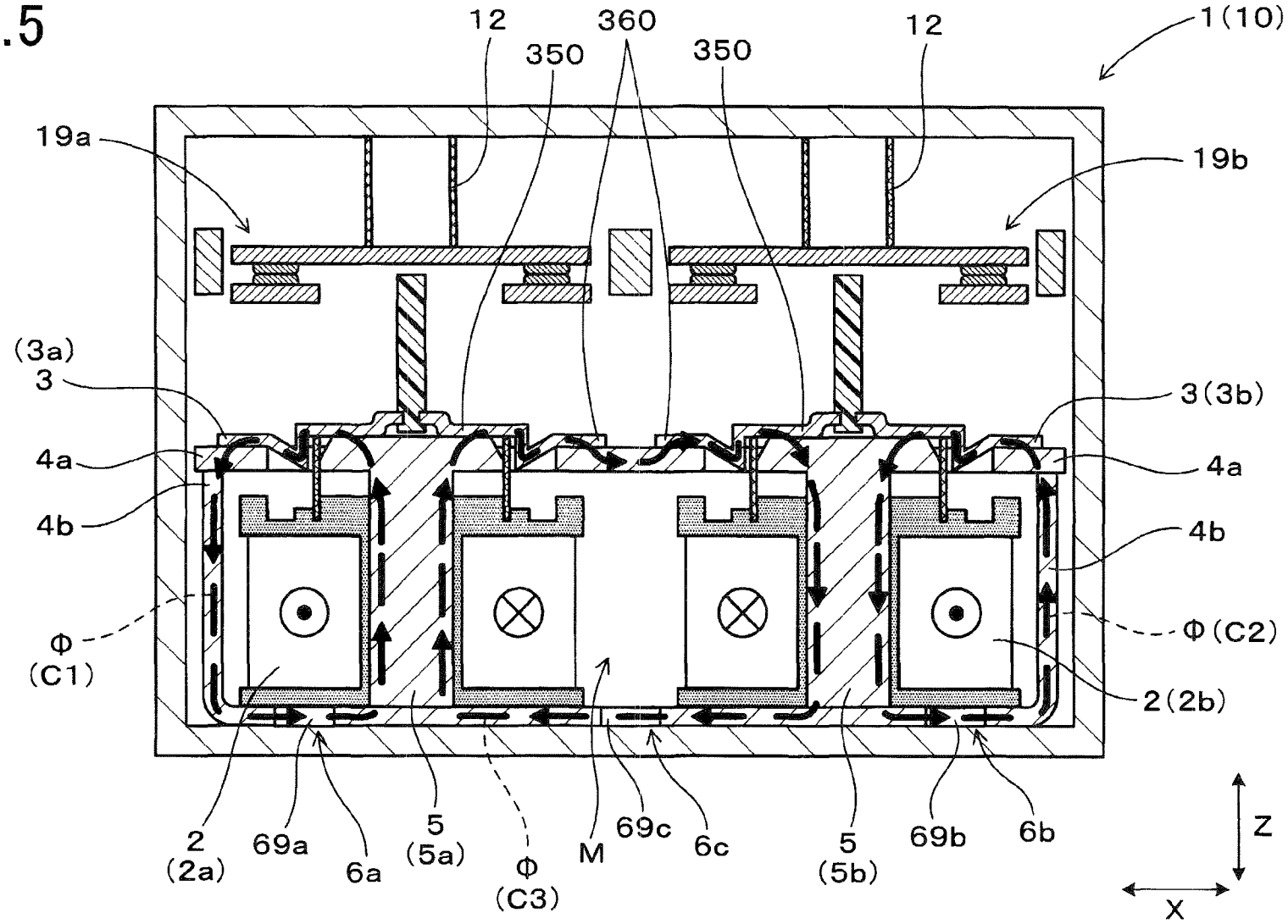
FIG. 5 is a sectional view of a solenoid device in a dual-energized mode in the first embodiment.

In a dual-energized mode, as shown in FIG. 5, where the two magnetic coils 2 are both energized, the magnetic flux Φ of the first magnetic coil 2*a* flows in the first magnetic circuit C1, and the magnetic flux Φ of the second magnetic coil 2*b* flows in the second magnetic circuit C2. This produces magnetic forces to attract the first plunger 3*a* and the second plunger 3*b* to the first stationary core 5*a* and the second stationary core 5*b*, respectively. A portion of the magnetic flux Φ of the first magnetic coil 2*a* flows through a third magnetic circuit C3. The third magnetic circuit C3 is a magnetic circuit including both the stationary cores 5*a* and 5*b*. The third magnetic circuit C3 is made up of the first stationary core 5*a*, the first plunger 3*a*, the first yoke 4*a*, the second plunger 3*b*, the second stationary core 5*b*, and the second yoke 4*b*.

Figure 6:
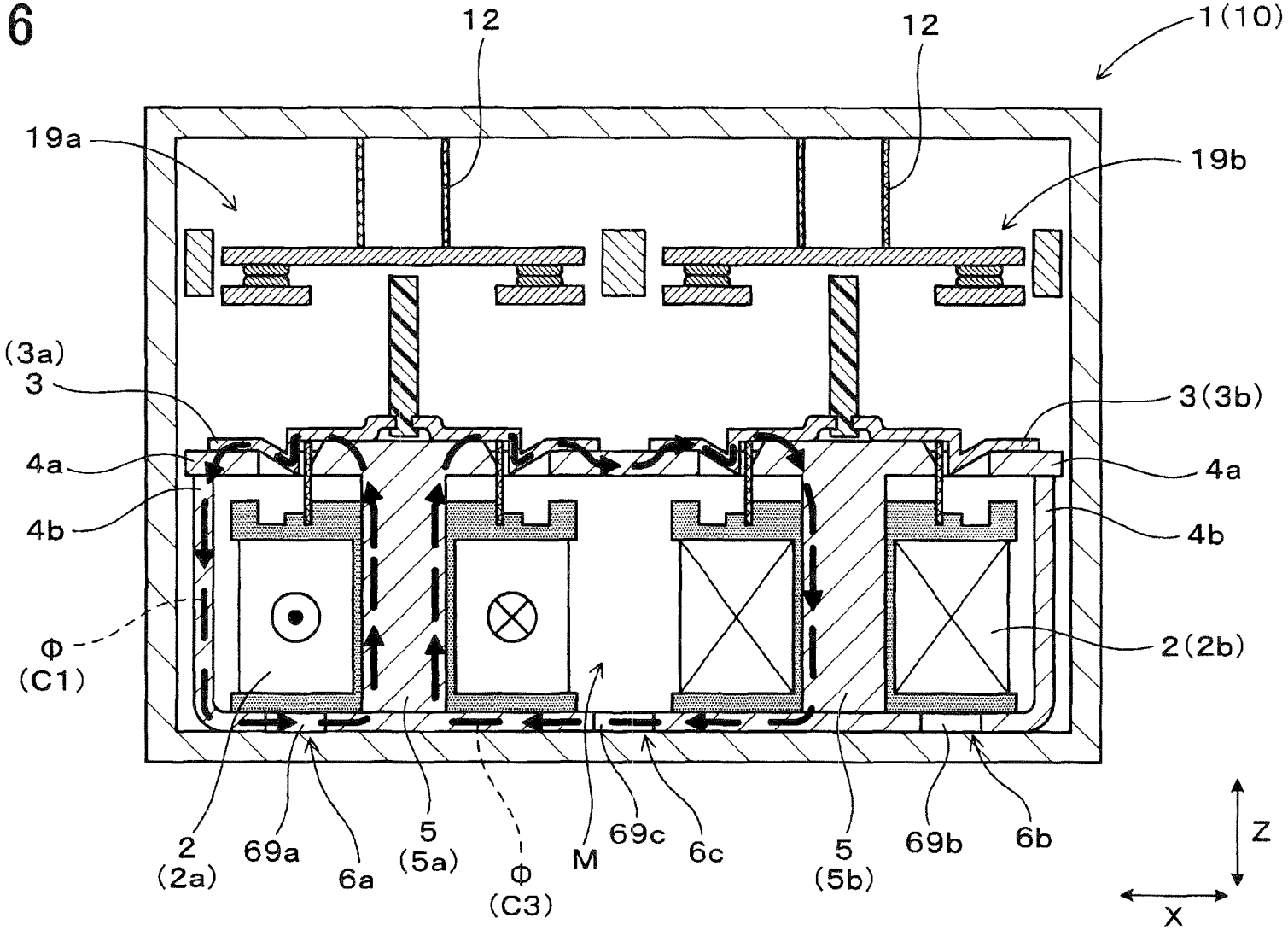
FIG. 6 is a sectional view of a solenoid device when a second magnetic coil is deenergized following a dual-energized mode in the first embodiment.

When the first magnetic coil 2*a* is kept energized, but the second magnetic coil 2*b* is deenergized, as illustrated in FIG. 6, following the dual-energized mode (see FIG. 5), it will cause the magnetic flux Φ of the second magnetic coil 2*b* to disappear. The magnetic flux Φ of the first magnetic coil 2*a* continues to flow in the first magnetic circuit C1 and the third magnetic circuit C3. This produces magnetic forces which keep the first plunger 3*a* and the second plunger 3*b* attracted to the first stationary core 5*a* and the second stationary core 5*b*, respectively.

The solenoid device 1 is used in an electromagnetic relay 10. The electromagnetic relay 10 is equipped with two switches 19 (19*a* and 19*b*). Each of the switches 19 is, as clearly illustrated in FIG. 1, made up of a fixed contact 13, a moving contact 14, a metallic fixed contact-support 15 which retains the fixed contact 13, and a metallic moving contact-support 16 which retains the moving contact 14. The moving contact-support 16 has a contact-side spring 12 secured thereto. The contact-side spring 12 presses the moving contact-support 16 toward the fixed contact-support 15.

The magnetic coils 2 have coil-side springs 11 secured thereto. The coil-side springs 11 presses the plungers 3 (the first plunger 3*a* and the second plunger 3*b*) toward the switches 19.

When the first plunger 3*a* is, as illustrated in FIG. 3, attracted to the first stationary core 5*a*, it will cause the moving contact-support 16 to be moved by pressure, as produced by the contact-side spring 12, to the fixed contact-support 15. This turns on the switch 19*a*.

When the first magnetic coil 2*a* is, as illustrated in FIG. 1, deenergized, it will cause the magnetic flux Φ to disappear, so that the first plunger 3*a* is moved by pressure, as produced by the coil-side spring 11*a*, to the moving contact-support 16. An insulator 300 mounted on the first plunger 3 then contacts the moving contact-support 16 to lift the moving contact-side support 16 away from the fixed contact-support 15 against the pressure, as produced by the contact-side spring 12. This turns off the first switch 19*a*. Similarly, the second switch 19*b* is turned on or off by energizing or deenergizing the second magnetic coil 2*b*.

Figure 9:
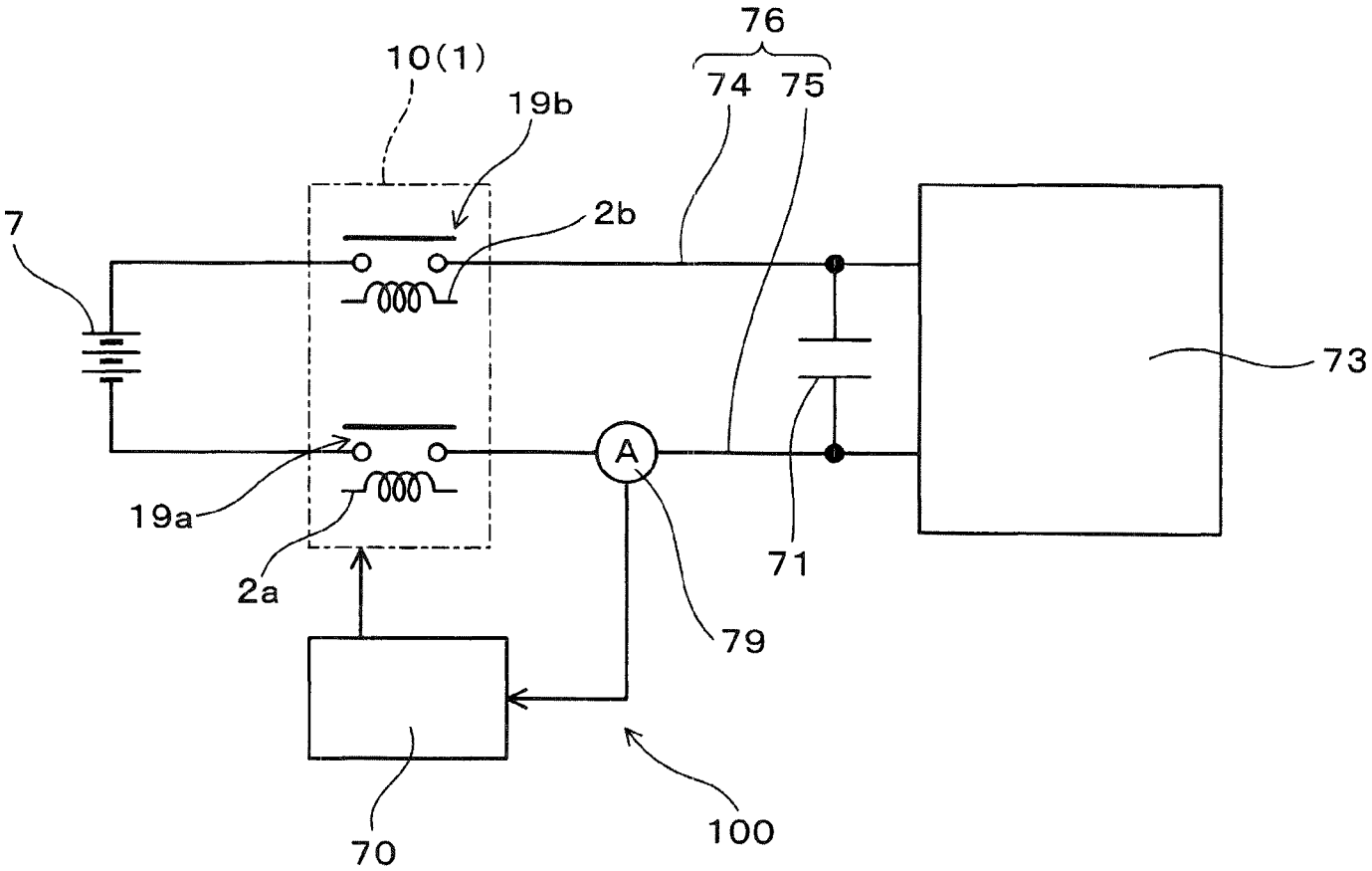
FIG. 9 is a circuit diagram of an electric circuit using a solenoid device in the first embodiment.

The electromagnetic relay 10 is used in a circuit, as illustrated in FIG. 9. The electromagnetic relay 10 is, as shown in the drawing, disposed in the power line 76 which connects a dc power supply 7 and an electronic device 73. The power line 76 is equipped with a positive wire 74 which connects a positive electrode of the dc power supply 7 and the electronic device 73 and a negative wire 75 which connects a negative electrode of the dc power supply 7 and the electronic device 73. A smoothing capacitor 71 is connected between the positive wire 74 and the negative wire 75.

The negative wire 75 has the first switch 19*a* installed therein. The positive wire 74 has the second switch 19*b* installed therein. The power line 76 also includes a current sensor 79. The current sensor 79 is connected to the control circuit 70. The current sensor 79 connects with the control circuit 70. The control circuit 70 works to control on-off operations of the switches 19*a* and 19*b*.

The solenoid device 1 and the control circuit 70 constitute the solenoid control system 100.

The control circuit 70 works to check whether the switches 19*a* and 19*b* are stuck or not before activating the electronic device 73. Specifically, the control circuit 70 first energizes only the first magnetic coil 2*a*, so that only the first switch 19*a* is turned on (see FIG. 3). In the absence of detection of the current by the current sensor 79, the control circuit 70 decides that the second switch 19*b* is not stuck. Subsequently, the control circuit 70 turns off the first switch 19*a* and energizes only the second magnetic coil 2*b* to turn on only the second switch 19*b* (see 2.5 FIG. 4). In the absence of detection of the current by the current sensor 79, the control circuit 70 decides that the first switch 19*a* is not stuck. After finding that the switches 19*a* and 19*b* are both not stuck, the control circuit 70 energizes the magnetic coils 2*a* and 2*b* to turn on the switches 19*a* and 19*b* (see FIG. 5). Afterwards, the control circuit 70 deenergizes the second magnetic coil 2*b* while keeping the first magnetic coil 2*a* energized (see FIG. 6). The control circuit 70 continues to turn on the switches 19*a* and 19*b* to supply the electric power to the electronic device 63.

In the dual-deenergized mode, as illustrated in FIG. 1, where both the magnetic coils 2*a* and 2*b* are in the deenergized state, the first gap G1 is created between the first plunger 3*a* and the first stationary core 5*a*. The second gap G2 is also created between the second plunger 3*b* and the second stationary core 5*b*. Accordingly, in the dual-deenergized mode, only the first gap G1 is created in the first magnetic circuit C1 (see FIG. 2). Additionally, the first gap G1 and the second gap G2 are formed in the third magnetic circuit C3 (see FIG. 5). This causes a magnetic resistance in the first magnetic circuit C1 to be lower than that in the third magnetic circuit C3 in the dual-deeneergized mode.

In dual-deeneergized mode, the second magnetic circuit C2 has only the second gap G1 formed therein (see FIG. 4). This causes the magnetic resistance in the second magnetic circuit C2 to be lower than that in the third magnetic circuit C3 in the dual-deeneergized mode.

When the dual-deeneergized mode (see FIG. 1) is switched to a mode where only the first magnetic coil 2*a* is energized, most of the magnetic flux Φ of the first magnetic coil 2*a* flows in the first magnetic circuit C1 because the first magnetic circuit C1 is lower in magnetic resistance than the third magnetic circuit C3. This causes, as illustrated in FIG. 3, the first plunger 3*a* to be attracted to the first stationary core 5*a*, but the second plunger 3*b* is not attracted to the second stationary core 5*b*.

Similarly, when the dual-deeneergized mode (see FIG. 1) is switched to a mode where only the second magnetic coil 2*b* is energized, most of the magnetic flux Φ of the second magnetic coil 2*b* flows in the second magnetic circuit C2 because the second magnetic circuit C2 is lower in magnetic resistance than the third magnetic circuit C3. This causes the second plunger 3*b* to be attracted to the second stationary core 5*b*, but the first plunger 3*a* is not attracted to the first stationary core 5*a*.

In the dual-energized mode, as shown in FIG. 5, where both the magnetic coils 2*a* and 2*b* are energized, the magnetic flux Φ of the first magnetic coil 2*a* flows in the first magnetic circuit C1, while the magnetic flux Φ of the second magnetic coil 2*b* flow in the second magnetic circuit C2. This produce the magnetic force to attract the plungers 3*a* and 3*b*. When both the plungers 3*a* and 3*b* are attracted, the first gap G1 and the second gap G2 disappear, so that the magnetic resistance in the third magnetic circuit C3 drops. This causes a portion of the magnetic flux Φ of the first magnetic coil 2*a* to flow in the third magnetic circuit C3.

In the interval M between the magnetic coils 2*a* and 2*b*, the first yoke 4*a* and the second yoke 4*b* do not connect with each other, so that the magnetic flux Φ is not short-circuited from the first yoke 4*a* to the second yoke 4*b*. This enables the magnetic flux Φ of the first magnetic coil 2*a* to flow to the third magnetic circuit C3.

The directions of currents to be delivered to the first magnetic coil 2*a* and the second magnetic coil 2*b* in the dual-energized mode (see FIG. 5) are so set that the magnetic flux Φ of the first magnetic coil 2*a* which flows through the third magnetic circuit C3 and the magnetic flux Φ of the second magnetic coil 2*b* which flows through the second magnetic circuit C2 will be oriented in the same direction in the second stationary core 5*b*.

When the second magnetic coil 2*b* is deenergized, as illustrated in FIG. 6, while the first magnetic coil 2*a* is kept energized following the dual-energized mode (see FIG. 5), the magnetic flux Φ disappears from the second magnetic circuit C2. The magnetic flux Φ of the first magnetic coil 2*a* continues to flow in the first magnetic circuit C1 and the third magnetic circuit C3. This produces the magnetic force which continues to attract the first plunger 3*a* and the third plunger 3*b*.

The plungers 3*a* and 3*b* are made of a disc. When the plunger 3 is moved forward or backward, as illustrated in FIGS. 1 and 5, the center 350 of the plunger 3 is brought into contact with or moved away from the top end 510 of the stationary core 5. The movement of the plunger 3 also causes a periphery 360 of the plunger 3 to be brought into contact with or moved away from the first yoke 4*a*.

Figure 7:
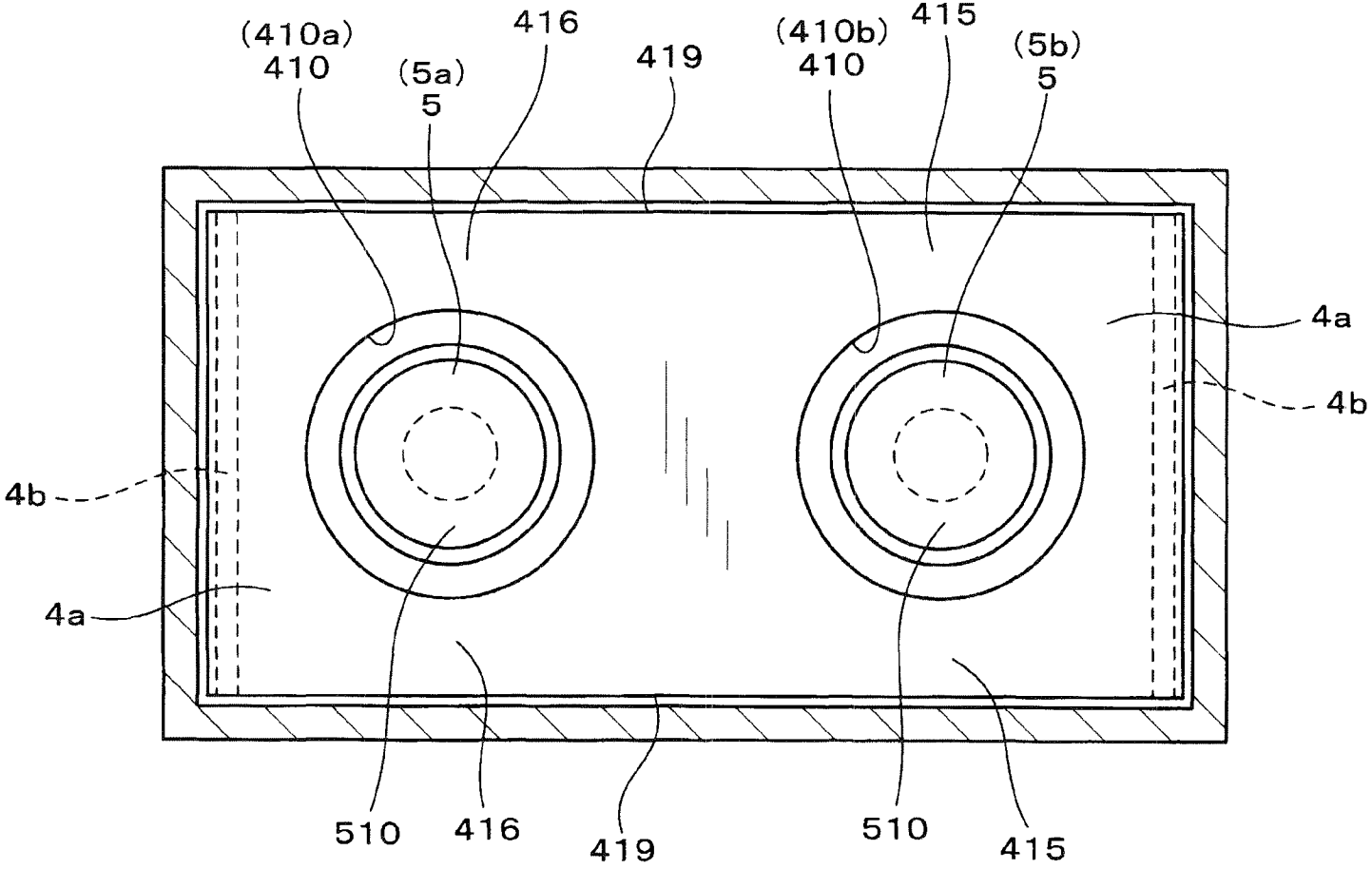
FIG. 7 is a sectional view, as taken along the line VII-VII in FIG. 1.

The stationary cores 5 are of a substantially cylindrical shape. The top ends 510 of the stationary cores 5 have an increased diameter. The first yoke 4*a*, as illustrated in FIG. 7, has circular through holes 410 (410*a* and 410*b*) formed therein. The top ends 510 of the stationary cores 5 are disposed inside the through holes 410. The first yoke 4*a* is formed in the shape of a flat plate.

The second yoke 4*b*, as illustrated in FIG. 1, has two side walls 420 and a bottom wall 430. The side walls 420 connect with ends 470 of the first yoke 4*a* which are opposed in a direction in which the magnetic coil 2*a* and 2*b* are arrayed (i.e., the X-direction). The bottom wall 430 connects with the rear ends 520 of the stationary cores 5.

Figure 8:
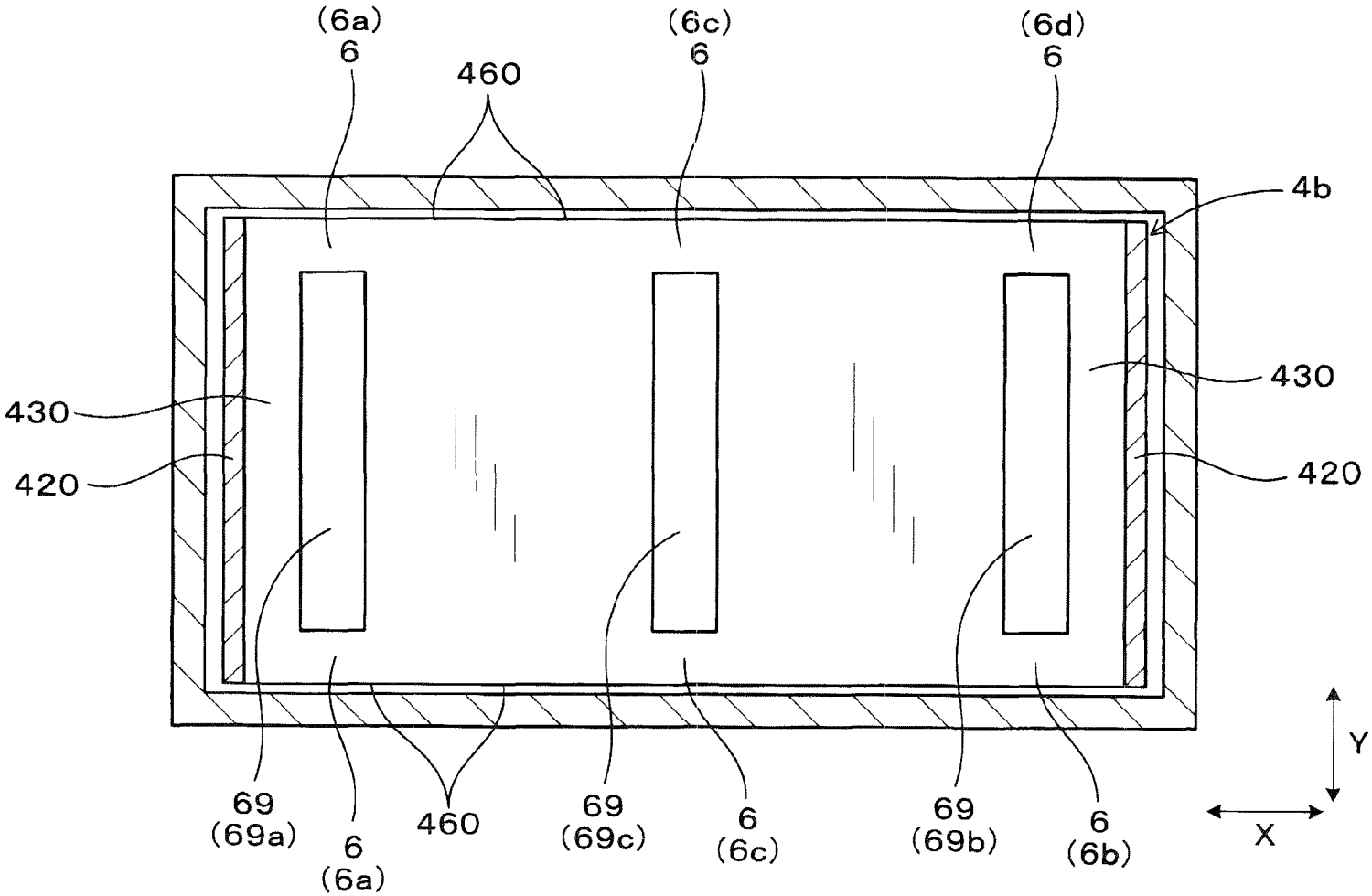
FIG. 8 is a sectional view, as taken along the line VIII-VIII in FIG. 1.

The second yoke 4*b*, as illustrated in FIG. 8, has three slits 69 (69*a* to 69*c*) formed in the bottom wall 430 thereof. Each of the slits 69 is of a rectangular shape elongated in the Y-direction (i.e., perpendicular to the X- and Z-directions). Magnetically-saturated portions 6 (6*a* to 6*c*) in which the magnetic flux Φ is saturated are defined between the slits 69 and the side surface 460 of the bottom wall 430. The magnetically-saturated portions 6 include first magnetically-saturated portions 6*a* where the magnetic flux Φ flowing in the first magnetic circuit C1 is saturated, second magnetically-saturated portions 6*b* where the magnetic flux Φ flowing in the second magnetic circuit C2 is saturated, and third magnetically-saturated portions 6*c* where the magnetic flux Φ flowing in the third magnetic circuit C3 is saturated.

The operation and beneficial effects in this embodiment will be described below. When the second magnetic coil 2*b* is deenergized, as illustrated in FIGS. 5 and 6, while the first magnetic coil 2*a* is kept energized following the dual-energized mode, the magnetic force, as produced by the magnetic flux Φ of the first magnetic coil 2*a* flowing through the first magnetic circuit C1 and the third magnetic circuit C3 works to keep the first plunger 3*a* and the second plunger 3*b* attracted to the first stationary core 5*a* and the second stationary core 5*b*, respectively. The two plungers 3*a* and 3*b* continue to be attracted only by the energization of the first magnetic coil 2*a* without need for energizing the second magnetic coil 2*b*. This results in a decrease in power consumption in the magnetic coils.

When only the first magnetic coil 2*b* is energized, as illustrated in FIG. 3, following the dual-deenergized mode (see FIG. 1), only the first plunger 3*a* is attracted to the first stationary core 5*a*, while the second plunger 3*b* is not attracted. As described above, in the dual-deeneergized mode, the magnetic resistance in the first magnetic circuit C1 is lower than the third magnetic resistance. Thus, when the dual-deeneergized mode is switched to a mode in which only the magnetic coil 2*a* is energized (see FIG. 3), most of the magnetic flux Φ of the first magnetic coil 2*a* flows through the first magnetic circuit C1, while it hardly flows in the third magnetic circuit C3 which is greater in magnetic resistance. This attracts only the first plunger 3*a* to the first stationary core 5*a* without attracting the second plunger 3*b*.

The first magnetic circuit C1, as illustrated in FIG. 1, has formed therein the first magnetically-saturated portion S6*a* where the magnetic flux Φ flowing the first magnetic circuit C1 is saturated.

Consequently, it becomes possible to keep the two plungers 3*a* and 3*b* attracted using the magnetic flux Φ of the first magnetic coil 2*a* when the second magnetic coil 2*b* is deenergized following the dual-energized mode (see FIG. 6). Specifically, the first magnetically-saturated portion S6*a* limits the amount of magnetic flux Φ flowing in the first magnetic circuit C1, so that a sufficient amount of magnetic flux Φ will flow in the third magnetic circuit C3 without a flow of an excessive amount of magnetic flux Φ only in the first magnetic circuit C1. This facilitates even delivery of the magnetic flux Φ of the first magnetic coil 2*a* to the first magnetic circuit C1 and the third magnetic circuit C3, thus making it easy to keep both the plungers 3*a* and 3*b* attracted.

The third magnetic circuit C3 has formed therein the third magnetically-saturated portions 6*c* in which the magnetic flux Φ flowing in the third magnetic circuit C3 is saturated. This facilitates the attraction of only the first plunger 3*a*. Specifically, when the dual-deeneergized mode is switched to a mode in which only the first magnetic coil 2*a* is energized (see FIG. 3), the magnetic flux Φ of the first magnetic coil 2*a* mainly flows in the first magnetic circuit C1, but a portion of the magnetic flux Φ may flow in the third magnetic circuit C3 when the second gap G2 is small, so that the second plunger 3*b* is attracted. The third magnetically-saturated portions 6*c* are, therefore, formed to make the magnetic flux Φ of the first magnetic coil 2*a* less likely to flow in the third magnetic circuit C3, thereby ensuring the stability in attracting only the first plunger 3*a* without attracting the second plunger 3*b*.

The formation of the second magnetically-saturated portions 6*b* facilitates an operation in which only the first magnetic coil 2*a* is energized to keep the plungers 3*a* and 3*b* attracted. Specifically, there is, as illustrated in FIG. 7, a portion 415 around the through hole 410*b* of the first yoke 4*a* through which the magnetic flux Φ flows. The magnetic flux Φ of the first magnetic coil 2*a* may, therefore, move through the portion 415 and flow to the second yoke 4*b*. In the absence of the second magnetically-saturated portions 6*b*, when only the first magnetic coil 2*a* is energized to continue to attract the plungers 3*a* and 3*b* (see FIG. 6), the magnetic flux Φ of the first magnetic coil 2*a* may pass through the portion 415 and flow to the second yoke 4*b*, thus resulting in a decrease in amount of magnetic flux Φ flowing in the third magnetic circuit C3. For this reason, the second magnetically-saturated portions 6*b* is formed to make the magnetic flux Φ less likely to flow through the portion 415. This avoids the decrease in amount of magnetic flux Φ flowing in the third magnetic circuit C3 and enables the second plunger 3*b* to be attracted by a strong magnetic force.

It is advisable that the first magnetically-saturated portions 6*a* be formed, as illustrated in FIG. 5, in an area where the first magnetic circuit C1 and the third magnetic circuit C3 are not laid to overlap each other. For instance, if the first magnetically-saturated portions 6*a* are formed in the first stationary core 5*a* in which the first magnetic circuit C1 and the third magnetic circuit C3 overlap each other, it may result in a difficulty in delivering a sufficient amount of magnetic flux Φ to both the magnetic circuits C1 and C3. Similarly, it is advisable that the second magnetically-saturated portions 6*b* be formed in an area where the second magnetic circuit C2 and the third magnetic circuit C3 are not laid to overlap each other. For instance, if the second magnetically-saturated portions 6*b* are formed in the second stationary core 5*b* in which the second magnetic circuit C2 and the third magnetic circuit C3 overlap each other, it may result in a difficulty in delivering a sufficient amount of magnetic flux Φ to both the magnetic circuits C2 and C3.

It is also advisable that the third magnetically-saturated portions 6*c* be formed in an area where the first magnetic circuit C1 and the third magnetic circuit C3 are not laid to overlap each other.

The term "magnetically-saturated" means that a magnetically saturated region of the B-H curve is entered. The magnetically saturated region is defined as a region where the density of magnetic flux is 50% or more of the density of saturated magnetic flux. The density of saturated magnetic flux is the density of magnetic flux of a magnetic material when subjected to external application of a magnetic field until its intensity of magnetization does not increase further.

In the solenoid control system 100, the control circuit 70 serves to control directions in which the current is to be delivered to the first magnetic coil 2*a* and the second magnetic coil 2*b* so that the magnetic flux Φ of the first magnetic coil 2*a* which flows through the third magnetic circuit C3 and the magnetic flux Φ of the second magnetic coil 2*b* which flows through the second magnetic circuit C2 will be oriented in the same direction in the second stationary core 5*b* in the dual-energized mode (see FIG. 5).

Accordingly, the magnetic fluxes Φ of the magnetic coils 2*a* and 2*b* are reinforced by each other in the second stationary core 5*b* in the dual-energized mode. This increases the magnetic force acting on the second plunger 3*b*. In the dual-energized mode, the magnetic flux Φ of the second magnetic coil 2*b* also flows in the third magnetic circuit C3. The above structure, thus, works to orient the magnetic flux Φ of the second magnetic coil 2*b* flowing in the third magnetic circuit C3 and the magnetic flux Φ of the first magnetic coil 2*a* flowing in the first magnetic circuit C1 in the same direction, thus producing a strong magnetic force attracting the first plunger 3*a*.

As apparent from the above discussion, this embodiment provides a solenoid device a solenoid control system which are capable of attracting a plurality of plungers independently from each other and also attracting the plungers simultaneously with a decrease in electric power consumed by electromagnetic coils.

When the dual-deeneergized mode is switched to the mode in which only the first magnetic coil 2*a* is energized, only the first plunger 3*a* is, as described above, attracted. When the dual-deeneergized mode is switched to the mode in which only the second magnetic coil 2*b* is energized, only the second plunger 3*b* is attracted (see FIGS. 3 and 4), but however, these operations may be modified. For instance, this embodiment may be designed so that when the dual-deeneergized mode is switched to the mode in which only the first magnetic coil 2*a* is energized, only the first plunger 3*a* is attracted, and when the dual-deeneergized mode is switched to the mode in which only the second magnetic coil 2*b* is energized, both the first plunger 3*a* and the second plunger 3*b* are attracted.

The slit S69 are, as shown in FIG. 8, formed to define the magnetically-saturated portions 6, but however, the magnetically-saturated portions 6 may be created by partially making the bottom wall 430 thin or using material in which the magnetic flux does not flow easily.

The first yoke 4*a* has formed around the through hole 410*b* the portion 415 in which the magnetic flux Φ flows. When the first magnetic coil 2*a* is energized, a portion of the magnetic flux Φ of the first magnetic coil 2*a* flows from the first stationary core 5*a* to the portion 415, transfers to the second yoke 4*b*, and then returns back to the first stationary core 5*a*. This path is the fourth magnetic circuit.

Second Embodiment

In the following embodiment, the same reference numbers in the drawings as employed in the first embodiment will refer to the same parts unless otherwise specified.

Figure 10:
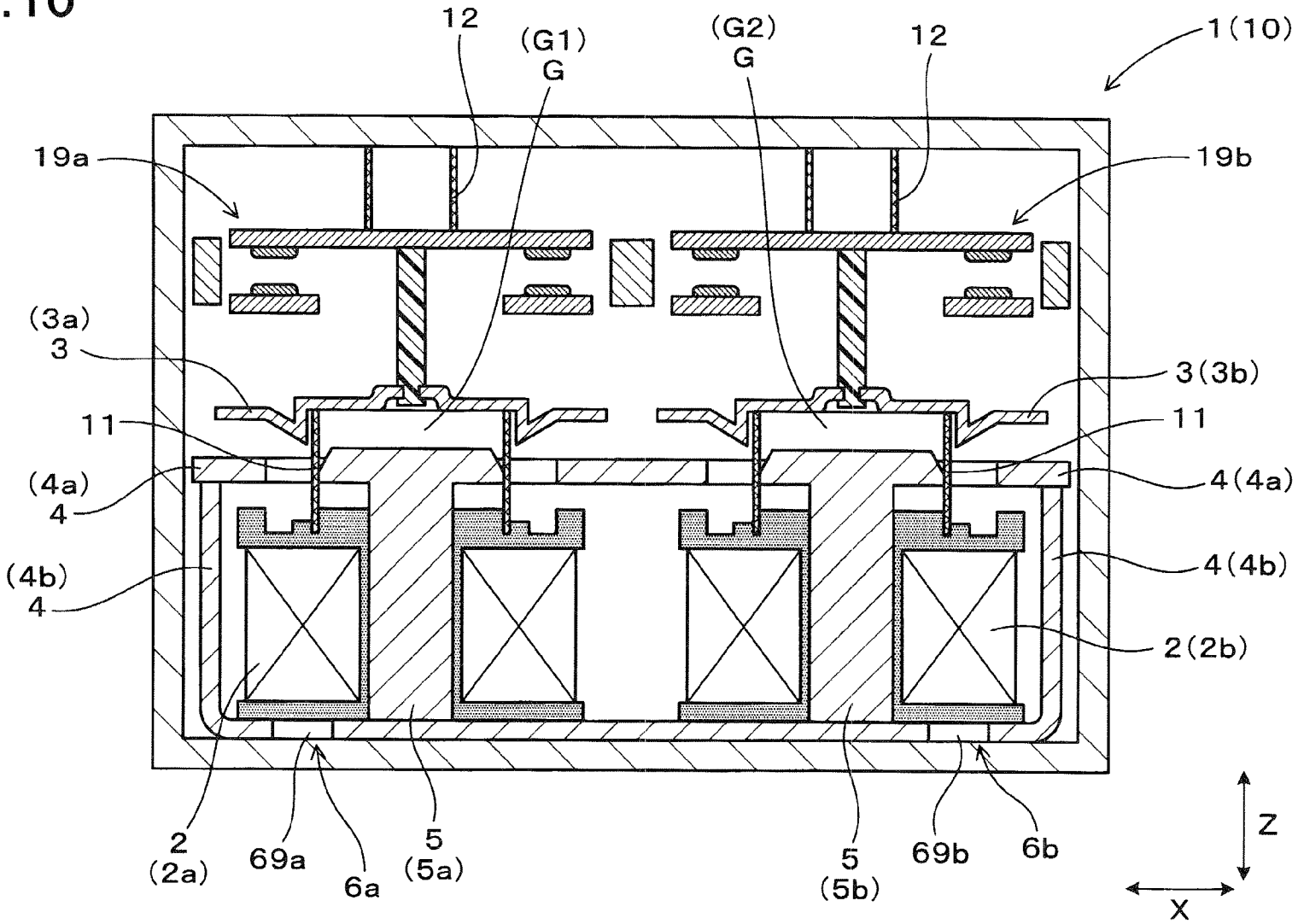
FIG. 10 is a sectional view of a solenoid device in the second embodiment.

This embodiment is different in the number of the magnetically-saturated portion S6 from the first embodiment. As illustrated in FIG. 10, this embodiment has only the first magnetically-saturated portions 6*a* and the second magnetically-saturated portions 6*b* and does not have the third magnetically-saturated portions 6*c*.

In this way, the number of the magnetically-saturated portions 6 is small, thus facilitating the ease with which the yoke 4 is machined. In this embodiment, when the dual-energized mode is switched to the mode in which only the first magnetic coil 2*a* is energized to attract only the first plunger 3*a* (see FIG. 3), there is a possibility that an excessive amount of magnetic flux Φ flows in the third magnetic circuit C3, so that the second plunger 3*b* is also attracted. In this case, the spring constants of the springs 11 and 12 may be optimized to attract only the first plunger 3*a* by energizing only the first magnetic coil 2*a*.

Other arrangements, operations, and beneficial effects are the same as in the first embodiment.

Third Embodiment

Figure 11:
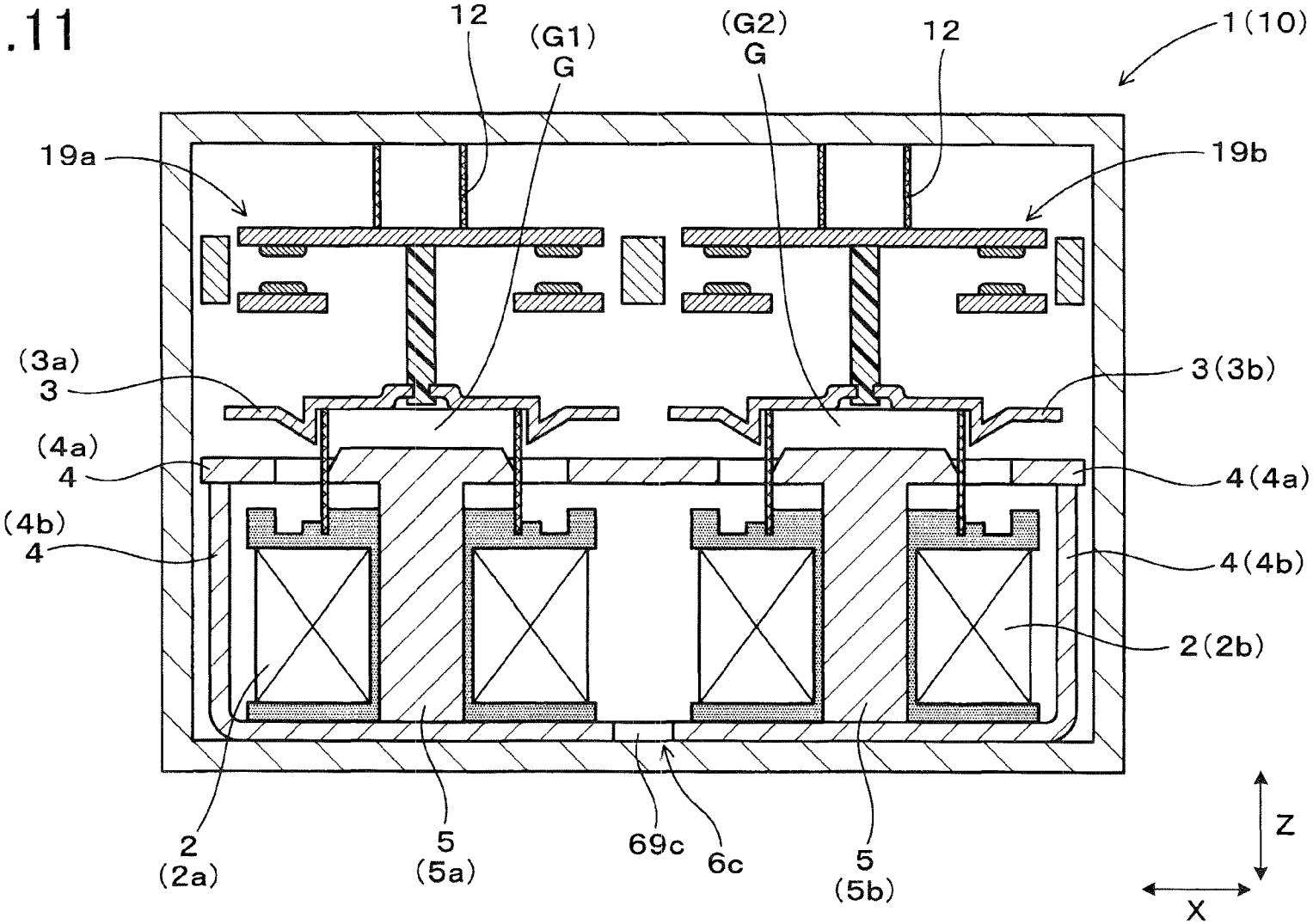
FIG. 11 is a sectional view of a solenoid device in the third embodiment.

This embodiment is different in the number of the magnetically-saturated portions 6 from the first embodiment. This embodiment, as illustrated in FIG. 11, has only the third magnetically-saturated portions 6*c*, but does not have the first magnetically-saturated portions 6*a* and the second magnetically-saturated portions 6*b*.

The number of the magnetically-saturated portions 6 is small, thus facilitating the ease with which the yoke 4 is machined. In this embodiment, when the dual-energized mode is switched to the mode in which the second magnetic coil 2*b* is deenergized, while keeping the first magnetic coil 2*a* energized (see FIG. 6) to continue to attract the plungers 3*a* and 3*b*, there is a possibility that an excessive amount of magnetic flux Φ of the first magnetic coil 2*a* flows in the first magnetic circuit C1, thus resulting in a failure in attracting the second plunger 3*b* properly. In this case, the spring constants of the springs 11 and 12 may be optimized to keep the first and second plungers 3*a* and 3*b* attracted by energizing only the first magnetic coil 2*a*.

Other arrangements, operations, and beneficial effects are the same as in the first embodiment.

Fourth Embodiment

Figure 12:
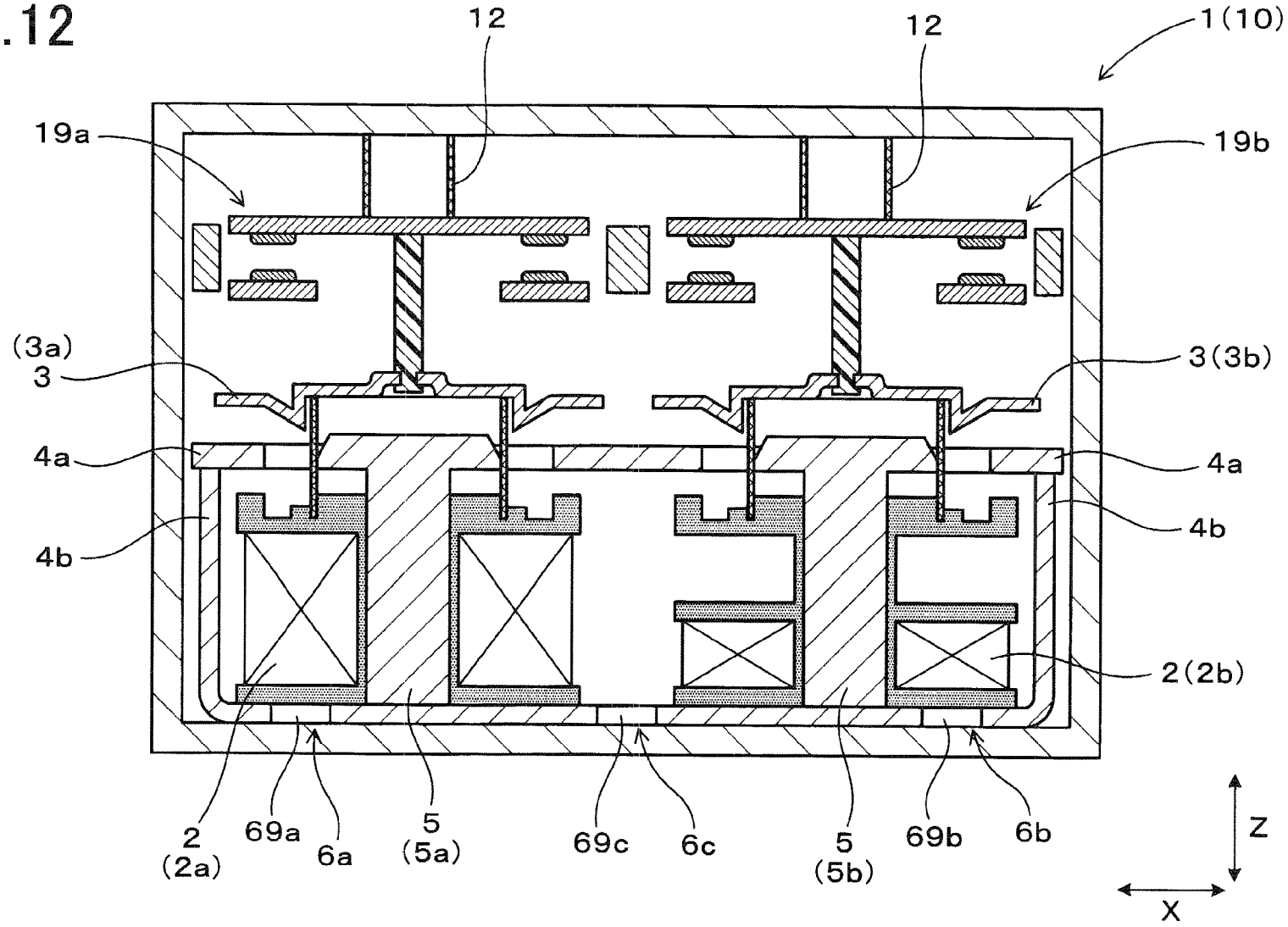
FIG. 12 is a sectional view of a solenoid device in the fourth embodiment.

This is different in configuration of the second magnetic coil 2*b* from the first embodiment. The number of turns of the second magnetic coil 2*b* is, as illustrated in FIG. 12, smaller than that of the first magnetic coil 2*a*. Specifically, the number of turns of the second magnetic coil 2*b* is less than or equal to half that of the first magnetic coil 2*a*. In the dual-energized mode in which both the coils 2*a* and 2*b* are energized, more current is delivered to the second magnetic coil 2*b* than to the first magnetic coil 2*a* to substantially equalize the magnetic forces, as produced by the magnetic coils 2*a* and 2*b*.

The operation and effects of this embodiment will be described. The amount of conductive wire used in the second magnetic coil 2*b* can be decreased, thus resulting in a decrease in production cost of the second magnetic coil 2*b*. Specifically, as described above, after the dual-energized mode, the second magnetic coil 2*b* is deenergized to continue to attract the plungers 3*a* and 3*b* only using the magnetic flux Φ of the first magnetic coil 2*a*. The time for which the current is being delivered to the second magnetic coil 2*b* is, therefore, relatively short. More current is also delivered to the second magnetic coil 2*b* than to the first magnetic coil 2*a* to substantially equalize the magnetic forces, as produced by the second magnetic coil 2*b* and the first magnetic coil 2*a*. This results in an increase in current flowing through the second magnetic coil 2*b*, but however, the time for which the current is being supplied to the second magnetic coil 2*b* is, as described above, short, thus permitting the amount of power consumed by the second magnetic coil 2*b* to be decreased. It is, thus, possible to decrease the number of turns of the second magnetic coil 2*b* without having to increase the power consumption and to decrease the production cost of the second magnetic coil 2*b*.

Other arrangements, operations, and beneficial effects are the same as in the first embodiment.

Fifth Embodiment

Figure 13:
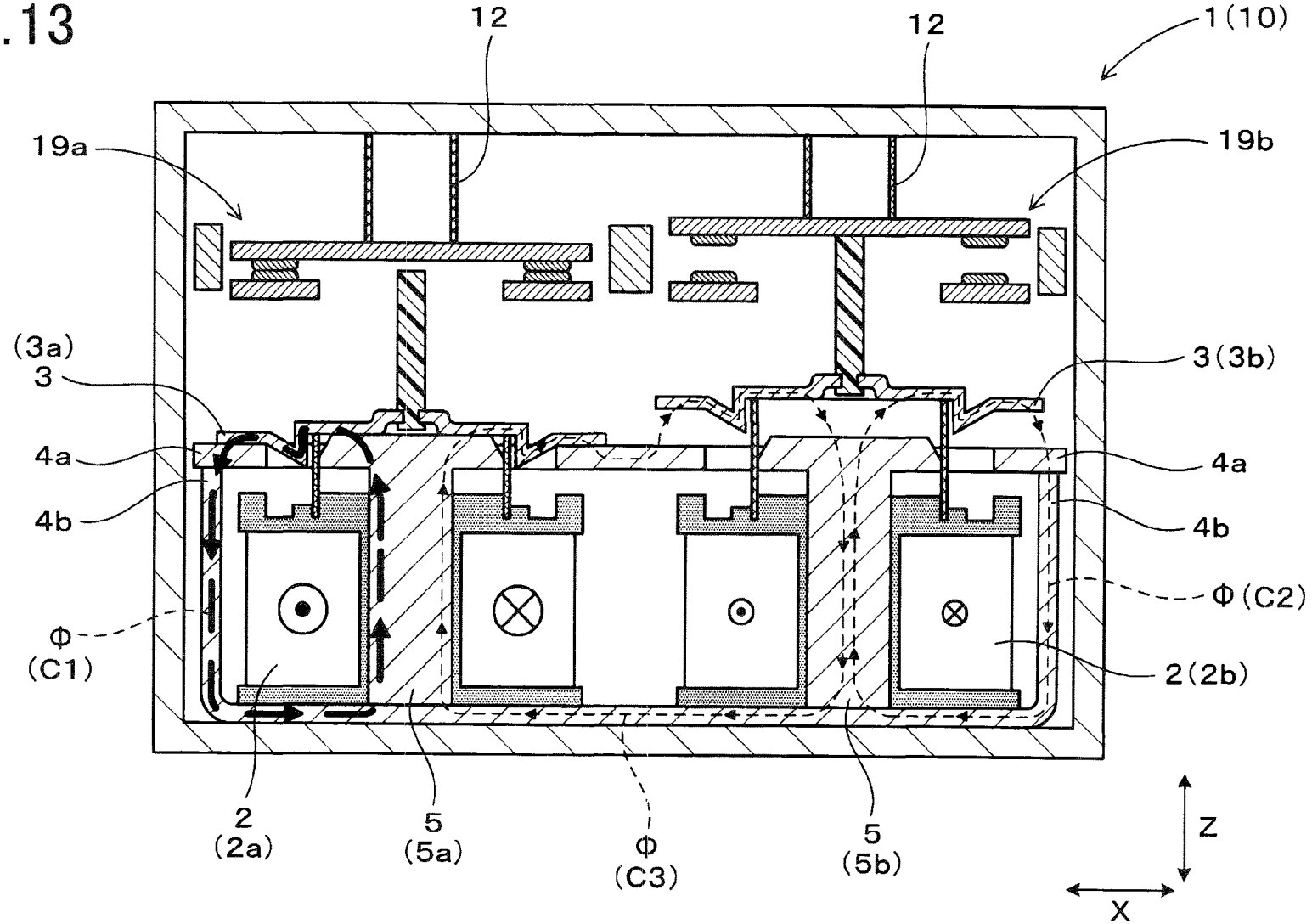
FIG. 13 is a sectional view of a solenoid device in which only a first plunger is attracted in the fifth embodiment.
Figure 14:
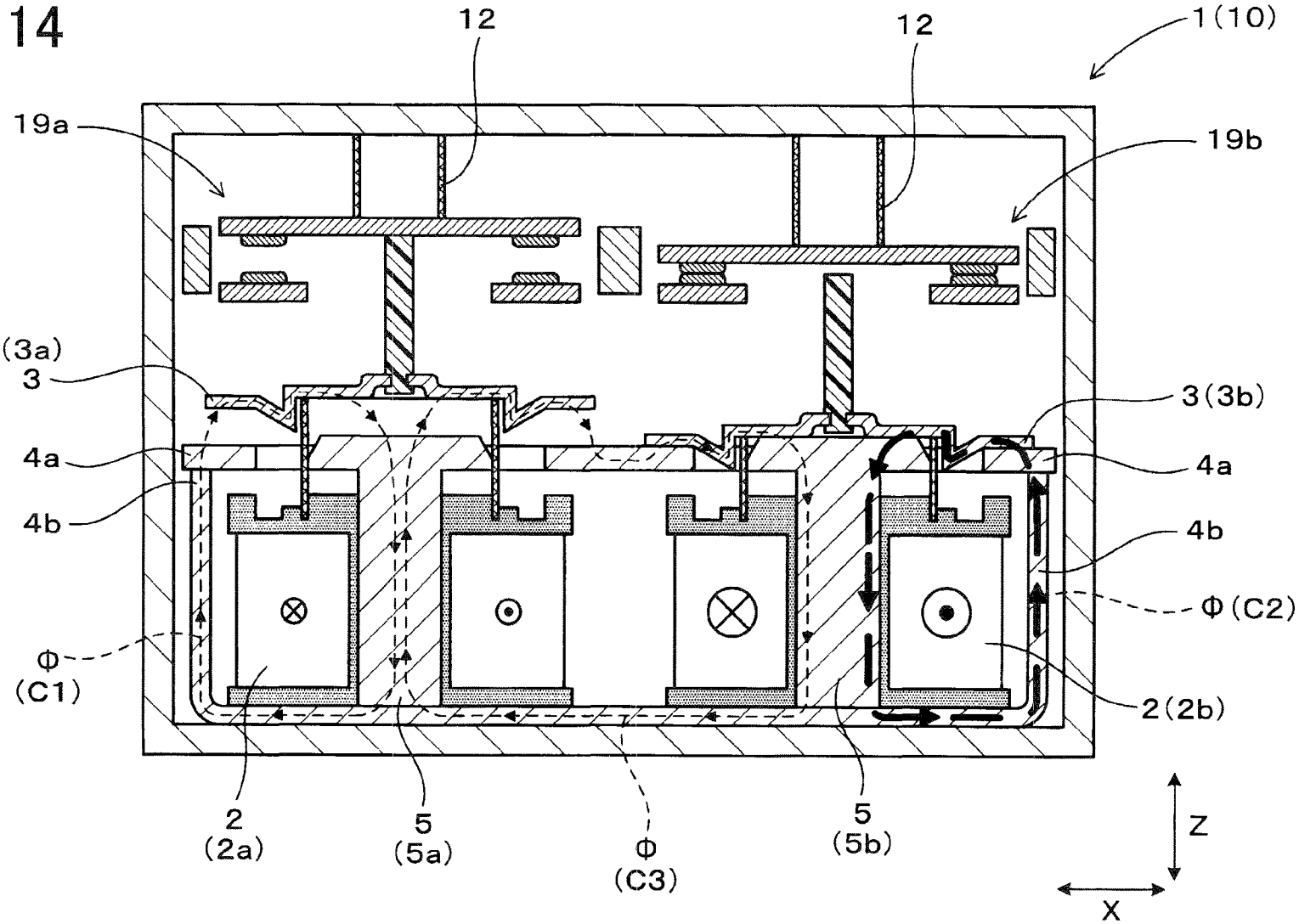
FIG. 14 is a sectional view of a solenoid device in which only a second plunger is attracted in the fifth embodiment.

This embodiment is, as illustrated in FIGS. 13 and 14, different in how to energize the magnetic coils 2*a* and 2*b* from the first embodiment. When the first magnetic coil 2*a* is energized, as illustrated in FIG. 13, to attract only the first plunger 3*a*, the magnetic flux Φ of the first magnetic coil 2*a* mainly flows in the first magnetic circuit C1, but a portion of the magnetic flux Φ may flow in the third magnetic circuit C3. If the magnetic flux Φ flowing in the third magnetic circuit C3 is kept as it is, it may cause the second plunger 3*b* to be attracted. Accordingly, this embodiment is designed to deliver the current to the second magnetic coil 2*b* so that the magnetic flux Φ of the second magnetic coil 2*b* will cancel, of the magnetic flux Φ which is generated by the first magnetic coil 2*a* and flows in the third magnetic circuit C3, a portion passing through the second stationary core 5*b* and the second plunger 3*b*. This enables only the first plunger 3*a* to be attracted without attracting the second plunger 3*b*. Note that the amount of current supplied to the second magnetic coil 2*b* is set small because the delivery of an excessive amount of current to the second magnetic coil 2*b* will cause the second plunger 3*b* attracted.

This embodiment, as illustrated in FIG. 14, works to slightly deliver the current to the first magnetic coil 2*a* when the second magnetic coil 2*b* is energized to attract only the second plunger 3*b*. Specifically, the current is supplied to the first magnetic coil 2*a* so that the magnetic flux Φ of the first magnetic coil 2*a* will cancel, of the magnetic flux Φ which is generated by the second magnetic coil 2*b* and flows in the third magnetic circuit C3, a portion passing through the first stationary core 5*a* and the first plunger 3*a*. This ensures the stability in attracting only the second plunger 3*a*.

Figure 15:
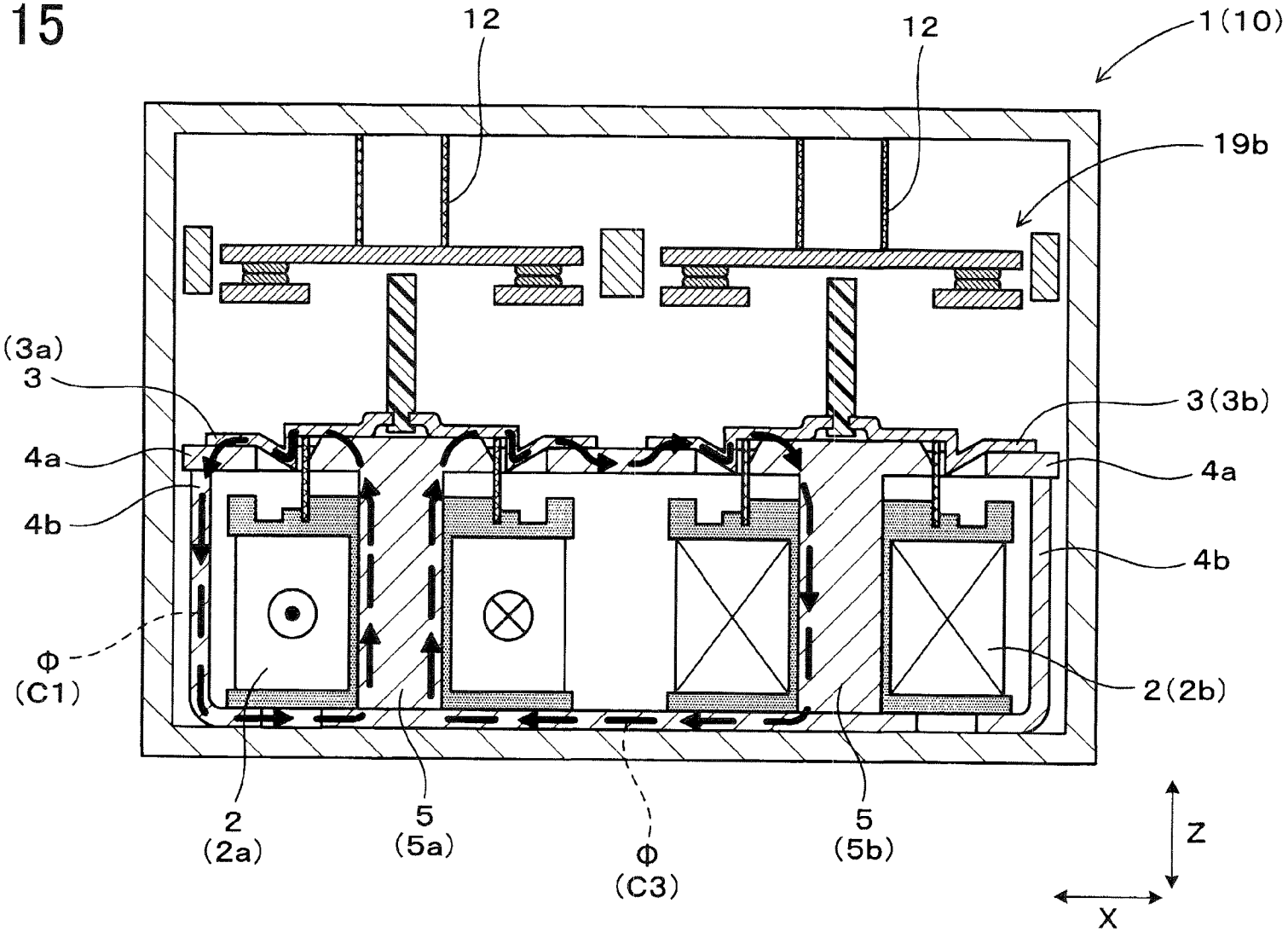
FIG. 15 is a sectional view of a solenoid device when a second magnetic coil is deenergized following a dual-energized mode in the fifth embodiment.

The third magnetically-saturated portions 6*c* is not formed. This is because even if the magnetic flux Φ of the first magnetic coil 2*a* flows in the third magnetic circuit C3 when it is required to attract the first plunger 3*a*, the magnetic flux Φ of the second magnetic coil 2*b* will cancel it, thus eliminating the need for the third magnetically-saturated portions 6*c* which restricts the flow of the magnetic flux Φ of the first magnetic coil 2*a* to the third magnetic circuit C3. This results in a decrease in magnetic resistance of the first magnetic circuit C1 and the third magnetic circuit C3, thus facilitating the ease with which the magnetic flux Φ of the first magnetic coil 2*a* flows in the first magnetic circuit C1 and the third magnetic circuit C3 when the second magnetic coil 2*b* is deenergized following the dual-energized mode (see FIG. 15), thus enabling the first plunger 3*a* and the second plunger 3*b* to be kept attracted by a strong magnetic force.

Other arrangements, operations, and beneficial effects are the same as in the first embodiment.

Sixth Embodiment

Figure 16:
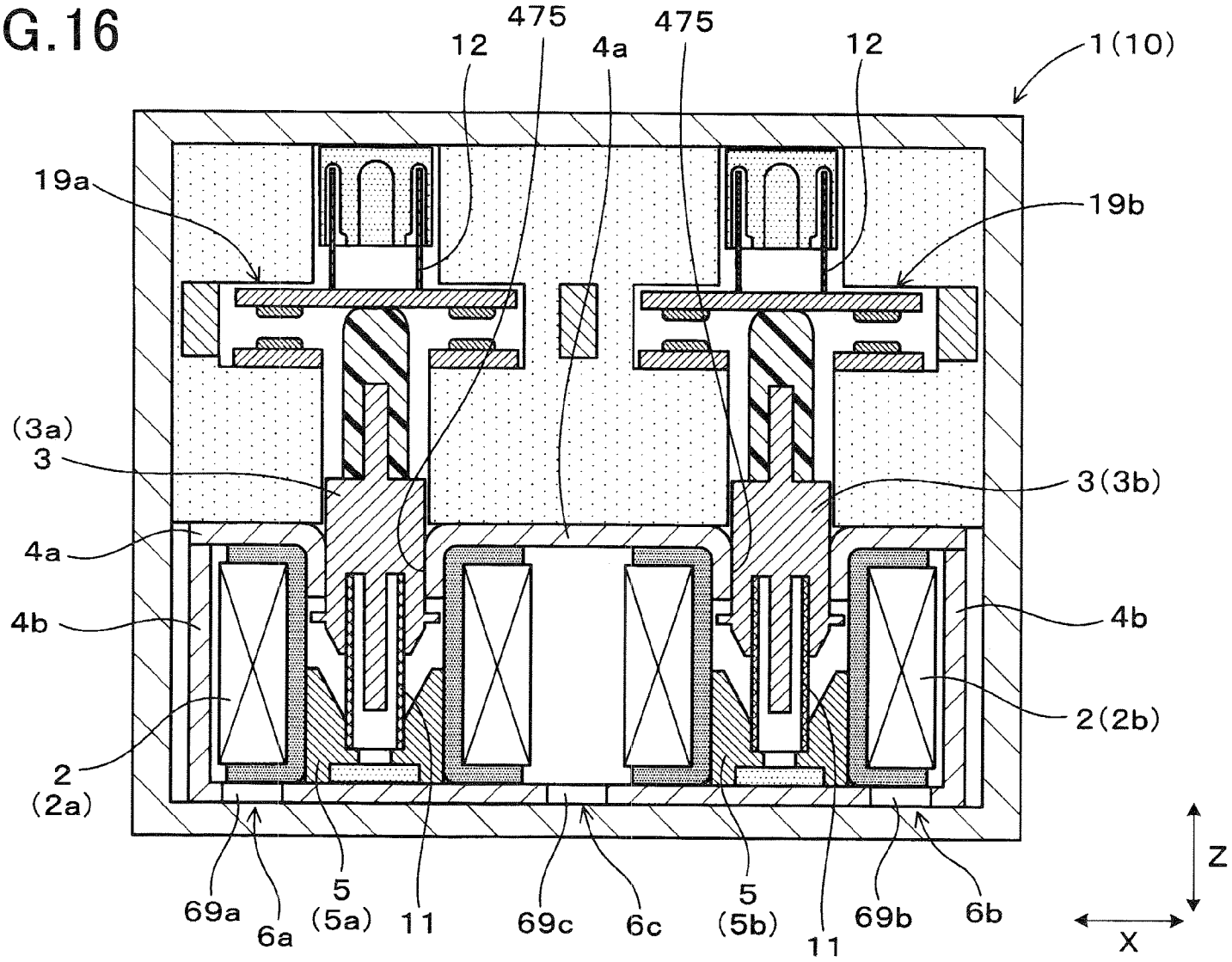
FIG. 16 is a sectional view of a solenoid device in the sixth embodiment.

This embodiment is different in configuration of the plungers 3 from the first embodiment. The plungers 3 are, as illustrated in FIG. 16, of a shape elongated in the Z-direction. The length of the stationary cores 5 in the Z-direction is shorter than that in the first embodiment. The stationary cores 5 are disposed inside the magnetic coils 2. The first yoke 4*a* has two plunger passing holes 475 formed therein. The plungers 3 are inserted into the plunger passing holes 475.

Other arrangements, operations, and beneficial effects are the same as in the first embodiment.

Seventh Embodiment

Figure 17:
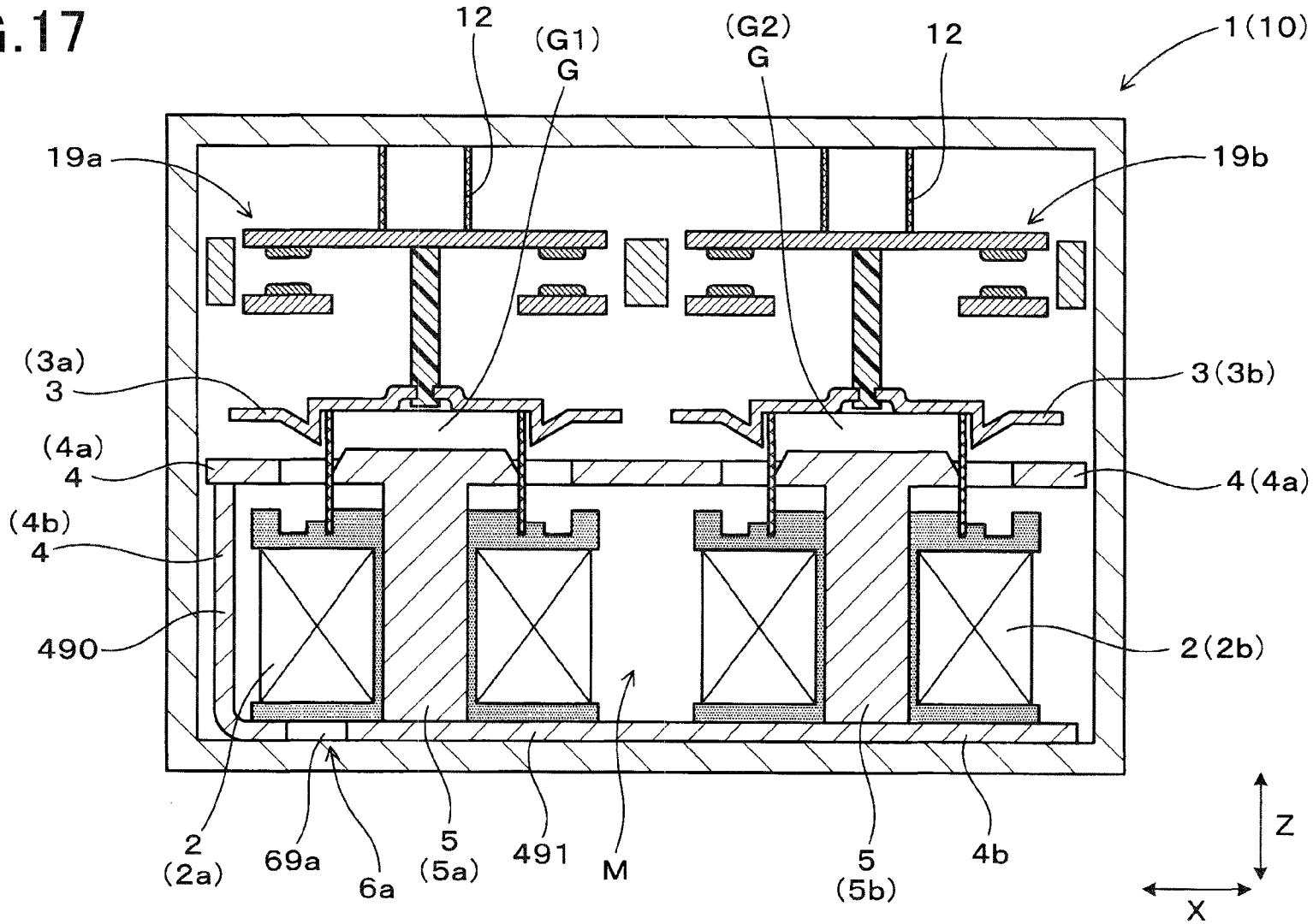
FIG. 17 is a sectional view of a solenoid device in the seventh embodiment.

This embodiment is different in configuration of the yoke 4 from the first embodiment. The first yoke 4*a* and the second yoke 4*b* do not, as illustrated in FIG. 17, connect with each other at a portion located adjacent the second magnetic coil 2*b*. The second yoke 4*b* is equipped with a bottom wall yoke 491 connecting with the stationary cores 5*a* and 5*b*, and a side wall yoke 490 extending upward from the bottom wall yoke 491. The side wall yoke 490 connects with the first yoke 4*a* near the first magnetic coil 2*a*.

Figure 18:
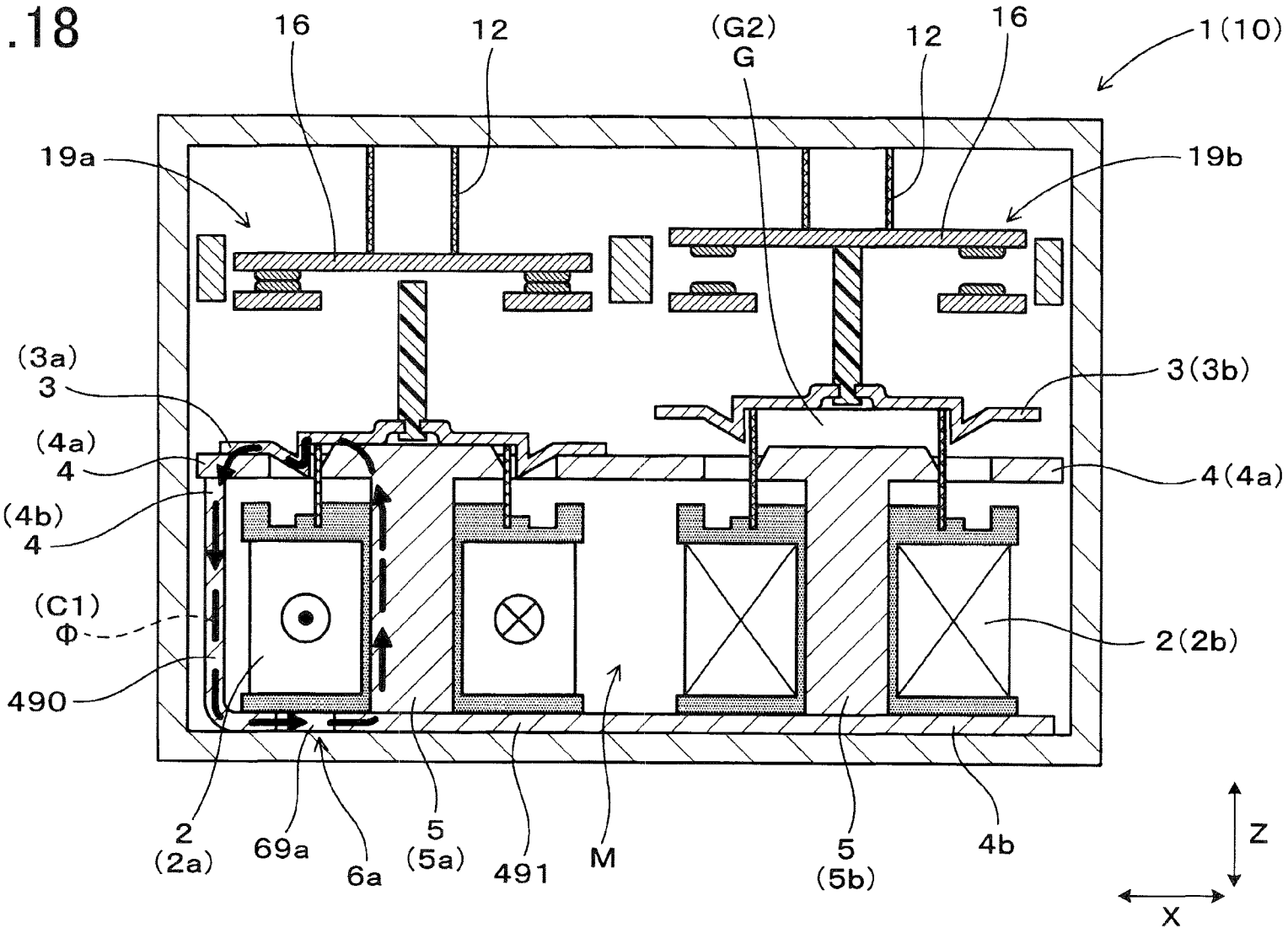
FIG. 18 is a sectional view of a solenoid device in which only a first magnetic coil is energized in the seventh embodiment.

When the dual-deeneergized mode is switched to a mode, as illustrated in FIG. 18, in which only the first magnetic coil 2*a* is energized, the magnetic flux Φ of the first magnetic coil 2*a* will flow in the first magnetic circuit C1 made up of the first stationary core 5*a*, the first plunger 3*a*, the first yoke 4*a*, the side wall yoke 490, and the bottom wall yoke 491, thereby attracting the first plunger 3*a*.

Figure 19:
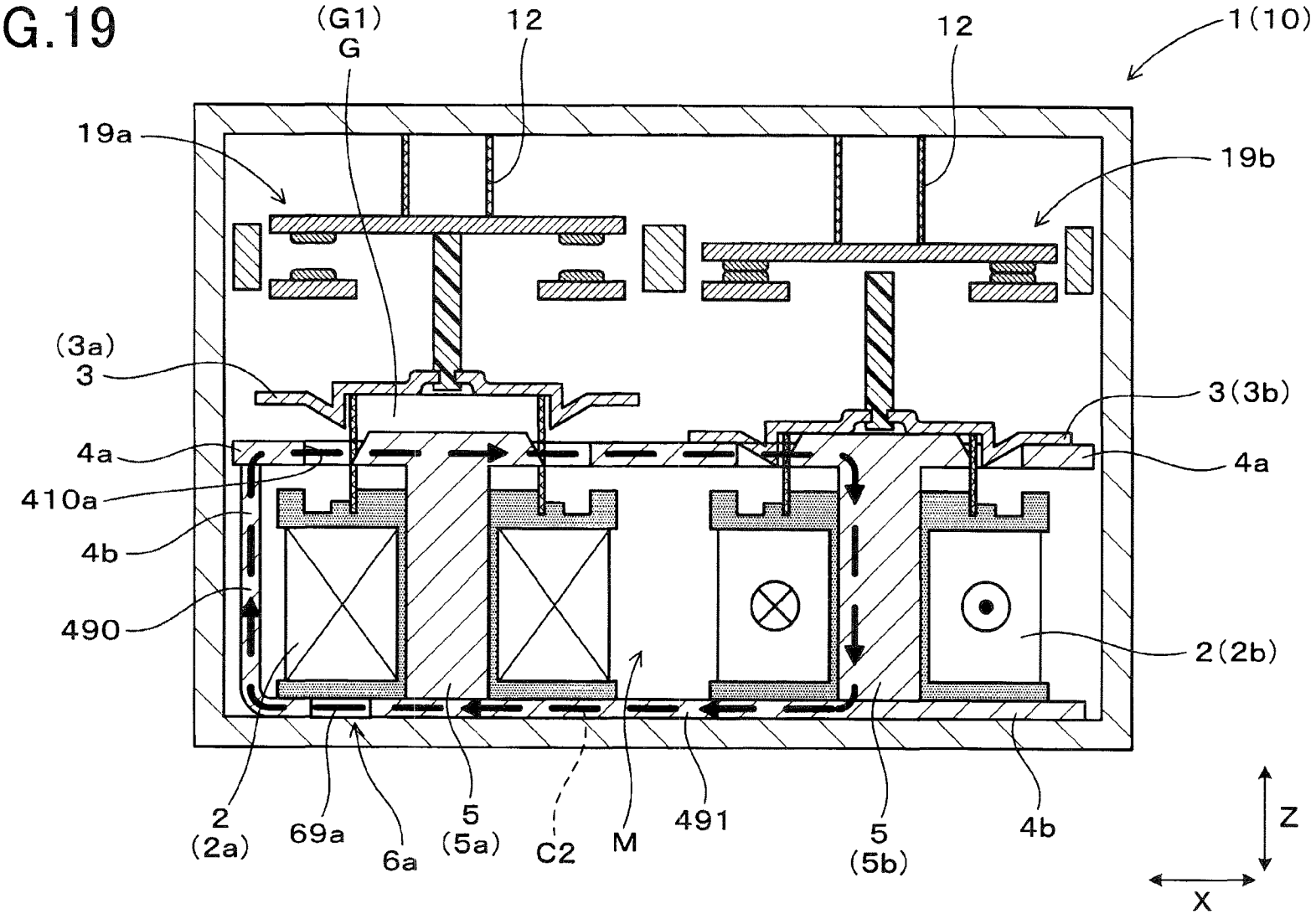
FIG. 19 is a sectional view of a solenoid device in which only a second magnetic coil is energized in the seventh embodiment.

Alternatively, when the dual-deeneergized mode is switched to a mode, as illustrated in FIG. 19, in which only the second magnetic coil 2*b* is energized, the magnetic flux Φ of the second magnetic coil 2*b* will flow from the second stationary core 5*b* to the bottom wall yoke 491, to the side wall yoke 490, and to the first yoke 4*a*. The magnetic flux Φ of the second magnetic coil 2*b* then passes through the portion 416 formed near the though hole 410*a* of the first yoke 4*a* (see FIG. 7) and flows into the second plunger 3*b*. This path is the second magnetic circuit C2. The magnetic force, as created by the flow of the magnetic flux Φ in the second magnetic circuit C2 attracts the second plunger 3*b* to the second stationary core 5*b*.

Figure 20:
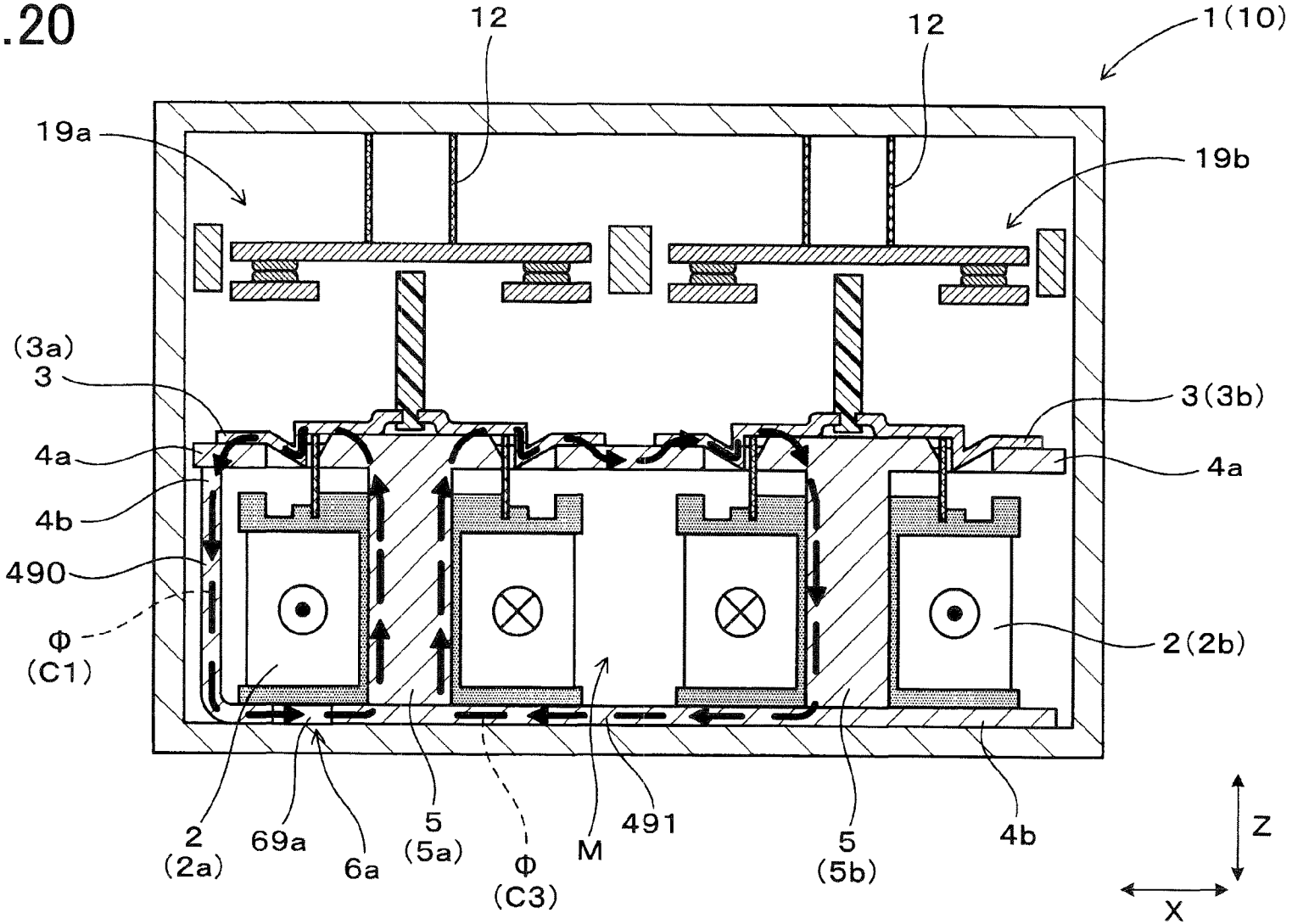
FIG. 20 is a sectional view of a solenoid device in a dual-energized mode in the seventh embodiment.

In the dual-energized mode, as illustrated in FIG. 20, the magnetic flux Φ of the first magnetic coil 2*a* partially flows through the third magnetic circuit C3, and the magnetic flux Φ of the second magnetic coil 2*b* also flows through the third magnetic circuit C3. This creates the magnetic force attracting the plungers 3*a* and 3*b*.

Figure 21:
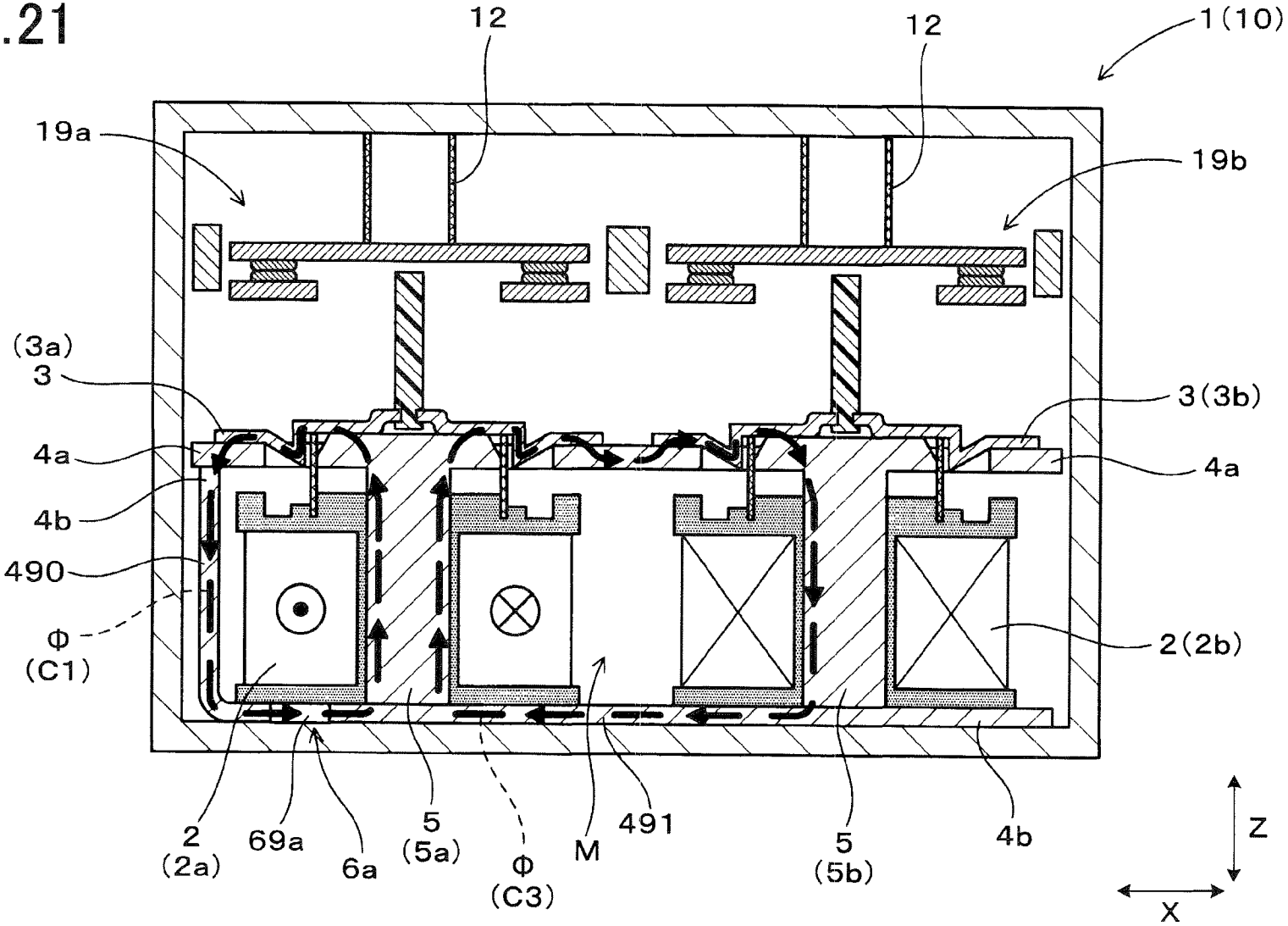
FIG. 21 is a sectional view of a solenoid device in which a second magnetic coil is deenergized following a dual-energized mode in the seventh embodiment.

When the second magnetic coil 2*b* is, as illustrated in FIG. 21, deenergized while the first magnetic coil 2*a* is kept energized following the dual-energized mode, the magnetic flux Φ of the first magnetic coil 2*a* continues to partially flow through the third magnetic circuit C3, thus keeping the plungers 3*a* and 3*b* attracted.

Other arrangements, operations, and beneficial effects are the same as in the first embodiment.

This embodiment has only the first magnetically-saturated portion S6*a* formed in the second yoke 4*b*, but however, may additionally include the second magnetically-saturated portion S6*b*.

Eighth Embodiment

Figure 22:
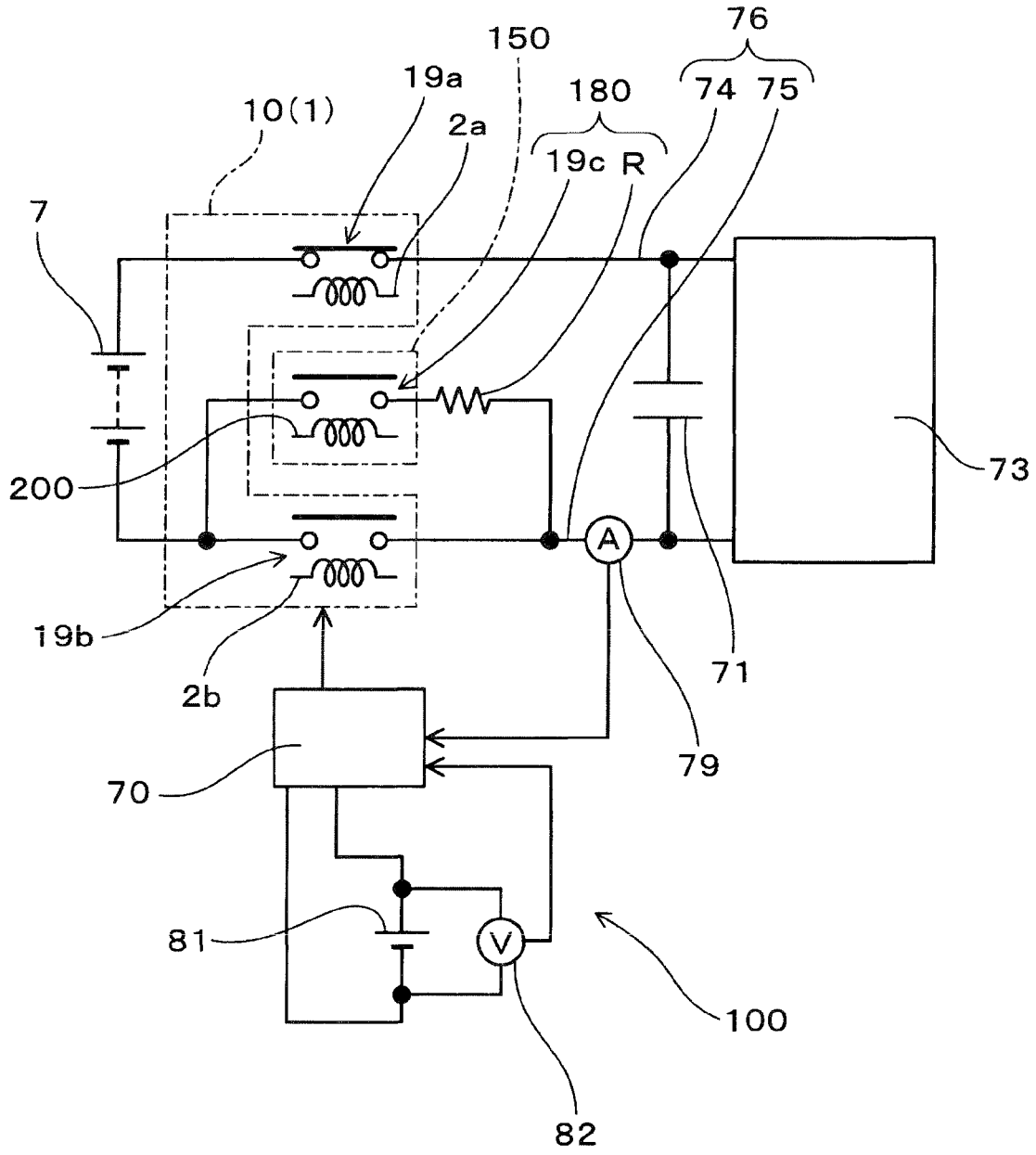
FIG. 22 is a circuit diagram of a solenoid control system which performs a sticking check in the eighth embodiment.

This embodiment is different in a circuit using the electromagnetic relay 10 from the first embodiment. The positive wire 74, as illustrated in FIG. 22, has the first switch 19*a* installed therein. The negative wire 75 has the second switch 19*b* installed therein. This embodiment has a series-connected assembly 180 of a pre-charge resistance R and a pre-charge switch 19*c* which are connected in series. The series-connected assembly 180 is connected in parallel to the second switch 19*b*. The first switch 19*a* and the second switch 19*b* are disposed in the electromagnetic relay 10 (i.e., the solenoid device 1). The pre-charge switch 19 is mounted in a pre-charging electromagnetic relay 150 which is made as a member separate from the electromagnetic relay 1.

This embodiment serves to check whether the switches 19*a* to 19*c* have been stuck or not before the electronic device 73 (DC-DC converter) starts to be driven. Such a sticking check is achieved by first using, as illustrated in FIG. 22, the control circuit 70 to turn on only the first switch 19*a* that is one of the three switches 19*a* to 19*c*. If the second switch 19*b* or the pre-charge switch 19*e* is stuck, it will cause the current to flow from the dc power supply 7 to charge the smoothing capacitor 71. The current sensor 7, therefore, detects the current. When the current sensor 79 has detected the current, the control circuit 70 determines that either one of the switches 19*b* and 19*c* is stuck and then inhibits the electronic device 73 from starting to be driven.

Figure 23:
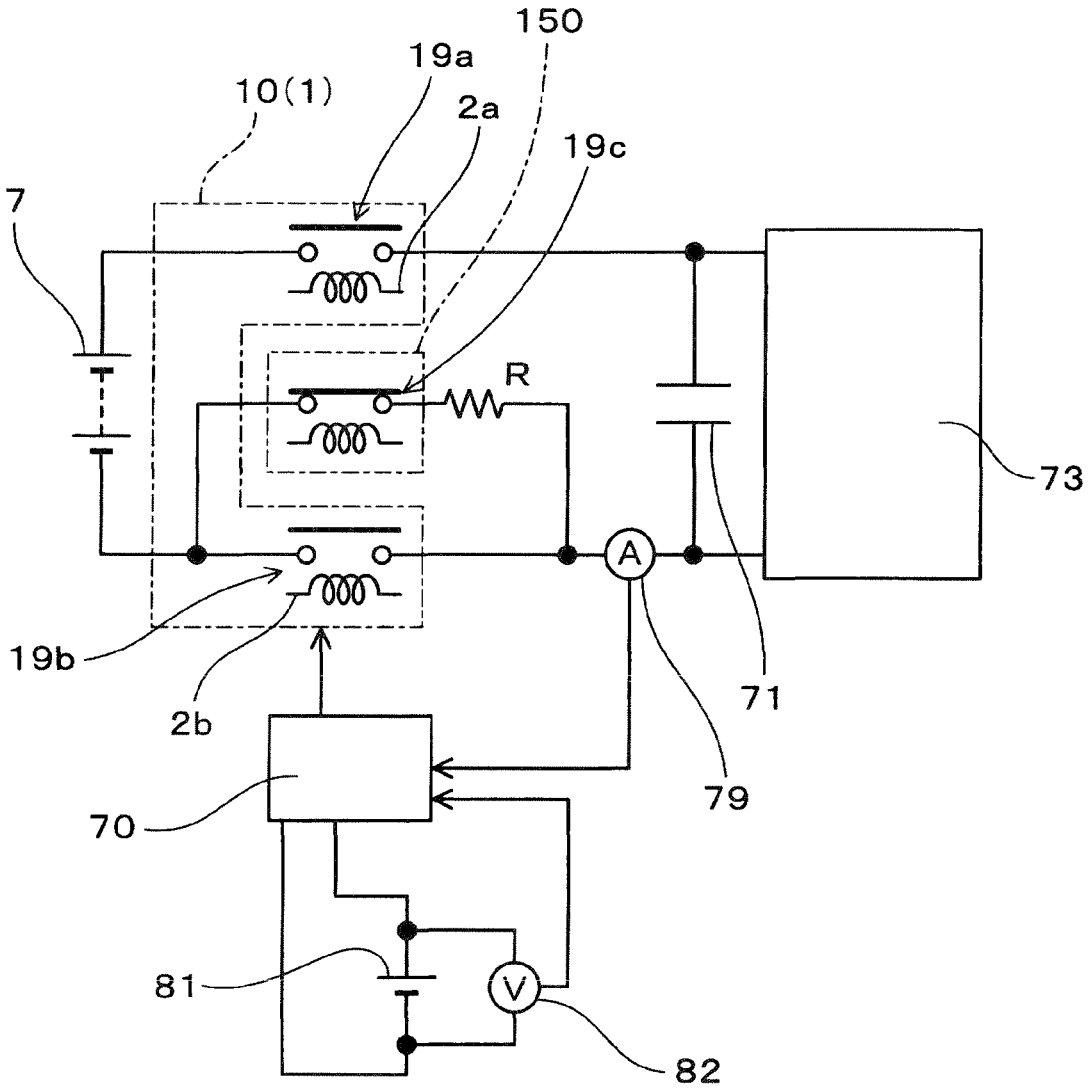
FIG. 23 is a circuit diagram which explains an operation following that in FIG. 22 when a check is performed for sticking.

When the current sensor 79 does not detect the current, and it is determined that both the second switch 19*b* and the pre-charge switch 19*c* are not stuck, the control circuit 70, as illustrated in FIG. 23, turns off the first switch 19*a* and then turns on the pre-charge switch 19*c*. If the first switch 19*a* is stuck, it will cause the current to flow out of the dc power supply 7 to charge the smoothing capacitor 71. The current sensor 79, thus, detects the current. When the current is detected, the control circuit 70 inhibits the electronic device 73 from starting to be driven.

Figure 24:
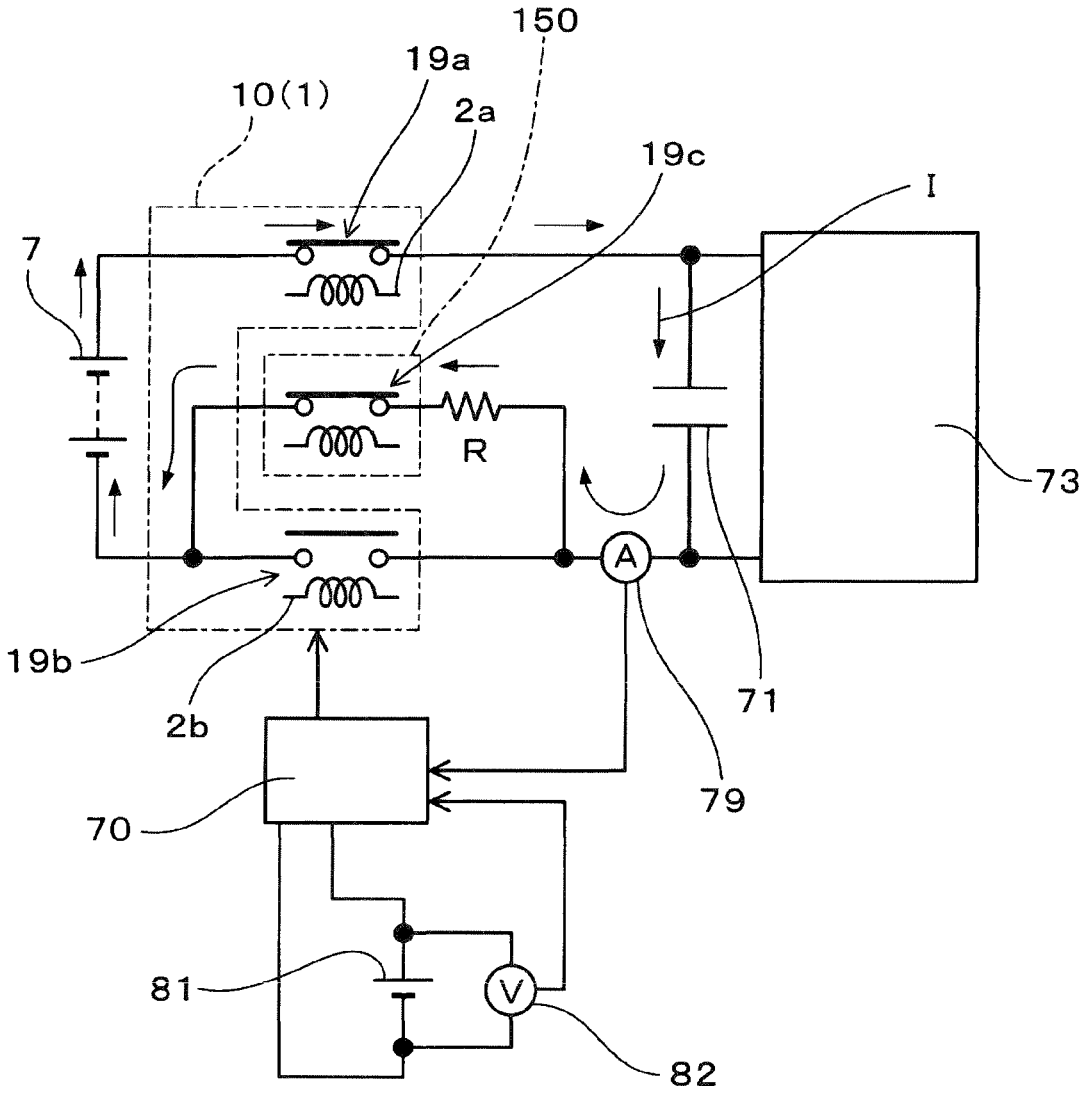
FIG. 24 is a circuit diagram which explains an operation following that in FIG. 23 when a capacitor is pre-charged.

When it is determined that all the switches 19*a* to 19*c* are not stuck, the first switch 19*a* and the pre-charge switch 19*c* are, as illustrated in FIG. 24, turned on. This causes the current I to flow from the dc power supply 7 to charge the smoothing capacitor 71. The current I passes through the pre-charge resistor R, so that a large amount of current does not flow to the smoothing capacitor 71, and the smoothing capacitor 71 is charged gradually.

Figure 25:
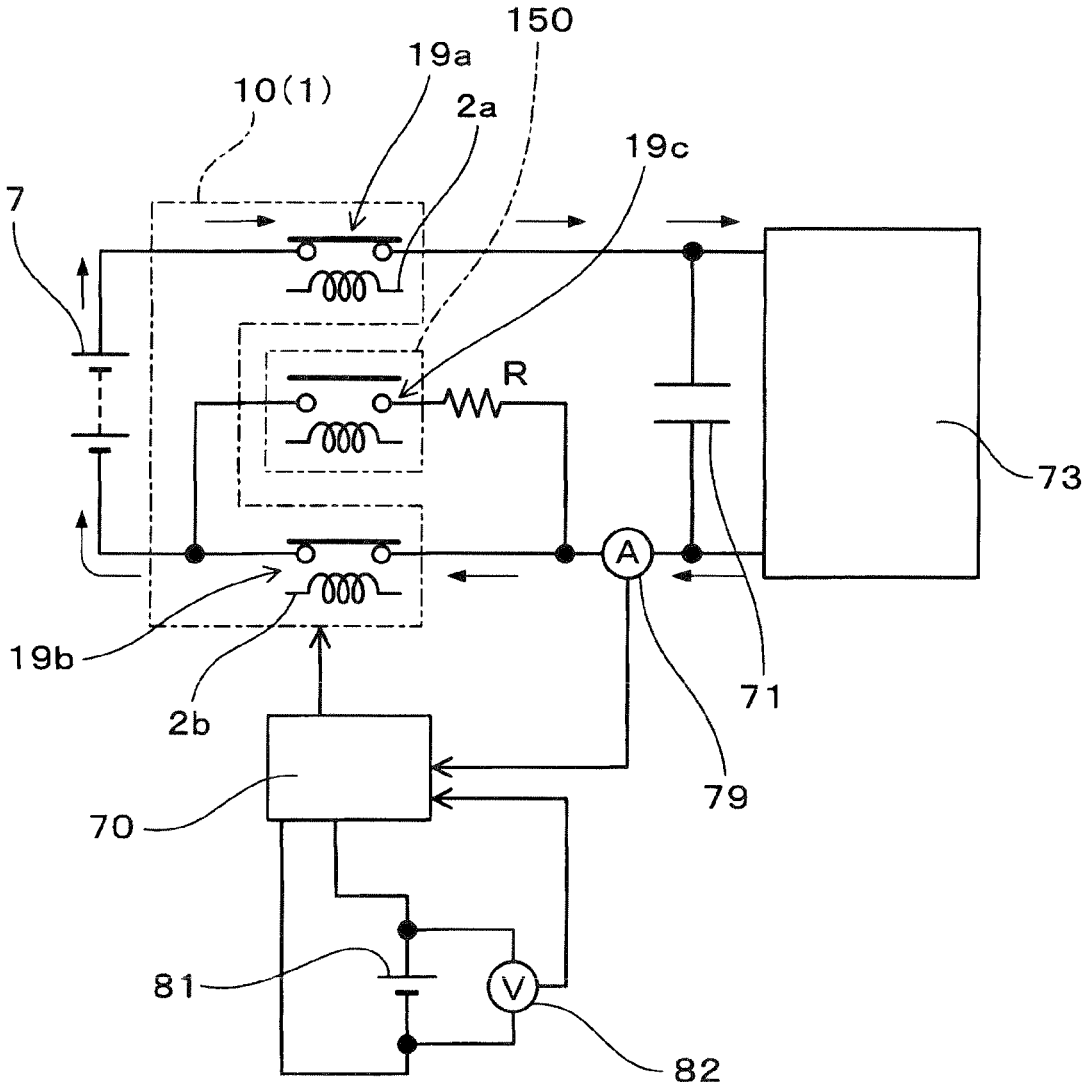
FIG. 25 is a circuit diagram which explains an operation following that in FIG. 24 when an electronic device is driven.

Upon completion of charging of the smoothing capacitor 71, no current will flow. When the current I is not detected by the current sensor 79, the control circuit 70, as illustrated in FIG. 25, turns on the first switch 19*a* and the second switch 19*b*, turns off the pre-charge switch 19*c*, and supplies the power from the dc power supply 7 to the electronic device 73 through the switches 19*a* and 19*b*.

If the first switch 19*a* and the second switch 19*b* are turned on when the smoothing capacitor 71 is not charged, it may cause the inrush current to flow through the smoothing capacitor 71, so that the switches 19*a* and 19*b* get stuck. However, the flow of the inrush current upon turning on of the switches 19*a* and 19*b* is, as described above, avoided by pre-charging the smoothing capacitor 71 through the pre-charge resistor R, thus preventing the switches 19*a* and 19*b* from being stuck.

Other arrangements, operations, and beneficial effects are the same as in the first embodiment.

This embodiment determines that the switches 19 are stuck when the current sensor 79 detects the current, but does not necessarily need to use the current sensor 79. The sticking determination may be made using a voltage sensor which measures the voltage at the smoothing capacitor 71. For example, if the second switch 19*b* or the pre-charge switch 19*c* is stuck when the first switch 19*a* is turned on, the current will flow therethrough, so that the voltage arise at the smoothing capacitor 71. It is, thus, possible to determine that the second switch 19*b* or the pre-charge switch 19*c* has been stuck when the voltage sensor detects the voltage.

Ninth Embodiment

Figure 26:
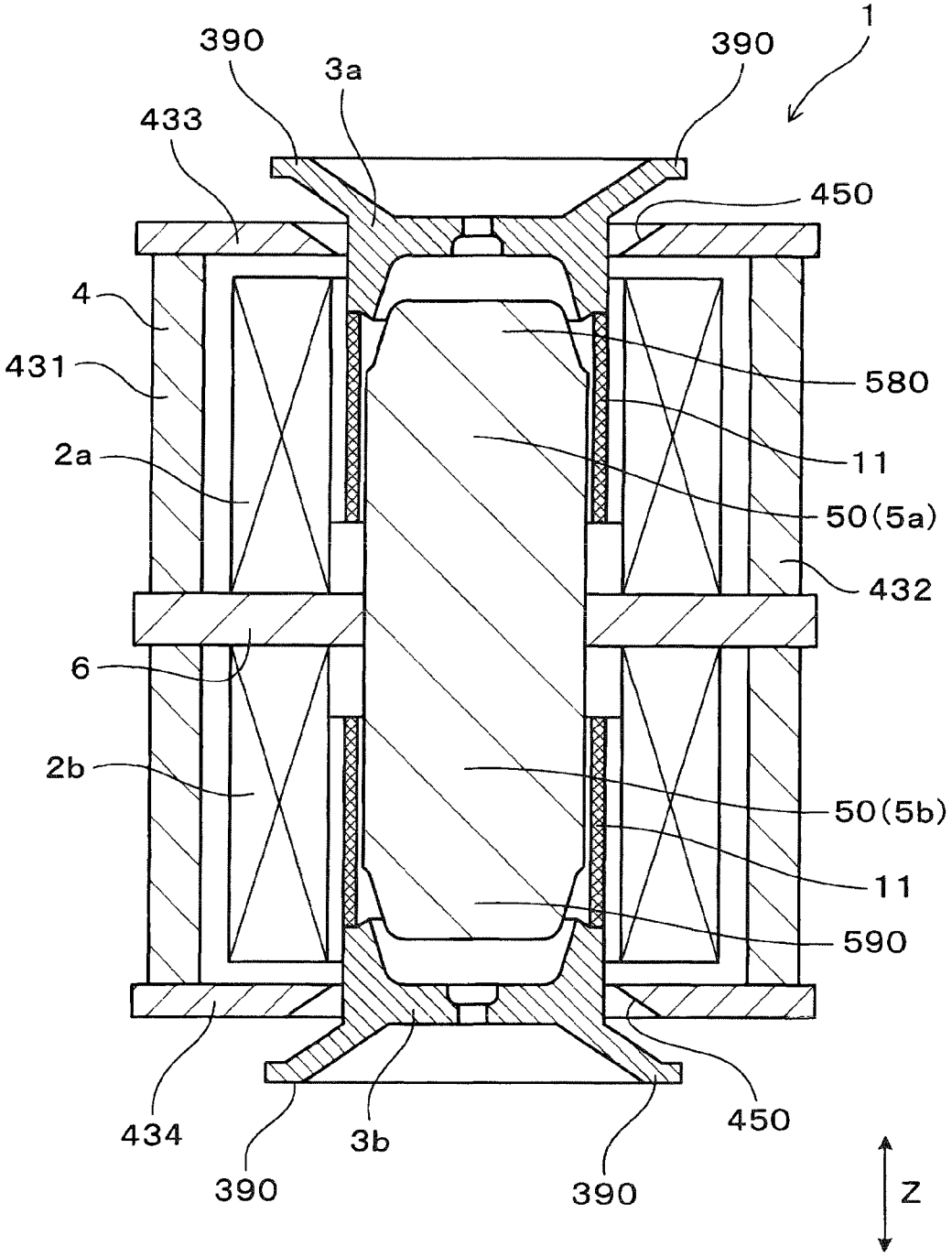
FIG. 26 is a sectional view of a solenoid device in the ninth embodiment.

This embodiment is an example in which the configurations of the stationary core 5 and the yoke 4 are modified. The first stationary core 5*a* and the second stationary core 5*b* are, as illustrated in FIG. 26, unified in the form of a single bar-like stationary core 50 extending in the Z-direction. The first plunger 3*a* is attracted to one of ends of the stationary core 50 in the Z-direction, that is, an end 580, while the second plunger 3*b* is attracted to the other of the ends of the stationary core 50 in the Z-direction, that is, an end 590. The first magnetic coil 2*a* is disposed outside the first stationary core 5*a*. The second magnetic coil 2*b* is arranged outside the second stationary core 5*b*.

This embodiment is, like the first embodiment, designed to turn on or off the switches 19*a* and 19*b* (not shown) through the frontward or backward movement of the plungers 3*a* and 3*b*.

Figure 27:
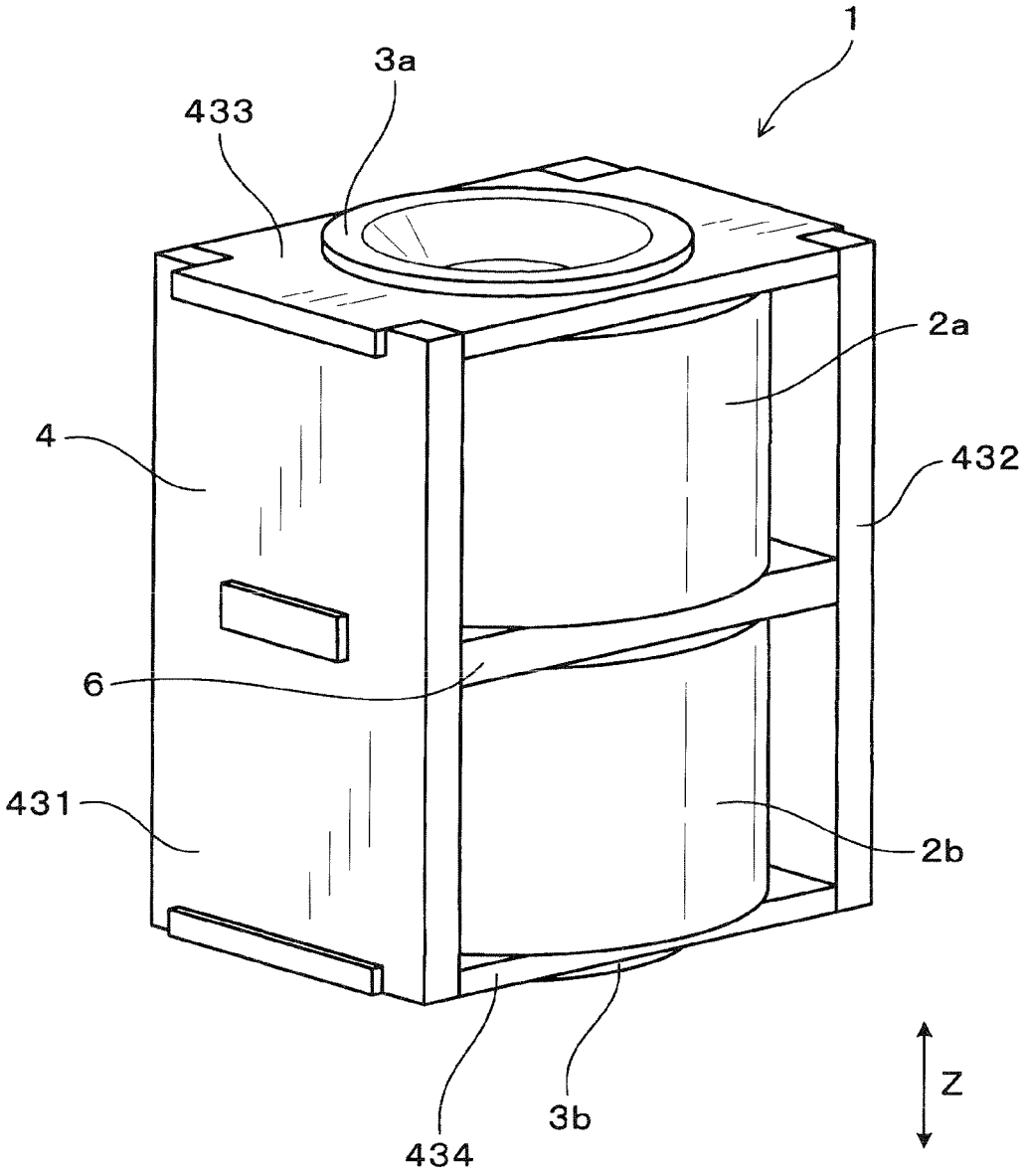
FIG. 27 is a perspective view of a solenoid device in the ninth embodiment.

The yoke 4 is, as illustrated in FIG. 27, arranged so as to surround the two magnetic coils 2*a* and 2*b*. The yoke 4 is made up of a first plate 431, a second plate 432, a third plate 433, and a fourth plate 434. The first plate 431 and the second plate 432 are parallel to each other and arranged to have a thickness-wise direction thereof oriented perpendicular to the Z-direction. The third plate 433 and the fourth plate 434 are parallel to each other and arranged to have a thickness-wise direction thereof oriented perpendicular to the Z-direction. The third plate 433 and the fourth plate 434, as illustrated in FIG. 26, have the through holes 450, respectively. Within the through holes 450, the plungers 3*a* and 3*b* are partly disposed. The plungers 3*a* and 3*b* are designed so that when they are moved frontward or backward, outer peripheries 390 thereof are brought into abutment with or moved away from the third plate 433 and the fourth plate 434, respectively.

The magnetically-saturated portion 6 made of soft magnetic material is, as illustrated in FIGS. 26 and 27, disposed between the magnetic coils 2*a* and 2*b*. The magnetically-saturated portion 6 is formed in the shape of a plate and connects with the first plate 431 and the second plate 432.

The solenoid device 1 preferably has the magnetically-saturated portion 6 formed therein, but does not necessarily need to have it. The magnetically-saturated portion 6 may be formed by making a through hole in the yoke or making a portion of the yoke thin. The magnetically-saturated portion 6 is formed effectively by partially decreasing a sectional area of the yoke constituting the magnetic circuit. The magnetically-saturated portion 6 may alternatively be formed by arranging a member in the magnetic circuit through which the magnetic flux Φ hardly flows. The magnetically-saturated portion 6 may also be formed by creating an air gap in the magnetic circuit.

Figure 28:
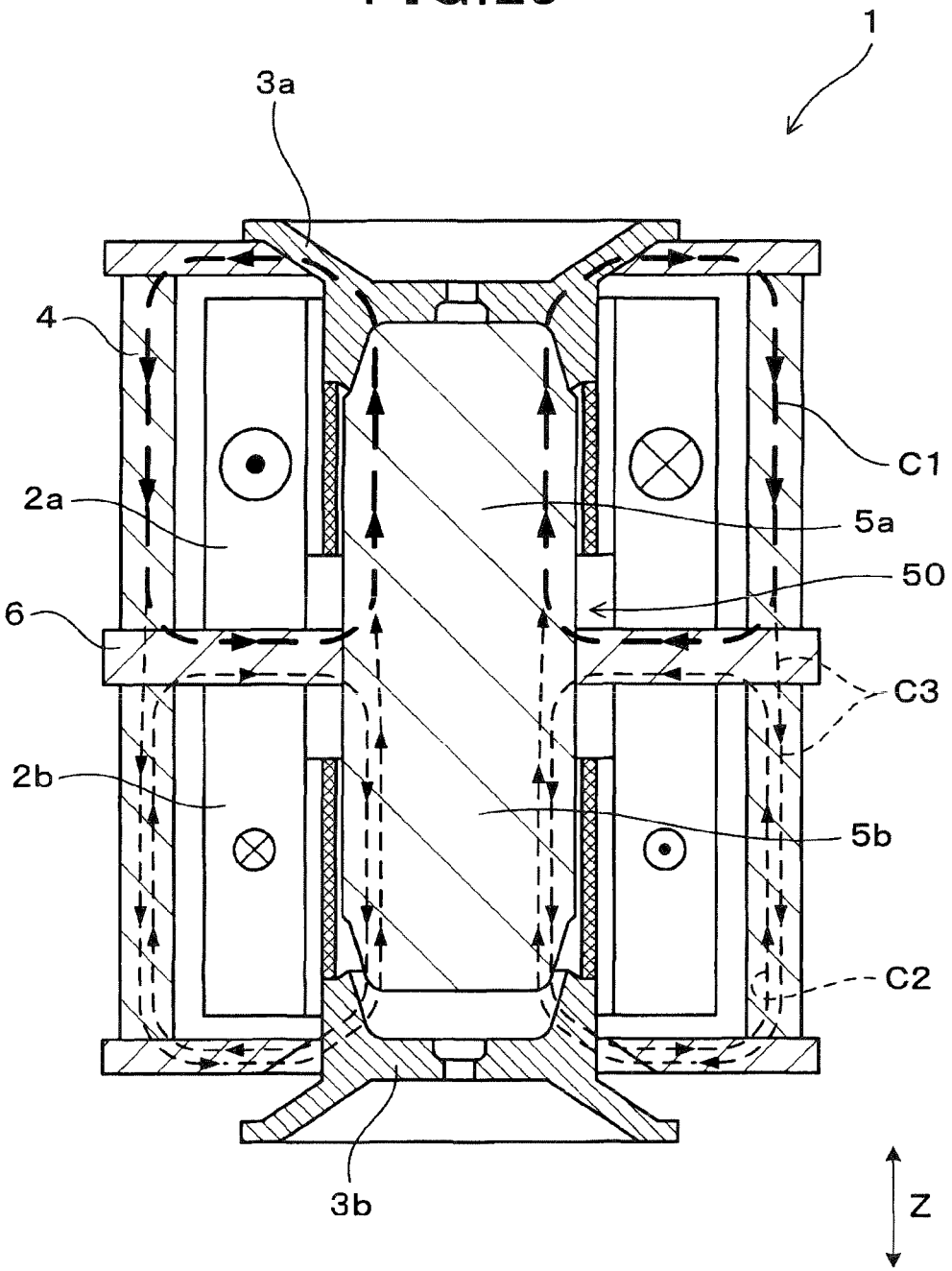
FIG. 28 is a sectional view of a solenoid device in which only a first plunger is attracted in the ninth embodiment.

When it is required to attract only the first plunger 3*a*, the current is, as shown in FIG. 28, delivered to the first magnetic coil 2*a*, while a small amount of current is supplied to the second magnetic coil 2*b*. The magnetic flux Φ, as generated by the first magnetic coil 2*a*, flows through the first magnetic circuit C1 including only the first stationary core 5*a*. The first magnetic circuit C1 is a circuit including the magnetically-saturated portion 6. A portion of the magnetic flux of the first magnetic coil 2*a* flows through the third magnetic circuit C3 including the first stationary core 5*a* and the second stationary core 5*b*. The magnetic flux Φ flowing in the third magnetic circuit C3 is cancelled by the magnetic flux Φ, as developed by the second magnetic coil 2*b*, thereby not attracting the second plunger 3*b*.

A portion of the magnetic flux Φ of the second magnetic coil 2*b* flows in the third magnetic circuit C3. Of the magnetic flux Φ of the second magnetic coil 2*b*, a portion flowing through the third magnetic circuit C3 is small in quantity and thus is omitted in the drawings.

Although not illustrated, it is possible to attract only the second plunger 3*b*. This is achieved by energizing the second magnetic coil 2*b* to attract the second plunger 3*b* and delivering a small amount of current to the first magnetic coil 2*a* to produce the magnetic flux Φ which cancels the magnetic flux Φ which is generated from the second coil 2*b* and flows through the third magnetic circuit C3. This attracts only the second plunger 3*b* without attracting the first plunger 3*a*.

Figure 29:
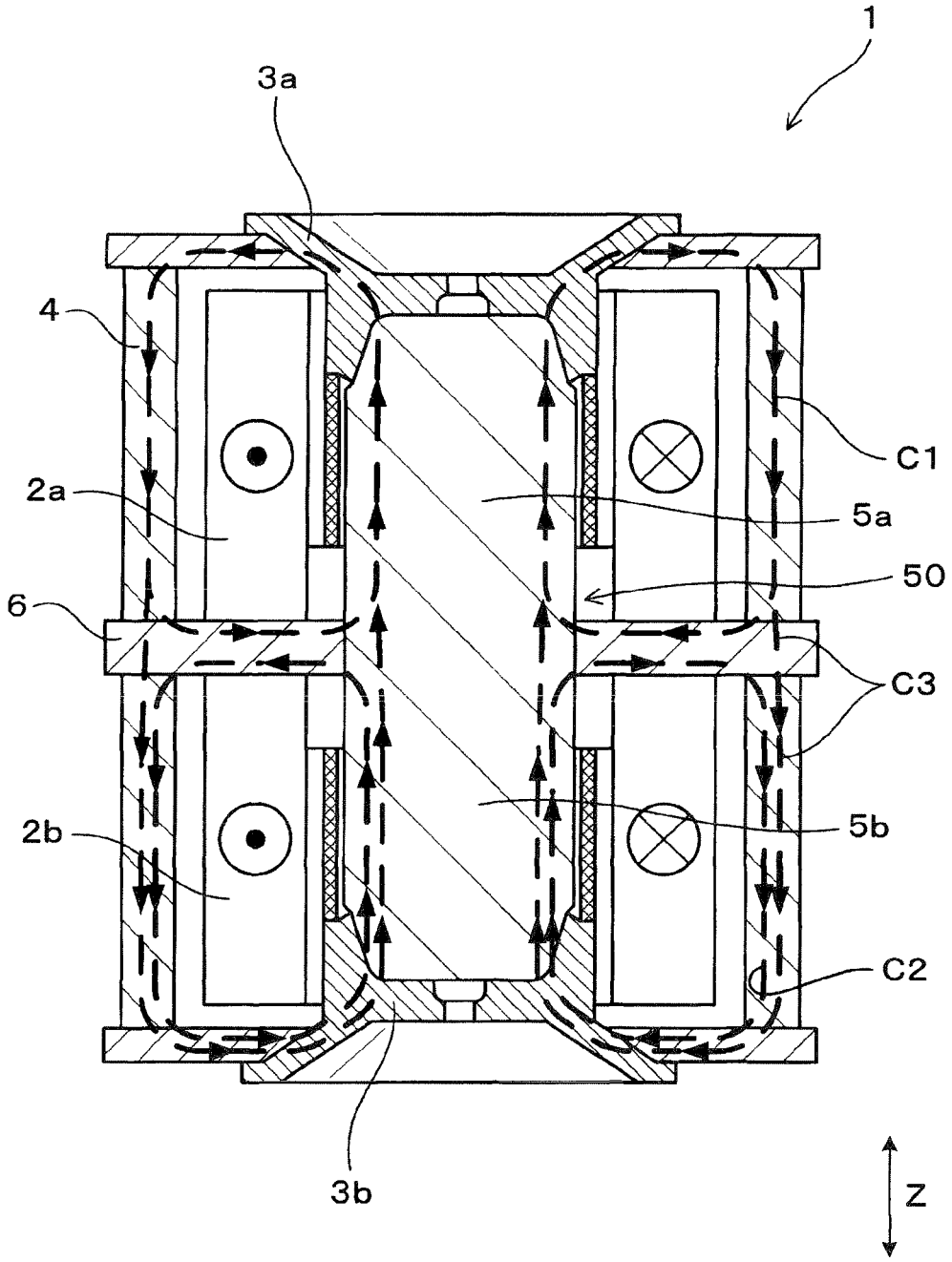
FIG. 29 is a sectional view of a solenoid device in which two plungers are attracted in a dual-energized mode in the ninth embodiment.

When it is required, as illustrated in FIG. 29, to attract the first plunger 3*a* and the second plunger 3*b*, the magnetic oils 2*a* and 2*b* are both energized. This causes the magnetic flux Φ, as generated from the first magnetic coil 2*a*, to flow through the first magnetic circuit C1, thereby producing the magnetic force which attracts the first plunger 3*a*. The magnetic flux Φ, as generated from the second magnetic coil 2*b*, also flows through the second magnetic circuit C2, thereby producing the magnetic force which attracts the second plunger 3*b*. A portion of the magnetic flux Φ, as generated from the first magnetic coil 2*a*, also flows through the third magnetic circuit C3. A relatively large amount of the magnetic flux Φ flows in the third magnetic circuit C3.

Figure 30:
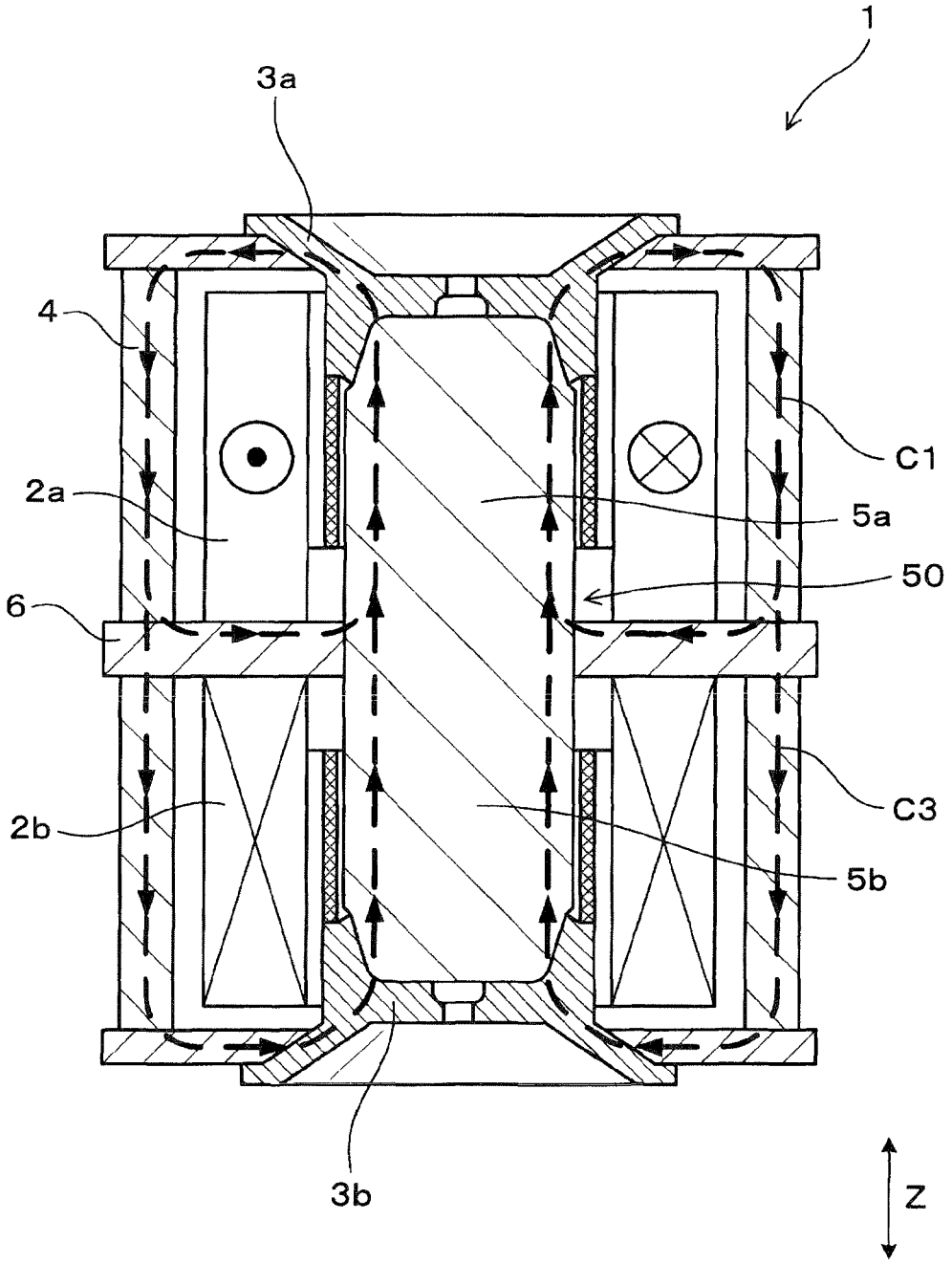
FIG. 30 is a sectional view of a solenoid device when a second magnetic coil is deenergized following a dual-energized mode.

When the second magnetic coil 2*b* is deenergized, as illustrated in FIG. 30, while the first magnetic coil 2*a* is kept energized following the dual-energized mode, it will cause the magnetic flux Φ, as generated from the first magnetic coil 2*a*, to flow through the first magnetic circuit C1 and partially flow through the third magnetic circuit C3. This creates the magnetic force to keep the first plunger 3*a* and the second plunger 3*b* attracted.

This embodiment, as described above, has the magnetically-saturated portion 6 formed in the first magnetic circuit C1. This causes the magnetic flux Φ of the first magnetic coil 2*a* to be saturated in the magnetically-saturated portion 6, thereby facilitating the flow of the magnetic flux Φ through the third magnetic circuit C3.

After the plungers 3*a* and 3*b* are attracted, the gaps G between the cores 5 (5*a* and 5*b*) and the plungers 3 (3*a* and 3*b*) are minimized. This enables a large amount of magnetic flux Φ to be developed by a small magnetomotive force. It is, thus, possible to use the single magnetic coil 2 (the first magnetic coil 2*a* in this embodiment) to continue to attract the two plungers 3*a* and 3*b*.

Although not illustrated, it is possible to continue to attract the first plunger 3*a* and the second plunger 3*b* even when the first magnetic coil 2*a* is deenergized, while the second magnetic coil 2*b* is kept energized following the dual-energized mode.

The operation and effects of this embodiment will be described below. In this embodiment, the direction (i.e., the downward side in the drawings) in which the first plunger 3*a* is attracted to the stationary core 50 and the direction (i.e., the upward side in the drawings) in which the second plunger 3*b* is attracted to the stationary core 50 are opposite to each other. This prevents the plungers 3*a* and 3*b* from being simultaneously moved close to the stationary core 50 by, for example, application of strong external vibrations to the solenoid device 1. The switches 19*a* and 19*b* (see FIG. 22) are, therefore, not turned on simultaneously upon the application of the vibrations to the solenoid device 1. In the case where the solenoid device 1 is used in the circuit of FIG. 22, the simultaneous turning on of the switches 19*a* and 19*b* when the smoothing capacitor 71 is not charged may cause the inrush current to flow through the switches 19*a* and 19*b* so that they are stuck. The solenoid device of this embodiment makes the switches 19*a* and 19*b* less likely to be turned on simultaneously, thus alleviating the above problem.

Other arrangements, operations, and beneficial effects are the same as in the first embodiment.

Tenth Embodiment

This embodiment is different in structure of the magnetic coils 2*a* and 2*b* from the first embodiment. The conductive wire of the second magnetic coil 2*b* is thinner than that of the first magnetic coil 2*a*. The second magnetic coil 2*b* is, therefore, smaller in size and weight than the first magnetic coil 2*a*. The amount of copper used in the second magnetic coil 2*b* is smaller than that in the first magnetic coil 2*a*, thus resulting in a decrease in production cost.

The conductive wire of the second magnetic coil 2*b* is, as described above, thinner than that of the first magnetic coil 2*a*, so that the electric resistance of the second magnetic coil 2*b* is high, and the amount of current flowing through the second magnetic coil 2*b* is small. The second magnetic coil 2*b* is, thus, lower in power consumption and magnetomotive force than the first magnetic coil 2*a*.

Figure 31:
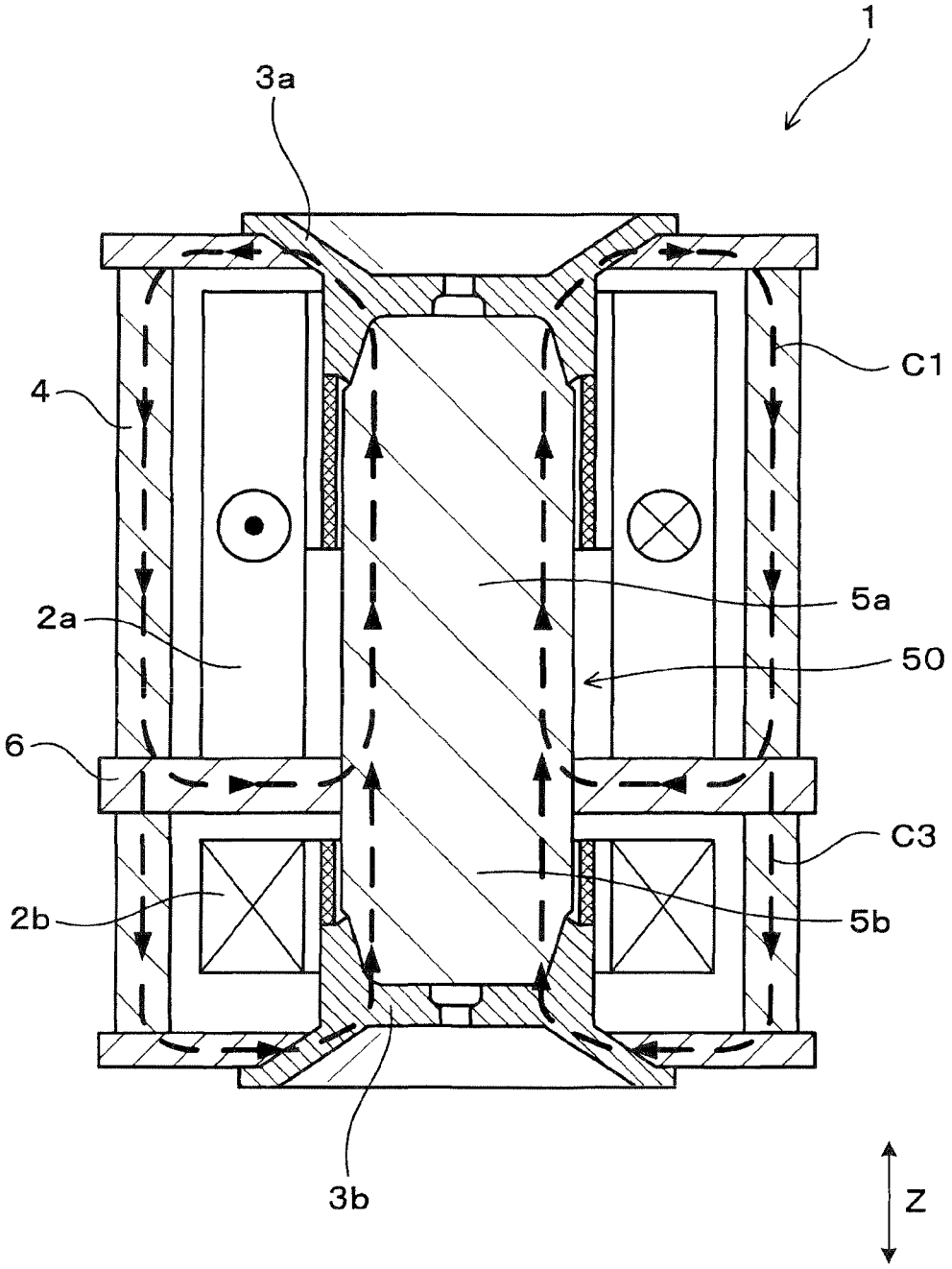
FIG. 31 is a sectional view of a solenoid device when a dual-energized mode is switched, so that only a first magnetic coil is energized to attract two plungers in the tenth embodiment.

This embodiment is, as illustrated in FIG. 31, designed to attract both the plungers 3*a* and 3*b* with the magnetic flux Φ, as generated from the first magnetic coil 2, when the dual-deenergized mode is switched to the mode in which only the first magnetic coil 2*a* is energized. Specifically, the magnetic flux Φ of the first magnetic coil 2*a* continues to flow through the first magnetic circuit C1, thereby producing the magnetic force which attracts the first plunger 3*a*. A portion of the magnetic flux Φ flows through the third magnetic circuit C3, thereby producing the magnetic force which attracts the second plunger 3*b*.

The magnetically-saturated portion 6 is formed in the first magnetic circuit C1, so that the magnetic flux Φ of the first magnetic coil 2*a* is saturated in the magnetically-saturated portion 6, thereby facilitating the flow of the magnetic flux Φ through the third magnetic circuit C3.

Figure 32:
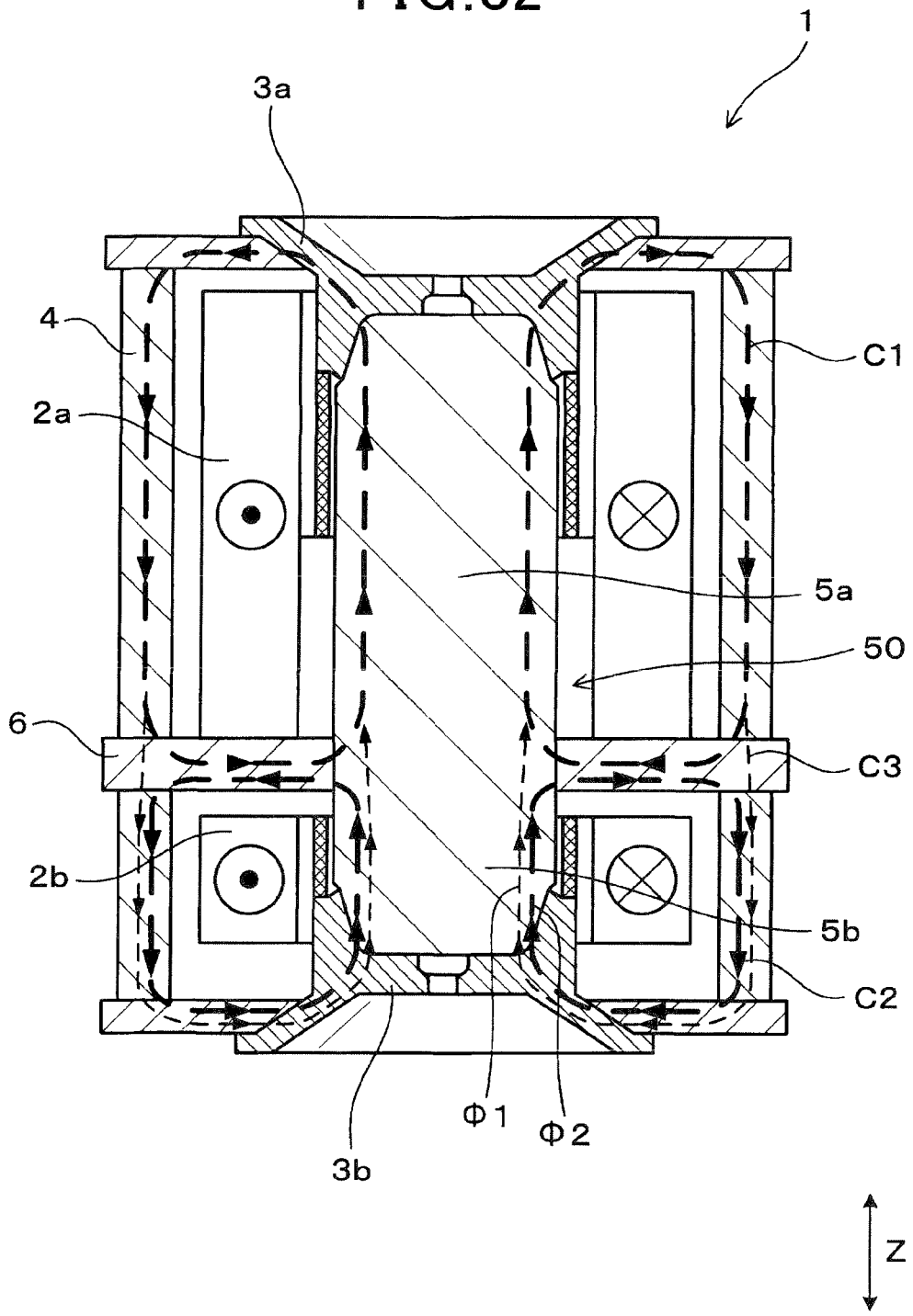
FIG. 32 is a sectional view of a solenoid device in which two plungers are attracted in a dual-energized mode in the tenth embodiment.

When the first magnetic coil 2*a* and the second magnetic coil 2*b* are, as illustrated in FIG. 32, energized simultaneously, the plungers 3*a* and 3*b* are both attracted. The directions of currents to be delivered to the first magnetic coil 2*a* and the second magnetic coil 2*b* are so set that the magnetic flux Φ of the first magnetic coil 2*a* flowing through the third magnetic circuit C3 and the magnetic flux Φ of the second magnetic coil 2*b* flowing through the second magnetic circuit C2 will be oriented in the same direction in the second plunger core 5*b*. The directions of the currents are controlled by the above described control circuit 70 (see FIG. 22).

Figure 33:
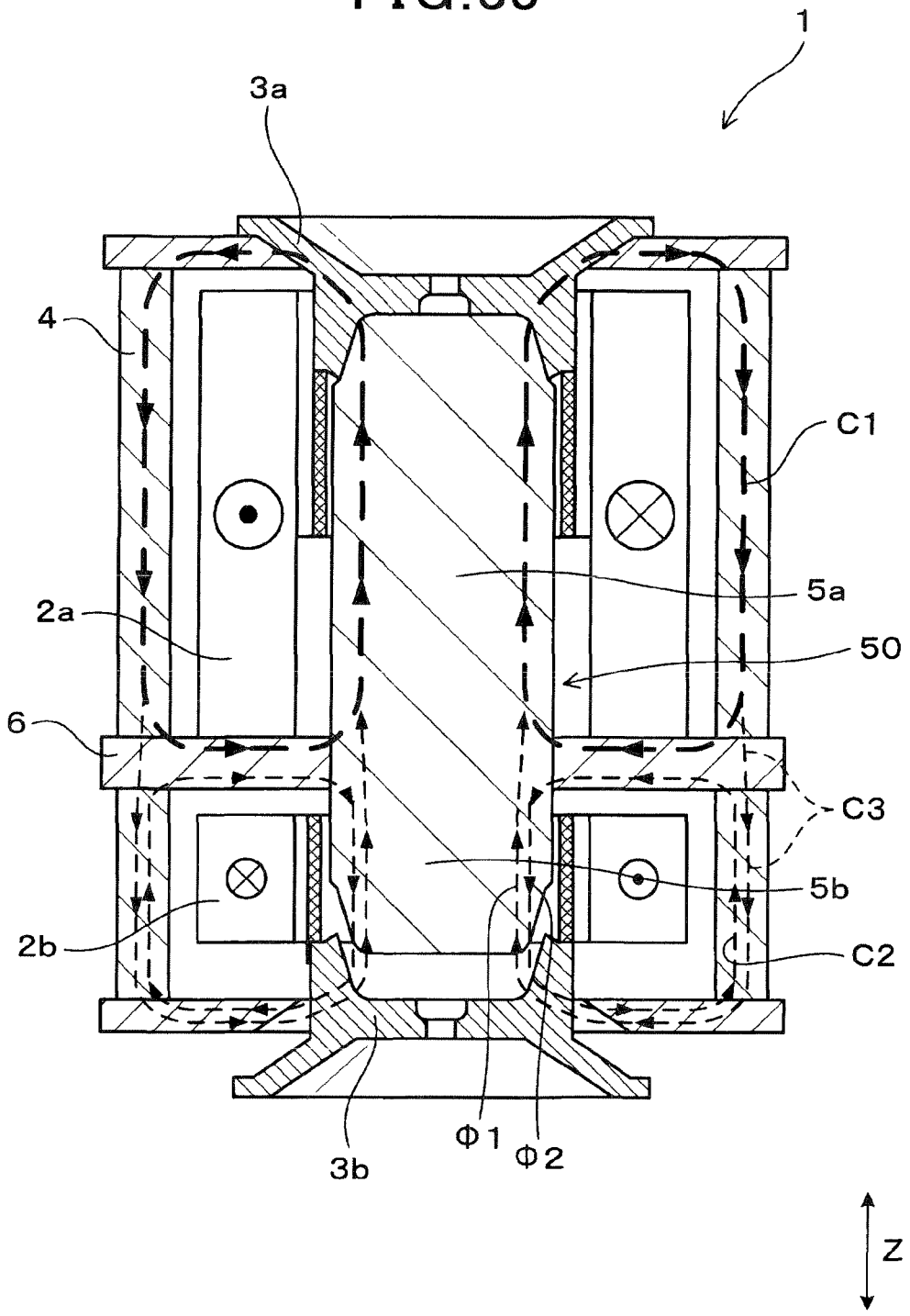
FIG. 33 is a sectional view of a solenoid device in which only a first plunger is attracted in the tenth embodiment.

When the first plunger 3*a* is, as illustrated in FIG. 33, attracted, the first magnetic coil 2*a* is also energized to deliver the current to the second magnetic coil 2*b*. The magnetic flux Φ2 of the second magnetic coil 2*a* cancels, of the magnetic flux Φ which is produced by the first magnetic coil 2*a* and flows through the third magnetic circuit C3, a portion Φ1 flowing between the second stationary core 5*b* and the second plunger 3*b*. This prevents the second plunger 3*b* from being attracted by the magnetic flux Φ1 of the first magnetic coil 2*a*

The magnetic flux Φ of the second magnetic coil 2*b* partially flows through the third magnetic circuit C3. Of the magnetic flux Φ of the second magnetic coil 2*b*, a portion flowing through the third magnetic circuit C3 is small in quantity and thus is omitted in the drawings.

Although not illustrated, it is possible to attract only the second plunger 3*b*. This is achieved by energizing the second magnetic coil 2*b* to attract the second plunger 3*b* and delivering a small amount of current to the first magnetic coil 2*a* to produce the magnetic flux Φ which cancels the magnetic flux Φ which is generated from the second coil 2*b* and flows through the third magnetic circuit C3. This attracts only the second plunger 3*b* without attracting the first plunger 3*a*.

Figure 34:
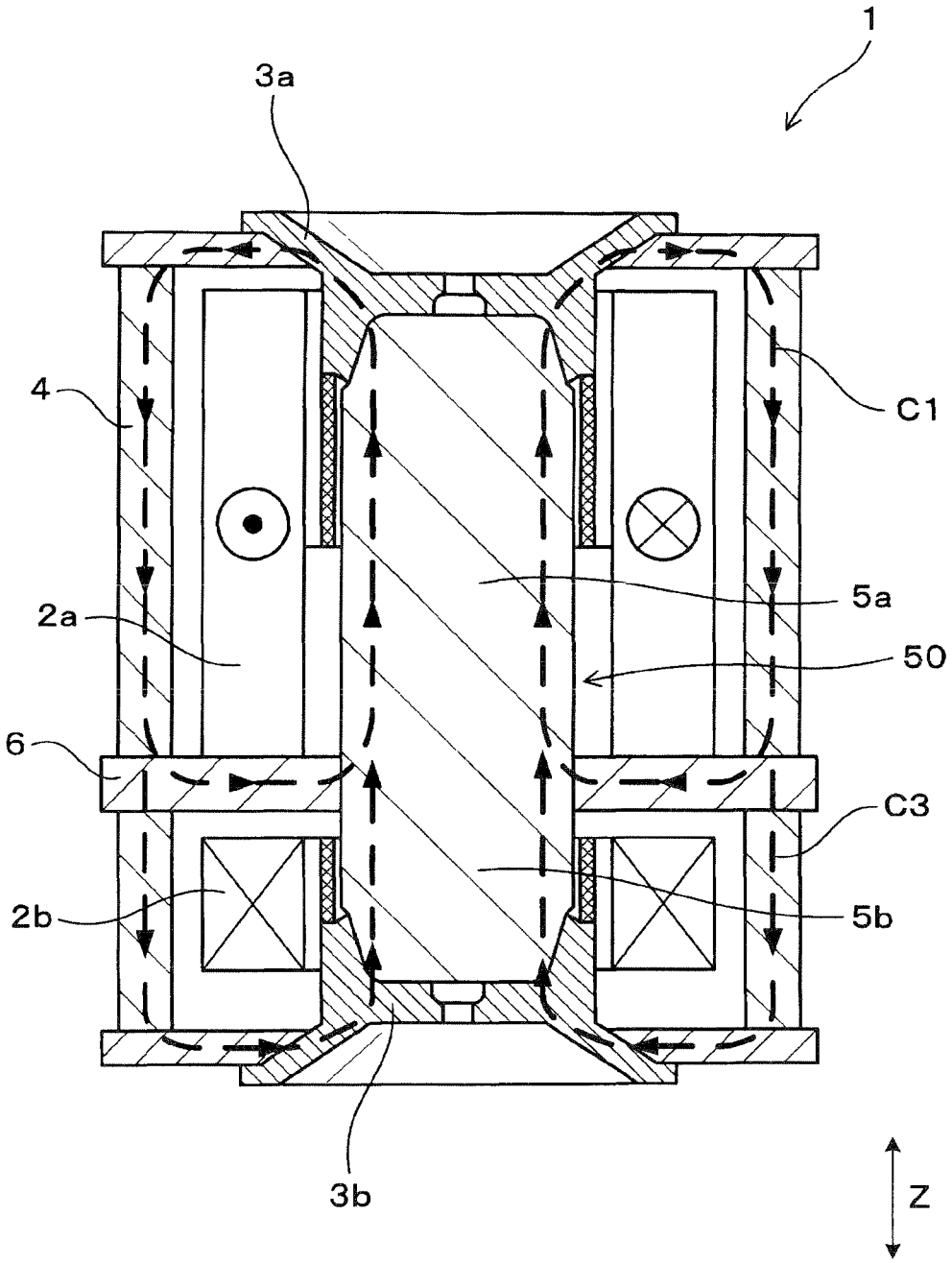
FIG. 34 is a sectional view of a solenoid device when a second magnetic coil is deenergized following a dual-energized mode in the tenth embodiment.
Figure 35:
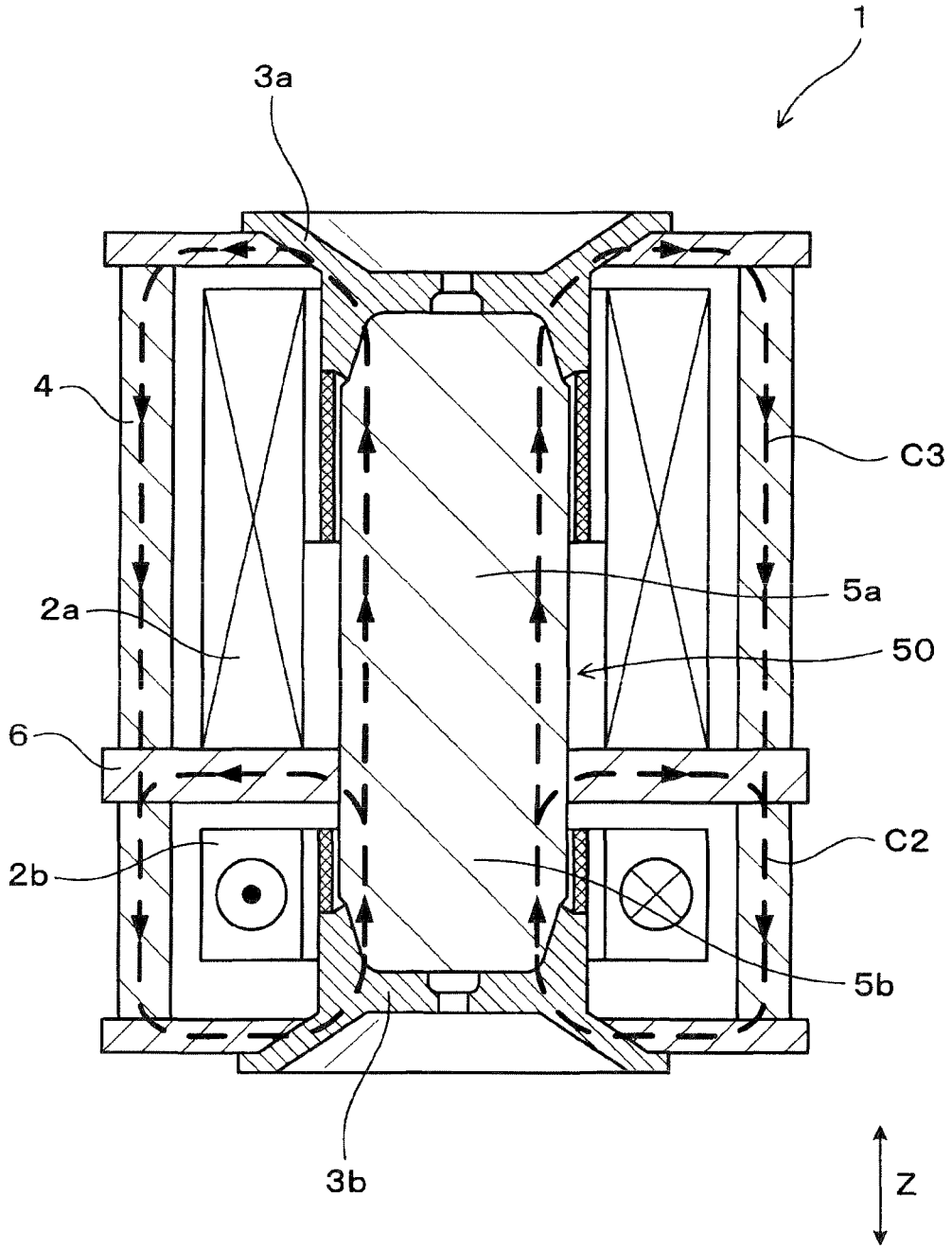
FIG. 35 is a sectional view of a solenoid device when a first magnetic coil is deenergized following a dual-energized mode in the tenth embodiment.

It is also possible to continue to attract the plungers 3*a* and 3*b* (i.e. a dual-attracting mode) when the magnetic coils 2*a* and 2*b* are both deenergized following the dual-energized mode (see FIG. 32). Specifically, the dual-attracting mode is established when the dual-energized mode (see FIG. 32) is switched to the mode, as illustrated in FIG. 34, in which the first magnetic coil 2*a* is kept energized, while the second magnetic coil 2*b* is deenergized. Alternatively, the dual-attracting mode is also established when the dual-energized mode (see FIG. 32) is switched to the mode, as illustrated in FIG. 35, in which the second magnetic coil 2*b* is kept energized, while the first magnetic coil 2*a* is deenergized.

The second magnetic coil 2*b* is, as described above, lower in power consumption than the first magnetic coil 2*a*. This embodiment is designed to energize only the second magnetic coil 2*b* (see FIG. 35) to maintain the dual-attracting mode, thereby further decreasing the power consumption. Specifically, the solenoid control system 100 is, like in the eighth embodiment (see FIG. 22), controlled in operation by the control circuit 70. The control circuit 70 connects with the power supply 81. The control circuit 70 controls the amounts and directions of current to be delivered from the power supply 81 to the magnetic coils 3*a* and 3*b*. The power supply 81 has the voltage sensor 82 installed therein. When the voltage V, as measured by the voltage sensor 82, is higher than a given reference value Vs, only the second magnetic coil 2*b* which is lower in power consumption is energized (see FIG. 35) to maintain the dual-attracting mode, thereby further reducing the power consumption of the whole of the solenoid device 1. Alternatively, when the voltage V at the power supply 81 is lower than the given reference value Vs, the energization of only the second magnetic coil 2*b* in which the magnetomotive force is lower may result in a difficulty in creating the magnetomotive force sufficient to maintain the dual-attracting mode. This embodiment is, thus, designed to energize only the first magnetic coil 2*a*, as illustrated in FIG. 34, in which the magnetomotive force is higher to maintain the dual-energized mode when the voltage V at the power supply 81 is lower than the given reference value Vs. This ensure the stability in maintaining the dual-attracting mode.

Figure 36:
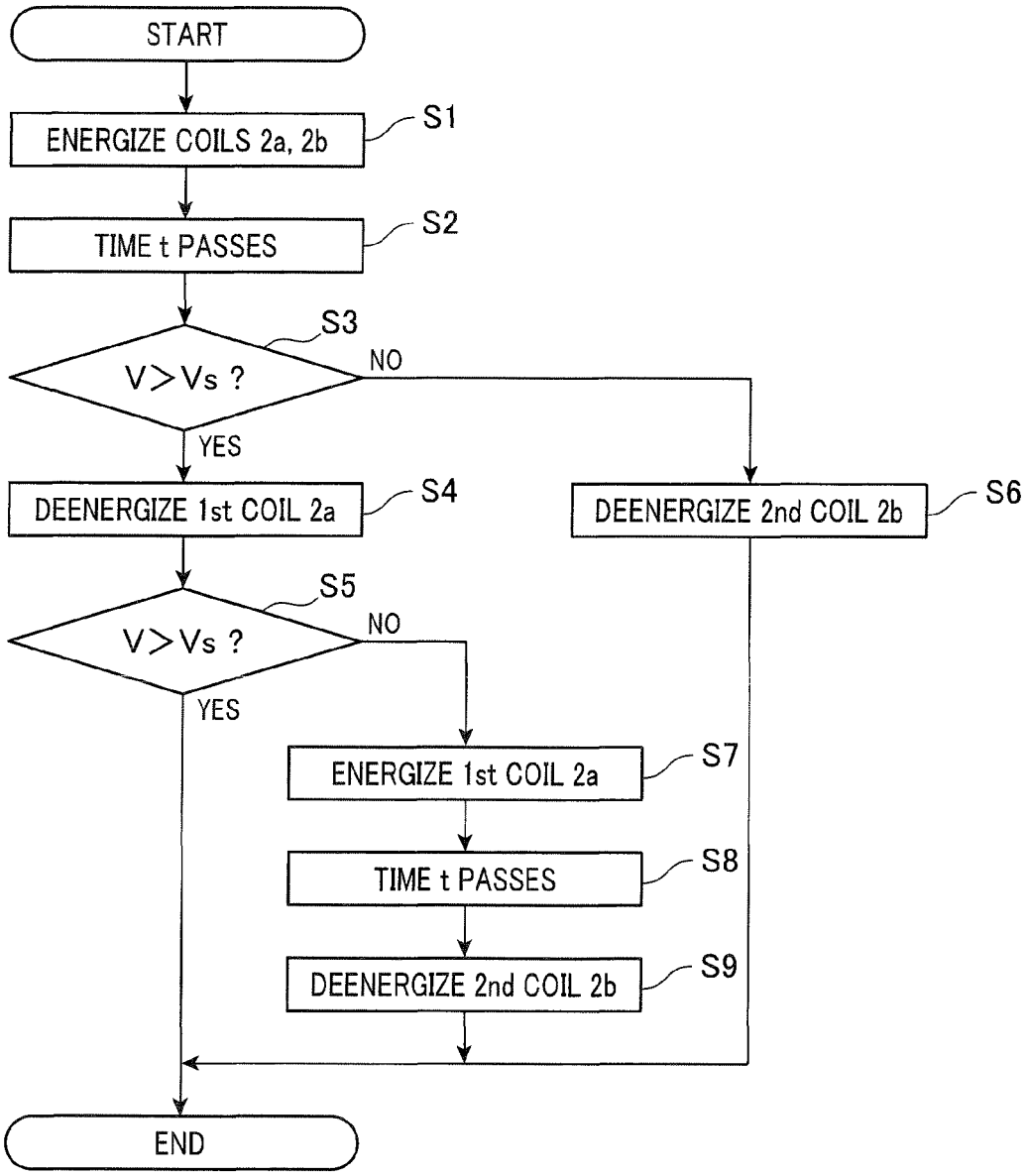
FIG. 36 is a flowchart for a control circuit in the tenth embodiment.

The flowchart in the control circuit 70 is illustrated in FIG. 36. Prior to execution of a program of the flowchart of FIG. 36, the check for sticking of the switches 19*a* to 19*c* (see FIGS. 22 and 23) and the pre-charging operation on the smoothing capacitor 71 (see FIG. 24) are performed. Upon completion of such operations, step S1 of FIG. 36 is executed. Specifically, the magnetic coils 2*a* and 2*b* are both energized (see FIG. 32) to attract the plungers 3*a* and 3*b*. Subsequently, steps S2 and S3 are performed in sequence. In step S2, the routine waits for a given period of time. In step S3, it is determined whether the voltage V at the power supply 81 is higher than the reference value Vs or not (step S3).

If a NO answer is obtained in step S3, the routine proceeds to step S6 wherein the second magnetic coil 2*b* is deenergized while the first magnetic coil 2*a* is kept energized (see FIG. 34). Alternatively, of a YES answer is obtained in step S3 meaning that it is determined that the voltage V at the power supply 81 is higher than the reference value Vs, then the routine proceeds to step S4 wherein the first magnetic coil 2*a* is deenergized, while the second magnetic coil 2*b* is kept energized (see FIG. 35).

By performing steps S3, S4, and S6, either one of the magnetic coils 2*a* and 2*b* is energized to maintain the dual-attracting mode, thus resulting in a decrease in power consumption of the whole of the solenoid device 1. When the voltage V at the power supply 81 is higher than the reference value Vs, only the second magnetic coil 2*b* in which the power consumption is lower is energized, thus resulting in a more decrease in power consumption. Alternatively, when the voltage V at the power supply 81 is lower than the reference value Vs, the first magnetic coil 2*a* in which the magnetomotive force is higher is energized, thereby ensuring the stability in maintaining the dual-attracting mode.

After step S4, the routine proceeds to step S5 wherein the voltage V at the power supply 81 is checked again. If a YES answer is obtained meaning that the voltage V is higher than the reference value Vs, the routine terminates. Alternatively, if a NO answer is obtained meaning that the voltage V is lower than the reference value Vs, the routine performs steps S7 to S9 to switch to the mode in which only the first magnetic coil 2*a* is energized. Specifically, in step S7, the first magnetic coil 2*a* is energized. After a lapse of the given period of time (step S8), the second magnetic coil 2*b* is deenergized while the first magnetic coil 2*a* is kept energized (step S9).

The execution of steps S5, S7 to S9 in the above way ensures the stability in maintaining the dual-attracting mode. Specifically, when the voltage V at the power supply 81 drops below the reference value Vs after only the second magnetic coil 2*b* is kept energized in step S4, the mode in which only the first magnetic coil 2*a* in which the magnetomotive force is higher is energized is established (steps S7 to S9) This ensures the stability in maintaining the dual-attracting mode even when the voltage V at the power supply 81 has dropped.

Other arrangements, operations, and beneficial effects are the same as in the ninth embodiment.

Eleventh Embodiment

Figure 37:
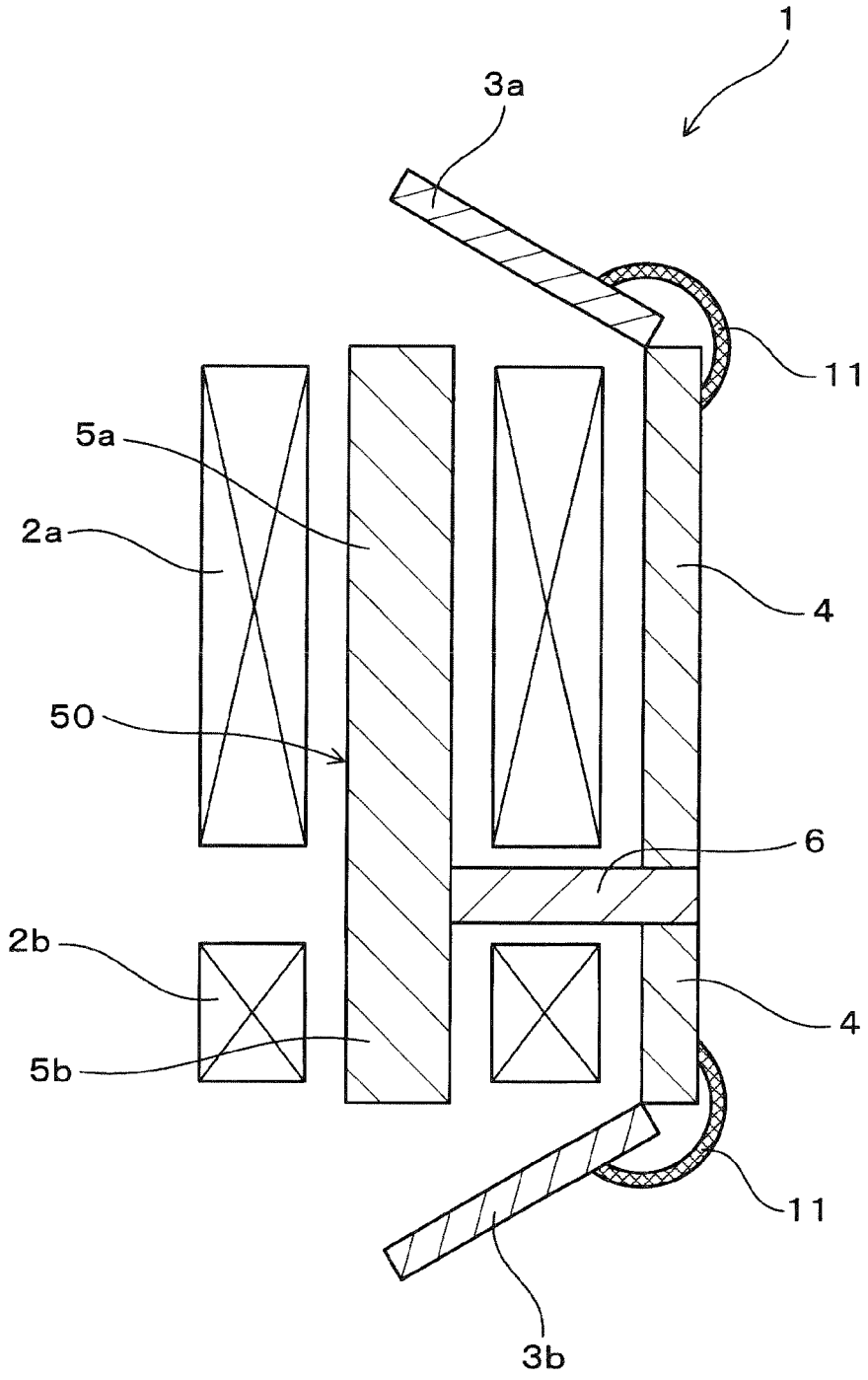
FIG. 37 is a sectional view of a solenoid device in the eleventh embodiment.

This embodiment is an example where the configuration of the plungers 3*a* and 3*b* is modified. This embodiment, as illustrated in FIG. 37, employs the hinge-type plungers 3*a* and 3*b*. The plungers 3*a* and 3*b* are secured to the yoke 4 to be pivotable. The plungers 3*a* and 3*b* have springs 11 installed thereon. When the magnetic coils 2*a* and 2*b* are deenergized, the plungers 3*a* and 3*b* are moved by the elastic force, as produced by the springs 11, away from the stationary cores 5*a* and 5*b*, respectively. This embodiment is also designed so that the energization of the magnetic coils 2*a* and 2*b* will result in generation of the magnetic force which attracts the plungers 3*a* and 3*b* to the stationary cores 5*a* and 5*b* against the elastic force, as produced by the springs 11.

Other arrangements, operations, and beneficial effects are the same as in the tenth embodiment.

What is claimed is:

1. A solenoid device comprising:

a first magnetic coil and a second magnetic coil which are energized to produce magnetic fluxes;

a first plunger which is moved frontward or backward by energization of the first magnetic coil;

a second plunger which is moved frontward or backward by energization of the second magnetic coil;

a first stationary core which is disposed so as to face the first plunger in a frontward/backward movement direction of the first plunger;

a second stationary core which is disposed so as to face the second plunger in a frontward/backward movement direction of the second plunger; and a yoke which is disposed outside the first and second magnetic coils, wherein in a dual-deenergized mode in which the above two magnetic coils are both deenergized, gaps are created between the first plunger and the first stationary core and between the second plunger and the second stationary core, wherein when the first magnetic coil is energized, the magnetic flux of the first magnetic coil flows through a first magnetic circuit which includes only the first stationary core, thereby producing a magnetic force which attracts the first plunger to the first stationary core, wherein when the second magnetic coil is energized, the magnetic flux of the second magnetic coil flows through a second magnetic circuit which includes only the second stationary core, thereby producing a magnetic force which attracts the second plunger to the second stationary core, wherein in a dual-energized mode in which the above two magnetic coils are both energized, the magnetic fluxes of the two magnetic coils flow through the first and second magnetic circuits, thereby producing a magnetic force which attracts the first and second plungers, and a portion of the magnetic flux of the first magnetic coil flows through a third magnetic circuit which includes the above two stationary cores, wherein when the second magnetic coil is deenergized while the first magnetic coil is kept energized following the dual-energized mode, the magnetic flux of the first magnetic coil flows through the first magnetic circuit and the third magnetic circuit, thereby producing magnetic forces to maintain a dual-attracting mode in which the first plunger is attracted to the first stationary core, and the second plunger is attracted to the second stationary core, and wherein the first magnetic circuit has formed therein a first magnetically-saturated portion where the magnetic flux flowing through the first magnetic circuit is saturated.

2. A solenoid control system which includes the solenoid device, as set forth in claim 1, and a control circuit which controls the solenoid device, wherein the control circuit controls directions of currents to be delivered to the first magnetic coil and the second magnetic coil in the dual-energized mode so that the magnetic flux of the first magnetic coil which flows through the third magnetic circuit and the magnetic flux of the second magnetic coil which flows through the second magnetic circuit are oriented in the same direction in the second stationary core.

3. A solenoid control system which includes the solenoid device, as set forth in claim 1, and a control circuit which controls the solenoid device, wherein when the first magnetic coil is energized to attract the first plunger to the first stationary core without attracting the second plunger to the second stationary core, the control circuit works to deliver the current to the second magnetic coil so that the magnetic flux of the second magnetic coil cancels of the magnetic flux which is produced by the first magnetic coil and flows through the third magnetic circuit, a portion flowing through the second stationary core and the second plunger.

4. A solenoid device as set forth in claim 1, wherein the first stationary core and the second stationary core are unified in the form of a single bar-like stationary core in the frontward/backward direction, wherein the first plunger is attracted to one of ends of the single stationary core in the frontward/backward movement direction, while the second plunger is attracted to the other of the ends of the single stationary core in the frontward/backward movement direction.

5. A solenoid device as set forth in claim 1, wherein the number of turns of the second magnetic coil is smaller than that of the first magnetic coil.

6. A solenoid device as set forth in claim 1, wherein the third magnetic circuit has formed therein a third magnetically-saturated portion where the magnetic flux flowing through the third magnetic circuit is saturated.

7. A solenoid control system which includes the solenoid device, as set forth in claim 1, and a control circuit which controls the solenoid device, wherein the second magnetic coil is lower in power consumption and magnetomotive force thereof than the first magnetic coil, wherein the control circuit measures a voltage at a power supply which delivers electric power to the above two magnetic coils, wherein when the measured voltage is lower than a given reference voltage, the control circuit deenergizes the second magnetic coil while energizing the first magnetic coil following the dual-energized mode, so that a magnetic force, as crated by the magnetic flux of the first magnetic coil flowing through the first magnetic circuit and the third magnetic circuit, maintains the dual-attracting mode, and wherein when the above voltage is higher than the given reference voltage, the control circuit deenergizes the first coil while energizing the second magnetic coil following the dual-energized mode, so that a magnetic force, as crated by the magnetic flux of the second magnetic coil flowing through the second magnetic circuit and the third magnetic circuit, maintains the dual-attracting mode.

8. A solenoid device comprising:

a first magnetic coil and a second magnetic coil which are energized to produce magnetic fluxes;

a first plunger which is moved frontward or backward by energization of the first magnetic coil;

a second plunger which is moved frontward or backward by energization of the second magnetic coil;

a first stationary core which is disposed so as to face the first plunger in a frontward/backward movement direction of the first plunger;

a second stationary core which is disposed so as to face the second plunger in a frontward/backward movement direction of the second plunger; and a yoke which is disposed outside the first and second magnetic coils, wherein in a dual-deenergized mode in which the above two magnetic coils are both deenergized, gaps are created between the first plunger and the first stationary core and between the second plunger and the second stationary core, wherein when the first magnetic coil is energized, the magnetic flux of the first magnetic coil flows through a first magnetic circuit which includes only the first stationary core, thereby producing a magnetic force which attracts the first plunger to the first stationary core, wherein when the second magnetic coil is energized, the magnetic flux of the second magnetic coil flows through a second magnetic circuit which includes only the second stationary core, thereby producing a magnetic force which attracts the second plunger to the second stationary core, wherein in a dual-energized mode in which the above two magnetic coils are both energized, the magnetic fluxes of the two magnetic coils flow through the first and second magnetic circuits, thereby producing a magnetic force which attracts the first and second plungers, and a portion of the magnetic flux of the first magnetic coil flows through a third magnetic circuit which includes the above two stationary cores, wherein when the second magnetic coil is deenergized while the first magnetic coil is kept energized following the dual-energized mode, the magnetic flux of the first magnetic coil flows through the first magnetic circuit and the third magnetic circuit, thereby producing magnetic forces to maintain a dual-attracting mode in which the first plunger is attracted to the first stationary core, and the second plunger is attracted to the second stationary core, and wherein the third magnetic circuit has formed therein a third magnetically-saturated portion where the magnetic flux flowing through the third magnetic circuit is saturated.

9. A solenoid device comprising:

a first magnetic coil and a second magnetic coil which are energized to produce magnetic fluxes;

a first plunger which is moved frontward or backward by energization of the first magnetic coil;

a second plunger which is moved frontward or backward by energization of the second magnetic coil;

a first stationary core which is disposed so as to face the first plunger in a frontward/backward movement direction of the first plunger;

a second stationary core which is disposed so as to face the second plunger in a frontward/backward movement direction of the second plunger; and a yoke which is disposed outside the first and second magnetic coils, wherein in a dual-deenergized mode in which the above two magnetic coils are both deenergized, gaps are created between the first plunger and the first stationary core and between the second plunger and the second stationary core, wherein when the first magnetic coil is energized, the magnetic flux of the first magnetic coil flows through a first magnetic circuit which includes only the first stationary core, thereby producing a magnetic force which attracts the first plunger to the first stationary core, wherein when the second magnetic coil is energized, the magnetic flux of the second magnetic coil flows through a second magnetic circuit which includes only the second stationary core, thereby producing a magnetic force which attracts the second plunger to the second stationary core, wherein in a dual-energized mode in which the above two magnetic coils are both energized, the magnetic fluxes of the two magnetic coils flow through the first and second magnetic circuits, thereby producing a magnetic force which attracts the first and second plungers, and a portion of the magnetic flux of the first magnetic coil flows through a third magnetic circuit which includes the above two stationary cores, wherein when the second magnetic coil is deenergized while the first magnetic coil is kept energized following the dual-energized mode, the magnetic flux of the first magnetic coil flows through the first magnetic circuit and the third magnetic circuit, thereby producing magnetic forces to maintain a dual-attracting mode in which the first plunger is attracted to the first stationary core, and the second plunger is attracted to the second stationary core, and wherein the number of turns of the second magnetic coil is smaller than that of the first magnetic coil.

10. A solenoid control system comprising:

a solenoid device comprising:

a first magnetic coil and a second magnetic coil which are energized to produce magnetic fluxes;

a first plunger which is moved frontward or backward by energization of the first magnetic coil;

a second plunger which is moved frontward or backward by energization of the second magnetic coil;

a first stationary core which is disposed so as to face the first plunger in a frontward/backward movement direction of the first plunger;

a second stationary core which is disposed so as to face the second plunger in a frontward/backward movement direction of the second plunger; and a yoke which is disposed outside the first and second magnetic coils, wherein in a dual-deenergized mode in which the above two magnetic coils are both deenergized, gaps are created between the first plunger and the first stationary core and between the second plunger and the second stationary core, wherein when the first magnetic coil is energized, the magnetic flux of the first magnetic coil flows through a first magnetic circuit which includes only the first stationary core, thereby producing a magnetic force which attracts the first plunger to the first stationary core, wherein when the second magnetic coil is energized, the magnetic flux of the second magnetic coil flows through a second magnetic circuit which includes only the second stationary core, thereby producing a magnetic force which attracts the second plunger to the second stationary core, wherein in a dual-energized mode in which the above two magnetic coils are both energized, the magnetic fluxes of the two magnetic coils flow through the first and second magnetic circuits, thereby producing a magnetic force which attracts the first and second plungers, and a portion of the magnetic flux of the first magnetic coil flows through a third magnetic circuit which includes the above two stationary cores, wherein when the second magnetic coil is deenergized while the first magnetic coil is kept energized following the dual-energized mode, the magnetic flux of the first magnetic coil flows through the first magnetic circuit and the third magnetic circuit, thereby producing magnetic forces to maintain a dual-attracting mode in which the first plunger is attracted to the first stationary core, and the second plunger is attracted to the second stationary core, wherein the solenoid control system further comprises a control circuit which controls the solenoid device, wherein the control circuit controls directions of currents to be delivered to the first magnetic coil and the second magnetic coil in the dual-energized mode so that the magnetic flux of the first magnetic coil which flows through the third magnetic circuit and the magnetic flux of the second magnetic coil which flows through the second magnetic circuit are oriented in the same direction in the second stationary core.

11. The solenoid control system as set forth in claim 10, wherein when the first magnetic coil is energized to attract the first plunger to the first stationary core without attracting the second plunger to the second stationary core, the control circuit works to deliver the current to the second magnetic coil so that the magnetic flux of the second magnetic coil cancels of the magnetic flux which is produced by the first magnetic coil and flows through the third magnetic circuit, a portion flowing through the second stationary core and the second plunger.

12. The solenoid control system as set forth in claim 10, wherein the first stationary core and the second stationary core are unified in the form of a single bar-like stationary core in the frontward/backward direction, wherein the first plunger is attracted to one of ends of the single stationary core in the frontward/backward movement direction, while the second plunger is attracted to the other of the ends of the single stationary core in the frontward/backward movement direction.

13. The solenoid control system as set forth in claim 10, wherein the number of turns of the second magnetic coil is smaller than that of the first magnetic coil.

14. The solenoid control system as set forth in claim 10, wherein the third magnetic circuit has formed therein a third magnetically-saturated portion where the magnetic flux flowing through the third magnetic circuit is saturated.

15. The solenoid control system as set forth in claim 10, wherein the second magnetic coil is lower in power consumption and magnetomotive force thereof than the first magnetic coil, wherein the control circuit measures a voltage at a power supply which delivers electric power to the above two magnetic coils, wherein when the measured voltage is lower than a given reference voltage, the control circuit deenergizes the second magnetic coil while energizing the first magnetic coil following the dual-energized mode, so that a magnetic force, as crated by the magnetic flux of the first magnetic coil flowing through the first magnetic circuit and the third magnetic circuit, maintains the dual-attracting mode, and wherein when the above voltage is higher than the given reference voltage, the control circuit deenergizes the first coil while energizing the second magnetic coil following the dual-energized mode, so that a magnetic force, as crated by the magnetic flux of the second magnetic coil flowing through the second magnetic circuit and the third magnetic circuit, maintains the dual-attracting mode.

16. A solenoid control system comprising:

a solenoid device comprising:

a first magnetic coil and a second magnetic coil which are energized to produce magnetic fluxes;

a first plunger which is moved frontward or backward by energization of the first magnetic coil;

a second plunger which is moved frontward or backward by energization of the second magnetic coil;

a first stationary core which is disposed so as to face the first plunger in a frontward/backward movement direction of the first plunger;

a second stationary core which is disposed so as to face the second plunger in a frontward/backward movement direction of the second plunger; and a yoke which is disposed outside the first and second magnetic coils, wherein in a dual-deenergized mode in which the above two magnetic coils are both deenergized, gaps are created between the first plunger and the first stationary core and between the second plunger and the second stationary core, wherein when the first magnetic coil is energized, the magnetic flux of the first magnetic coil flows through a first magnetic circuit which includes only the first stationary core, thereby producing a magnetic force which attracts the first plunger to the first stationary core, wherein when the second magnetic coil is energized, the magnetic flux of the second magnetic coil flows through a second magnetic circuit which includes only the second stationary core, thereby producing a magnetic force which attracts the second plunger to the second stationary core, wherein in a dual-energized mode in which the above two magnetic coils are both energized, the magnetic fluxes of the two magnetic coils flow through the first and second magnetic circuits, thereby producing a magnetic force which attracts the first and second plungers, and a portion of the magnetic flux of the first magnetic coil flows through a third magnetic circuit which includes the above two stationary cores, wherein when the second magnetic coil is deenergized while the first magnetic coil is kept energized following the dual-energized mode, the magnetic flux of the first magnetic coil flows through the first magnetic circuit and the third magnetic circuit, thereby producing magnetic forces to maintain a dual-attracting mode in which the first plunger is attracted to the first stationary core, and the second plunger is attracted to the second stationary core, wherein the solenoid control system further comprises a control circuit which controls the solenoid device, wherein when the first magnetic coil is energized to attract the first plunger to the first stationary core without attracting the second plunger to the second stationary core, the control circuit works to deliver the current to the second magnetic coil so that the magnetic flux of the second magnetic coil cancels of the magnetic flux which is produced by the first magnetic coil and flows through the third magnetic circuit, a portion flowing through the second stationary core and the second plunger.

17. The solenoid control system as set forth in claim 16, wherein the first stationary core and the second stationary core are unified in the form of a single bar-like stationary core in the frontward/backward direction, wherein the first plunger is attracted to one of ends of the single stationary core in the frontward/backward movement direction, while the second plunger is attracted to the other of the ends of the single stationary core in the frontward/backward movement direction.

18. The solenoid control system as set forth in claim 16, wherein the number of turns of the second magnetic coil is smaller than that of the first magnetic coil.

19. The solenoid control system as set forth in claim 16, wherein the third magnetic circuit has formed therein a third magnetically-saturated portion where the magnetic flux flowing through the third magnetic circuit is saturated.

20. The solenoid control system as set forth in claim 16, wherein the second magnetic coil is lower in power consumption and magnetomotive force thereof than the first magnetic coil, wherein the control circuit measures a voltage at a power supply which delivers electric power to the above two magnetic coils, wherein when the measured voltage is lower than a given reference voltage, the control circuit deenergizes the second magnetic coil while energizing the first magnetic coil following the dual-energized mode, so that a magnetic force, as crated by the magnetic flux of the first magnetic coil flowing through the first magnetic circuit and the third magnetic circuit, maintains the dual-attracting mode, and wherein when the above voltage is higher than the given reference voltage, the control circuit deenergizes the first coil while energizing the second magnetic coil following the dual-energized mode, so that a magnetic force, as crated by the magnetic flux of the second magnetic coil flowing through the second magnetic circuit and the third magnetic circuit, maintains the dual-attracting mode.

* * * * *